US010707043B2

(12) United States Patent
Yoneda

(10) Patent No.: US 10,707,043 B2
(45) Date of Patent: Jul. 7, 2020

(54) FUSE ELEMENT, FUSE DEVICE, AND HEAT-GENERATOR-INTEGRATED FUSE DEVICE

(71) Applicant: DEXERIALS CORPORATION, Tokyo (JP)

(72) Inventor: Yoshihiro Yoneda, Utsunomiya (JP)

(73) Assignee: DEXERIALS CORPORATION, Tokyo (JP)

( * ) Notice: Subject to any disclaimer, the term of this patent is extended or adjusted under 35 U.S.C. 154(b) by 0 days.

(21) Appl. No.: 15/514,616

(22) PCT Filed: Sep. 24, 2015

(86) PCT No.: PCT/JP2015/076913
§ 371 (c)(1),
(2) Date: Mar. 27, 2017

(87) PCT Pub. No.: WO2016/047681
PCT Pub. Date: Mar. 31, 2016

(65) Prior Publication Data

US 2017/0236673 A1 Aug. 17, 2017

(30) Foreign Application Priority Data

Sep. 26, 2014 (JP) ..... 2014-197630

(51) Int. Cl.
*H01H 85/08* (2006.01)
*H01H 85/06* (2006.01)
(Continued)

(52) U.S. Cl.
CPC ..... *H01H 85/08* (2013.01); *H01H 85/06* (2013.01); *H01H 85/10* (2013.01); *H01H 85/11* (2013.01);
(Continued)

(58) Field of Classification Search
CPC ..... H01H 85/08; H01H 85/12; H01H 85/06; H01H 85/143
(Continued)

(56) References Cited

U.S. PATENT DOCUMENTS 2,911,504 A * 11/1959 Cohn ..... H01G 9/0003 337/159
3,113,195 A * 12/1963 Kozacka ..... H01H 85/042 337/160
(Continued)

FOREIGN PATENT DOCUMENTS

JP 2001-006518 A 1/2001
JP 2001-216883 A 8/2001
(Continued)

OTHER PUBLICATIONS

Dec. 22, 2015 International Search Report issued in International Patent Application No. PCT/JP2015/076913.
(Continued)

*Primary Examiner* — Anatoly Vortman
(74) *Attorney, Agent, or Firm* — Oliff PLC

(57) ABSTRACT

A fuse device and a fuse element having excellent rapid blowout properties and excellent insulation properties after blowout even in a size-reduced fuse device are provided. A fuse element constitutes a current path of a fuse device and blows out due to self-generated heat when a rating-exceeding current flows, a length W in a width direction perpendicular to a conduction direction being greater than a total length L in the conduction direction in the fuse element. In particular, the fuse element includes a low melting point metal layer and a high melting point metal layer, the low melting point metal layer eroding the high melting point metal layer when current flows to cause blowout.

46 Claims, 27 Drawing Sheets

(51) Int. Cl.
*H01H 85/143* (2006.01)
*H01H 85/12* (2006.01)
*H01H 85/11* (2006.01)
*H01H 85/10* (2006.01)
*H01H 85/046* (2006.01)

(52) U.S. Cl.
CPC ..... *H01H 85/12* (2013.01); *H01H 85/143* (2013.01); *H01H 85/046* (2013.01)

(58) Field of Classification Search
USPC ..... 337/293
See application file for complete search history.

(56) References Cited

U.S. PATENT DOCUMENTS 3,152,233 A * 10/1964 Kozacka ..... H01H 85/0456 337/158
4,320,374 A * 3/1982 Narancic ..... H01H 85/06 337/162
4,331,947 A * 5/1982 Noerholm ..... H01H 85/046 337/159
4,706,059 A * 11/1987 Schmitt ..... H01H 85/046 337/283
5,453,726 A * 9/1995 Montgomery ..... H01H 85/046 29/623
5,479,147 A * 12/1995 Montgomery ..... H01H 85/0411 337/273
5,648,750 A * 7/1997 Yuza ..... H01H 85/0411 337/252
5,905,426 A * 5/1999 Douglass ..... H01H 85/10 337/228
5,977,860 A * 11/1999 Ulm, Jr. ..... H01H 69/022 337/227
7,928,827 B2 * 4/2011 Urrea ..... H01H 85/0417 337/161
2015/0002258 A1 * 1/2015 Yoshida ..... H01H 85/18 337/273
2016/0013001 A1 * 1/2016 Yoneda ..... H01H 85/11 337/227
2016/0172143 A1 * 6/2016 Yoneda ..... H01H 85/20 337/186
2016/0240342 A1 * 8/2016 Yoneda ..... H01H 69/02

FOREIGN PATENT DOCUMENTS

JP 2004-185960 A 7/2004
JP 2011-082064 A 4/2011
JP 2011-243504 A 12/2011
JP 2012-059719 A 3/2012
JP 2013-229293 A 11/2013
KR 2013-0114985 A 10/2013
WO 2013/146889 A1 10/2013

OTHER PUBLICATIONS

Jul. 26, 2019 Office Action issued in Korean Patent Application No. 10-2017-7010593.

* cited by examiner

FUSE ELEMENT, FUSE DEVICE, AND HEAT-GENERATOR-INTEGRATED FUSE DEVICE

TECHNICAL FIELD

The present disclosure relates to a fuse element, a fuse device, and a heat-generator-integrated fuse device having such a fuse element which is mounted on a current path and which blows out due to self-generated heat when a rating-exceeding current flows therethrough to interrupt the current path and especially relates to a fuse element, a fuse device, and a heat-generator-integrated fuse device having excellent rapid interruption properties and excellent insulation properties after blowout. This application claims priority to Japanese Patent Application No. 2014-197630 filed on Sep. 26, 2014, the entire content of which is hereby incorporated by reference.

BACKGROUND ART

Conventionally, fuse elements which blow out due to self-generated heat when a rating-exceeding current flows therethrough are used to interrupt a current path. Examples of often-used fuse elements include, for example, fuses fixed by a holder wherein solder is enclosed in glass, chip fuses wherein an Ag electrode is printed onto a ceramic substrate surface, and screw-in or insertion type fuses wherein part of a copper electrode is made thinner and assembled into a plastic case.

CITATION LIST

Patent Literature

PLT 1: Japanese Unexamined Patent Application Publication No. 2011-82064

SUMMARY OF THE INVENTION

Technical Problem

However, in the above-mentioned existing fuse elements, there have been problems such as inability to perform surface mounting using reflow, low current ratings, and degradation of rapid interruption properties when increasing ratings through enlargement.

Furthermore, in the case of a fuse device having rapid interruption properties to be mounted by reflow, to avoid melting due to reflow heat, it is generally preferable to use Pb-containing high melting point solder having a melting point of 300° C. or more in the fuse element in view of blowout properties. However, use of solder containing Pb is restricted with few exceptions under the RoHS directive and intensified demands for a transition to Pb-free products are expected.

Thus, there is a need to develop a fuse element which can be surface mounted using reflow and which has excellent properties for mounting in fuse devices, in which ratings can be increased to enable handling of large currents, and which has rapid blowout properties for rapidly interrupting a current path when a rating-exceeding current flows therethrough.

Accordingly, an object of the present invention is to provide a fuse device and a fuse element which, even in the case of a size-reduced fuse device, have excellent rapid blowout properties and excellent insulation properties after blowout.

Solution to Problem

To solve the aforementioned problems, a fuse element according to the present invention constitutes a current path of a fuse device and blows out due to self-generated heat when a rating-exceeding current flows comprises: a low melting point metal layer; and a high melting point metal layer laminated on the low melting point metal layer, wherein the low melting point metal layer has a film thickness of 30 μm or more, wherein the high melting point metal layer has a film thickness of 3 μm or more, and wherein a length in a width direction is greater than a length in the conduction direction.

Furthermore, to solve the aforementioned problems, a fuse element according to the present invention comprises: a recess or a through hole to divide the current path.

Furthermore, to solve the aforementioned problems, a fuse device according to the present invention comprises a fuse element constituting a current path and blows out due to self-generated heat when a rating-exceeding current flows, the fuse element comprising: a low melting point metal layer; and a high melting point metal layer laminated on the low melting point metal layer, wherein the low melting point metal layer has a film thickness of 30 μm or more, wherein the high melting point metal layer has a film thickness of 3 μm or more, and wherein a length in a width direction is greater than a length in the conduction direction.

Furthermore, to solve the aforementioned problems, a fuse device according to the present invention has a fuse element in which a recess or a through hole is provided to divide the current path.

Furthermore, to solve the aforementioned problems, a heat-generator-integrated fuse device according to the present invention has a fuse element which constitutes a current path and which blows out due to self-generated heat when a rating-exceeding current flows and a heat generator which heats to blow out the fuse element, the fuse element comprising: a low melting point metal layer; and a high melting point metal layer laminated on the low melting point metal layer, wherein the low melting point metal layer has a film thickness of 30 μm or more, wherein the high melting point metal layer has a film thickness of 3 μm or more, and wherein a length in a width direction is greater than a length in the conduction direction.

Furthermore, to solve the aforementioned problems, a heat-generator-integrated fuse device according to the present invention has a fuse element in which a recess or a through hole is provided to divide the current path. Furthermore, in order to solve the above-mentioned problems a fuse element according to the present invention constitutes a current path of a fuse device and blows out due to self-generated heat when a rating-exceeding current flows, wherein a width direction perpendicular to a conduction directions is greater than a total length in the conduction direction, and wherein and a plurality of recesses or through holes are aligned in the width direction. Furthermore, in order to solve the above-mentioned problems a fuse element according to the present invention constitutes a current path of a fuse device and blows out due to self-generated heat when a rating-exceeding current flows, wherein a width direction perpendicular to a conduction directions is greater than a total length in the conduction direction, and wherein a terminal serving as an external connection terminal of the fuse device is formed.

Advantageous Effects of Invention

According to the present invention, because the length in the width direction is greater than the length in the conduction direction in the fuse element, a plurality of recessed portions or through holes in the width direction can be easily provided; furthermore, because the current path can be divided by providing the recess or the through hole, by narrow-width portions formed by the recess or the through hole blowing out in a sequence, it is possible to suppress such occurrences as explosive scattering of the fuse element due to melting and expanding caused by self-generated heat. Thereby enabled are surface mounting using reflow, increased ratings capable of handling large currents, and obtaining rapid blowout properties for rapidly interrupting a current path when a rating-exceeding overcurrent flows therethrough.

DESCRIPTION OF EMBODIMENTS

Figure 1:
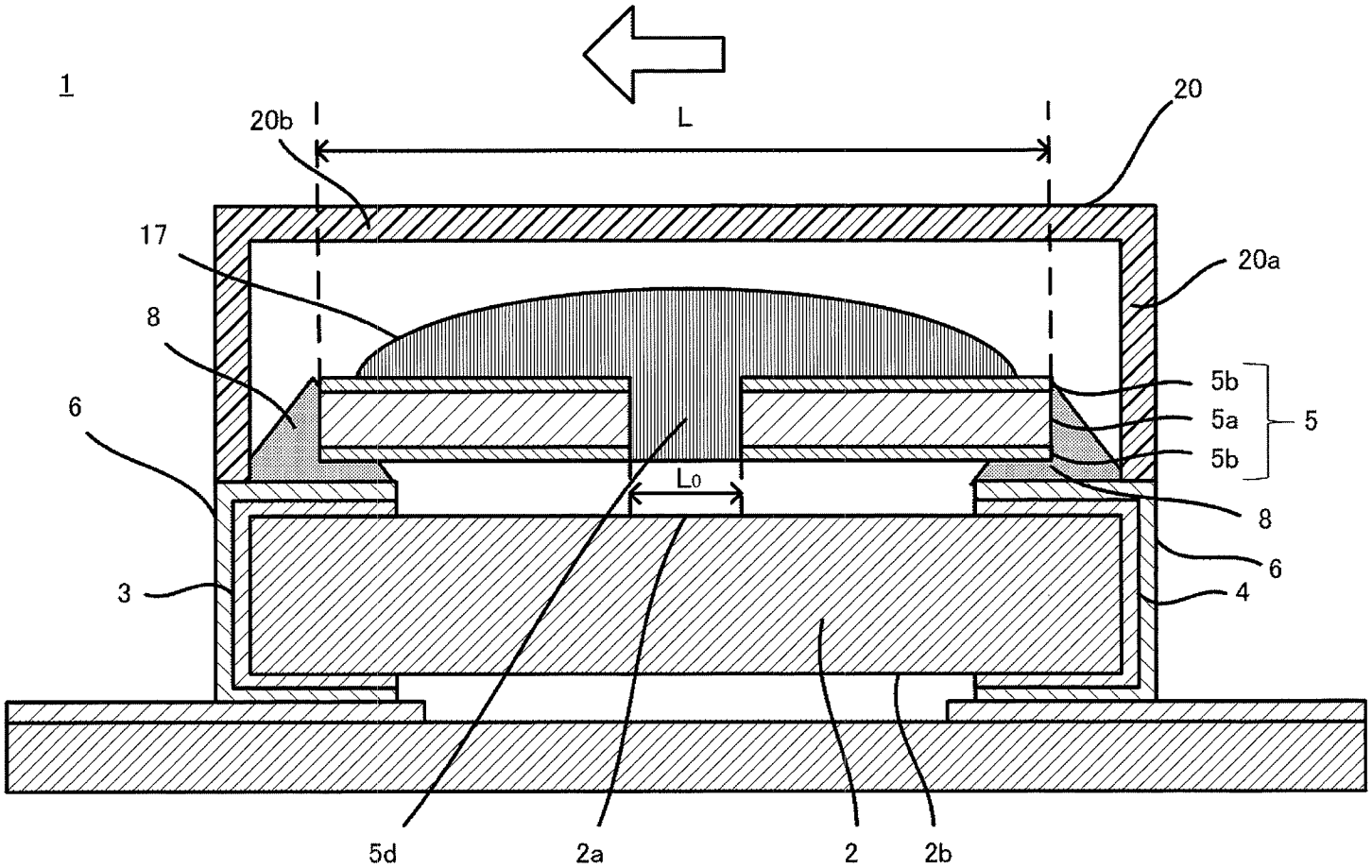
FIG. 1 is a cross-sectional view illustrating one example of a fuse device of the present invention.

Hereinafter, a fuse element, a fuse device, and a heat-generator-integrated fuse device according to the present invention will be described in detail with reference to the drawings. It should be noted that the present invention is not limited to the embodiments described below and various modifications can be made without departing from the scope of the present invention. The features shown in the drawings are illustrated schematically and are not intended to be drawn to scale. Actual dimensions should be determined in consideration of the following description. Moreover, those skilled in the art will appreciate that dimensional relations and proportions may be different among the drawings in some parts.

First Embodiment

Fuse Device

As illustrated in FIG. 1, a fuse device 1 according to the present invention comprises an insulating substrate 2, first and second electrodes 3, 4 provided on the insulating substrate 2, a fuse element 5 which is mounted between the first and second electrodes 3, 4 and which blows out due to self-generated heat when a rating-exceeding current flows therethrough to interrupt a current path between the first electrode 3 and the second electrode 4, and a cover member 20 that covers above a front surface 2*a* of the insulating substrate 2 on which the fuse element 5 is provided.

The insulating substrate 2 is formed, for example, in a rectangular shape from an insulating material such as alumina, glass ceramics, mullite, or zirconia. Furthermore, the insulating substrate 2 may be formed from a material used for printed wiring boards such as a glass epoxy substrate or a phenol substrate, among other materials.

The first and second electrodes 3, 4 are formed on opposing end portions of the insulating substrate 2. The first and second electrodes 3, 4 are each formed of a conductive pattern such as of Cu and Ag; in the case of a wiring material susceptible to oxidation such as Cu, a protective layer 6 such as an Ni/Au plating or Sn plating is provided as appropriate as an antioxidation measure. Furthermore, the first and second electrodes 3, 4 extend from a front surface 2*a* of the insulating substrate 2 to a back surface 2*b* via a side surface. The fuse device 1 is mounted on a current path of a circuit substrate via the first and second electrodes 3, 4 formed on the back surface 2*b*.

With the fuse device 1, a small and high-rated fuse device can be achieved, for example, although the size of the insulating substrate 2 is as small as approximately 3 to 4 mm×5 to 6 mm, high ratings of 50 to 60 A with a resistance of 0.5 to 1 mΩ are possible. It should be noted that it is a matter of course that the present invention is applicable to a fuse device having any size, resistance, and current rating.

Furthermore, it should be noted that in the fuse device 1, a cover member 20 for protecting the interior and for preventing the melted fuse element 5 from scattering is mounted onto the front surface 2*a* of the insulating substrate 2. The cover member 20 has a side wall 20*a* mounted on the front surface 2*a* of the insulating substrate 2 and a top surface 20*b* constituting an upper surface of the fuse device 1. The cover member 20 can be formed using an insulating material such as thermoplastic materials, ceramics, and glass epoxy substrates, among other materials.

Fuse Element

The fuse element 5 is mounted between the first and second electrodes 3, 4 and blows out due to self-generated heat (Joule heat) when a rating-exceeding current flows therethrough to interrupt the current path between the first electrode 3 and the second electrode 4.

As illustrated in FIG. 1, the fuse element 5 has a laminated structure composed of inner and outer layers, has a low melting point metal layer 5*a* as an inner layer and a high melting point metal layer 5*b* as an outer layer laminated on the low melting point metal layer 5*a*, and is formed in an approximately rectangular plate shape. The fuse element 5 is mounted between the first and second electrodes 3, 4 via a bonding material 8 such as solder before being connected above the insulating substrate 2 by, for example, reflow soldering.

The low melting point metal layer 5*a* is preferably a metal containing Sn as a primary constituent, a material commonly known as "Pb-free solder." The melting point of the low melting point metal layer 5*a* does not necessarily need to be higher than the temperature of the reflow furnace and may melt at about 200° C. The high melting point metal layer 5*b* is a metal layer laminated on a surface of the low melting point metal layer 5*a*, comprises, for example, Ag or Cu or a metal containing any of these as a primary constituent, and has a high melting point so as not to melt even in the case of mounting the fuse element 5 above the insulating substrate 2 by using a reflow oven.

In the fuse element 5, by laminating the low melting point metal layer 5*a* as the inner layer and the high melting point metal layer 5*b* as the outer layer, the fuse element 5 does not blow out even in the case of the reflow temperature exceeding the melting temperature of the low melting point metal layer 5*a*. Thus, the fuse element 5 can be efficiently mounted by reflow.

Furthermore, the fuse element 5 melts at a temperature equal to or higher than the melting point of the low melting point metal layer 5*a*, and interrupts the current path between the first and second electrodes 3, 4. In this regard, in the fuse element 5, the low melting point metal layer 5*a* melts and erodes the high melting point metal layer 5*b* so that the high melting point metal layer begins to melt at a temperature lower than the melting point of the high melting point metal layer 5*s*. Therefore, the fuse element 5 can blow out in a short time by using the erosive action of the low melting point metal layer 5*a* on the high melting point metal layer 5*b*. Moreover, because the melted metal of the fuse element 5 is divided right and left by a physical drawing action of the first and second electrodes 3, 4, the current path between the first and second electrodes 3, 4 can be rapidly and reliably interrupted.

Figure 2:
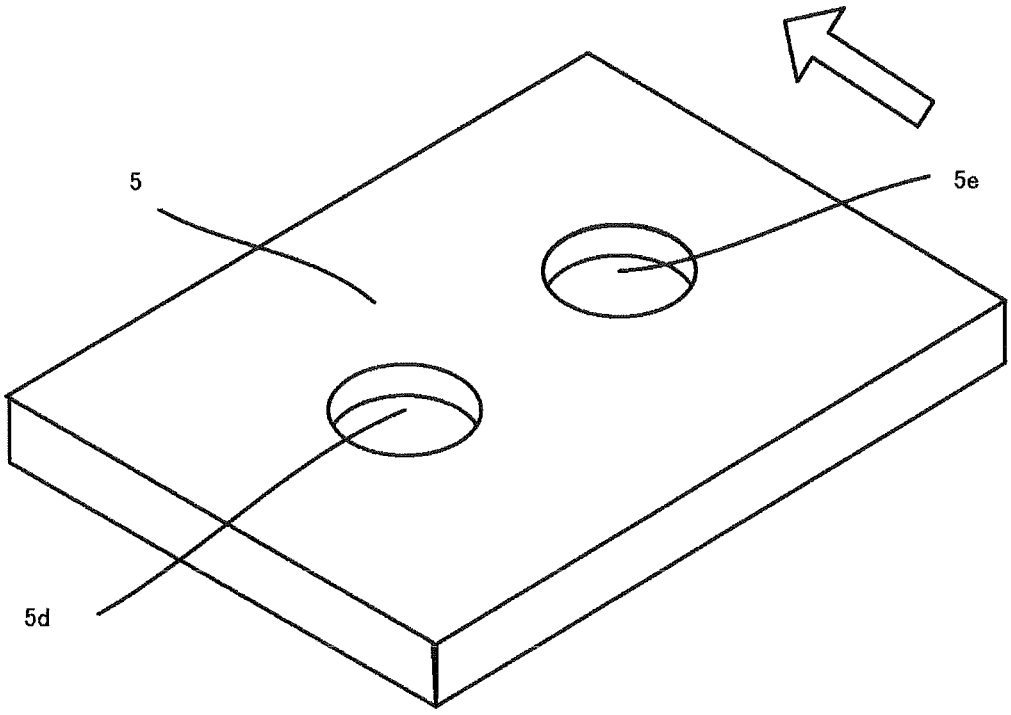
FIG. 2 is a perspective view illustrating one example of a fuse element.
Figure 3:
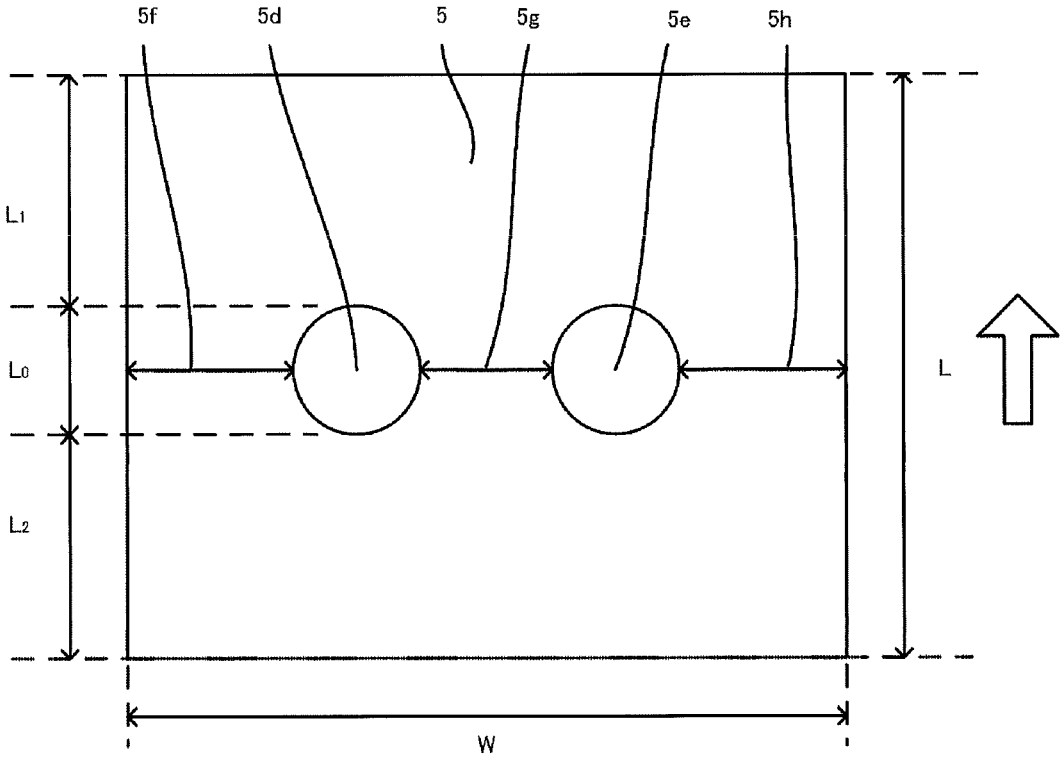
FIG. 3 is a plan view illustrating one example of a fuse element.

As illustrated in FIGS. 2 and 3, the fuse element 5 has a laminated structure, is formed in an approximately rectangular plate shape, and has a wide structure in which a length W in a width direction perpendicular to a conduction direction (hereinafter also simply referred to as the width W) is greater than a total length L in the conduction direction. It should be noted that in FIG. 2 and FIG. 3, the conduction direction is indicated by arrows and, in drawings to follow, the conduction direction is also indicated by arrows. The fuse element 5 has circular through holes 5*d*, 5*e* arranged in alignment in a middle portion with respect to the conduction direction. The through holes 5*d*, 5*e* may be non-penetrating recesses, and examples in which a recess is provided in the fuse element 5 will be described in other embodiments. Furthermore, the through holes 5*d*, 5*e* are not limited to being circular and other shapes may be used; examples of other shapes will be described in other embodiments. Furthermore, the through hole or the recess of the fuse element 5 are not indispensable, and a flat rectangular shape fuse element may be formed by adjusting the thickness to be thin. For example, by setting a thickness t of the fuse element 5 to 1/30 or less of the width W of the fuse element 5, favorable current interruption can be achieved. Furthermore, by setting the thickness t of the fuse element 5 to a ratio equal to or less than 1/60 of the width W of the fuse element 5 and appropriately increasing the width W of the fuse element 5, it is possible to handle a large current of 50 A or more.

Here, the total length L in the conduction direction is the maximum length in the conduction direction on a plane of a blowout portion BP of the fuse element 5. A folded terminal to be described below does not substantially function as a blowout portion BP because a large amount of connection material such as mounting solder adheres thereto and is not included in the conduction length of the fuse element 5. In the case of the total length L in the conduction direction being non-uniform in the fuse element 5, the portion having the minimum length is taken as the total length L in the conduction direction of the fuse element 5. The length W in the width direction is the length in the direction perpendicular to the conduction direction of the fuse element 5. In the case of the length W in the width direction being non-uniform in the fuse element 5, the portion having the maximum length is taken as the length W in the width direction of the fuse element 5.

In the following description, a case in which the fuse element 5 is provided with two through holes 5*d*, 5*e* arranged in alignment in the width direction will be described as an example. As illustrated in FIGS. 2 and 3, the two through holes 5*d*, 5*e* divide the fuse element 5 across the width direction to form a plurality of current paths. Then, as illustrated in FIG. 3, a plurality of narrow-width portions 5*f* to 5*h* divided by the two through holes 5*d*, 5*e* blow out due to self-generated heat (Joule heat) when a rating-exceeding current flows therethrough. In the fuse element 5, all of the narrow-width portions 5*f* to 5*h* blow out to interrupt the current path between the first and second electrodes 3, 4.

In the fuse element 5, by forming the plurality of narrow-width portions 5*f* to 5*h* arranged in alignment by providing the through holes 5*d*, 5*e*, when a rating-exceeding current flows, a large current flows through the narrow-width portions having lower resistances, which then blow out in a sequence due to self-generated heat, and arc discharge occurs only when the last remaining narrow-width portion blows out. Therefore, according to the fuse element 5, in the case of arc discharge occurring in the last remaining narrow-width portion at the time of blowout, the scale of this occurrence is reduced in proportion to the volume of the narrow-width portion, thereby preventing explosive scattering of melted metal and leading to significantly improved insulation properties after blowout. Furthermore, in the fuse element 5, because each of the plurality of the narrow-width portions 5*f* to 5*h* blow out independently, thermal energy required for blowing out each narrow-width portion can be reduced and interruption times can be decreased.

Additionally, the fuse element 5 has a wide structure in which the length W in the width direction is greater than the total length L in the conduction direction, thereby facilitating arrangement in alignment of the through holes 5*d*, 5*e* while maintaining volume of the fuse element 5.

In the fuse element 5, when a rating-exceeding current flows, even in the case of arc discharge occurring when blowout occurs, it is possible to prevent the melted fuse element from scattering over a wide area to form new current paths with the scattered metal as well as to prevent the scattered metal from adhering to, for example, terminals and surrounding electronic components.

That is, in a fuse element mounted over a large area between electrode terminals on an insulating substrate, when a voltage exceeding the rating is applied and a large current flows, heat is generated in the entire fuse element. Then the entire fuse element melts and agglomerates before blowing out while a large-scale arc discharge occurs. Consequently, the melted material of the fuse element scatters explosively. For this reason, scattered metal forming new current paths might impair insulating properties or melting of electrode terminals formed on the insulating substrate might also scatter to adhere to, for example, surrounding electronic components. Furthermore, in such a fuse element, after agglomerating as a whole, large amounts of thermal energy are required to blow out and cause interruption, leading to poor rapid blowout properties.

Packing arc-extinguishing material into hollow cases and wrapping fuse elements in a spiral around heat dissipating material to generate time lags in electrical fuses for high voltage applications have been proposed as measures for rapidly stopping arc discharge and interrupting circuits. However, conventional electrical fuses for high voltage applications, such as those manufactured by enclosing arc-extinguishing material or using spiral fuses, require complicated materials and manufacturing processes, and are unfavorable for application to miniaturized and high-current-rating fuse devices.

It should be noted that in order to obtain the same effect, it is conceivable to arrange in alignment elongated elements in which a fuse element is divided in the width direction; however, because the elongated elements blow out due to rapid heating and are liable to be scattered, the fuse element 5 provided with two through holes 5*d*, 5*e* dividing only a part of the current path is preferable.

Thus, while the current path of the fuse element 5 is divided into a plurality of parts, because volume of the element, which has a predetermined heat capacity, is ensured in the vicinity of the first and second electrodes 3, 4, the vicinity of the two through holes 5*d*, 5*e* can be heated and melted first, and explosive scattering of the melted metal can be prevented.

Through Holes

Next, position and size of the through holes 5*d*, 5*e* of the fuse element 5 will be described. Vicinities near the through holes 5*d*, 5*e* are blown out first as described above, and, in order to adjust the blowout position, it is particularly preferable that these vicinities are located near a central vicinity with respect to the length L in the conduction direction. In other words, in order to interrupt the circuit between the first and second electrodes 3, 4, it is preferable to select a central vicinity between the first and second electrodes 3, 4.

In particular, the through holes 5*d*, 5*e* are preferably located at positions separated from end portions in the conduction direction of the fuse element 5 by L1 and L2, respectively. More particularly, respective lengths of L1 and L2 are such that L/4<L1 and L/4<L2. While the current path of the fuse element 5 is divided into a plurality of parts, volume of the element, which has a predetermined heat capacity, is thus ensured in the vicinity of the first and second electrodes 3, 4.

Furthermore, size of the through holes 5*d*, 5*e* is preferably selected so that L/2>L0, wherein L0 is the diameter, with respect to the total length L of the current path of the fuse element 5. If a larger size is selected, the through holes 5*d*, 5*e* might extend to portions corresponding to the first and second electrodes 3, 4.

Structuring such a fuse element 5 as described above to have the high melting point metal layer 5*b* laminated on an inner layer of the low melting point metal layer 5*a* enables significant reductions in blowout temperature in comparison with, for example, chip fuses made from conventional high melting point metal. Therefore, the fuse element 5 is capable of having a larger cross-sectional area and greatly improved current ratings in comparison with, for example, a chip fuse of the same size.

Furthermore, the fuse element 5 is capable of smaller and thinner sizes than conventional chip fuses having the same current rating and has excellent rapid blowout properties. Moreover, improvements in surge tolerance (pulse tolerance), in which an abnormally high voltage is momentarily applied, are enabled by the fuse element 5 in electrical systems in which the fuse device 1 is incorporated. For example, the fuse element 5 does not blow out even in the case of a current of 100 A flowing for a few milliseconds. In this respect, because the fuse element of this embodiment comprising Sn and Ag has a low resistivity that is ¼ to ⅓ of that of a conventional Pb-based fuse element, and because a large current flowing for a very short time flows across the surface of a conductor (skin effect) and the high melting point metal layer 5*b* comprising an Ag plating having a low resistance is provided as an outer layer in the fuse element 5, a current caused by a surge can be easily allowed to flow, thereby preventing blowout due to self-generated heat. Therefore, the fuse element 5 can significantly improve surge tolerance in comparison with conventional fuses made from Pb-based solder alloys.

Pulse Tolerance Test

Next, a pulse tolerance test of the fuse device 1 will be described. In this test, as fuse devices, a fuse element (example) comprising Ag plated to a thickness of 4 μm on both surfaces of a low melting point metal foil (Sn 96.5/Ag/Cu) and a fuse element (comparative example) comprising only a low melting point metal foil (Pb 90/Sn/Ag) were prepared. The fuse element of the example had a cross-sectional area of 0.1 mm2 and a length L of 1.5 mm, and the fuse device had a resistance of 2.4 mΩ. The fuse element of the comparative example had a cross-sectional area of 0.15 mm2 and a length L of 1.5 mm, and the fuse device had a resistance of 2.4 mΩ.

Both ends of the fuse element according to the example and the comparative example were respectively solder connected between the first and second electrodes formed on the insulating substrate (see FIG. 1), a current of 100 A was supplied at intervals of 10 seconds for 10 msec (on=10 msec/off=10 sec), and the number of pulses until blowout was measured.

TABLE 1

| | Fuse Element | Cross-Sectional Area ($mm^2$) | Length (mm) | Fuse Device Resistance (mΩ) | Pulses Tolerated (times) |
|---|---|---|---|---|---|
| Ex. | Sn 96.5/Ag/Cu + Ag Plating | 0.1 | 1.5 | 2.4 | 3890 |
| Comp | Pb 90/Sn/Ag | 0.15 | 1.5 | 2.4 | 412 |

As shown in Table 1, the fuse element of the example was able to withstand 3890 pulses before blowing out, but the fuse element of the comparative example, was able to withstand only 412 pulses despite having a larger cross-sectional area than the fuse element of the example. It can thus be seen that the fuse element in which the high melting point metal layer is laminated on the low melting point metal layer has significantly improved pulse tolerance.

It should be noted that it is preferable that the volume of the low melting point metal layer 5*a* is larger than the volume of the high melting point metal layer 5*b*. By increasing the volume of the low melting point metal layer 5*a*, the fuse element 5 can blow out in a short time through effective erosion of the high melting point metal layer 5*b*.

Particularly, the fuse element 5 has a coated structure with the low melting point metal layer 5*a* as an inner layer and the high melting point metal layer 5*b* as an outer layer, and a layer thickness ratio of the low melting point metal layer 5*a* to the high melting point metal layer 5*b* may be 2.1:1 to 100:1. Thereby, volume of the low melting point metal layer 5*a* can reliably be made larger than the volume of the high melting point metal layer 5*b*, and blowout can be achieved in a short time by effective erosion of the high melting point metal layer 5*b*.

That is, in the fuse element 5, because the high melting point metal layer 5*b* is laminated on upper and lower surfaces of the low melting point metal layer 5*a* constituting the inner layer, when a thickness ratio of the low melting point metal layer to the high melting point metal layer is 2.1:1 or more, by increasing thickness of the low melting point metal layer 5*a*, volume of the low melting point metal layer 5*a* can be made to be greater than volume of the high melting point metal layer 5*b*. However, in the fuse element 5, when the layer thickness ratio of the low melting point metal layer to the high melting point metal layer exceeds 100:1 so that the low melting point metal layer 5*a* is excessively thick and the high melting point metal layer 5*b* is excessively thin, the high melting point metal layer 5*b* might be eroded by the low melting point metal layer 5*a* which is melted by heat during reflow mounting.

Such a film thickness range was determined by preparing a plurality of fuse element samples having different film thicknesses which were then mounted on the first and second electrodes 3, 4 via solder paste before applying a temperature of 260° C. corresponding to reflow to observe which fuse element samples did not blow out.

In fuse elements comprising a 1 μm thick Ag plating layer formed on upper and lower surfaces of a 100 μm thick low melting point metal layer 5*a* (Sn 96.5/Ag/Cu), the Ag plating melted at a temperature of 260° C. and element shape could not be maintained. In view of surface mounting using reflow, it was confirmed that if a thickness of the high melting point metal layer 5*b* is 3 μm or more with respect to thickness of the low melting point metal layer 5*a* being 100 shape can be reliably maintained even when surface mounting is performed by using reflow. In the case of using Cu as the high melting point metal, if thickness is 0.5 μm or more, shape can be reliably maintained even when using reflow for surface mounting.

Moreover, by reducing erosive properties through employing Cu in the high melting point metal layer, or by reducing Sn content through employing an alloy with a low melting point such as Sn/Bi or In/Sn in the material of the low melting point metal layer, it is also possible to select a ratio of the low melting point metal layer to the high melting point metal layer of 100:1.

Thickness of the low melting point metal layer 5*a*, although depending on the size of the fuse element, in general, is preferably 30 μm or more, in view of spreading of erosion into the high melting point metal layer 5*b* to cause rapid blowout.

Manufacturing Method

The fuse element 5 can be manufactured by depositing the high melting point metal layer 5*b* on the surface of the low melting point metal layer 5*a* using a plating technique. For example, the fuse element 5 can be efficiently manufactured by plating Ag to a surface of a long solder foil which can be easily used by cutting according to size at the time of use.

Furthermore, the fuse element 5 may be manufactured by bonding together a low melting point metal foil and a high melting point metal foil. For example, the fuse element 5 can be manufactured by pressing a rolled sheet of solder foil between two similarly rolled sheets of Cu foil or Ag foil. In this case, a material softer than the high melting point metal foil is preferably selected for the low melting point metal foil. Thereby, unevenness in thickness can be compensated for and the low melting point metal foil and the high melting point metal foil can be bonded together without voids. Additionally, the low melting point metal foil may be made thicker beforehand to accommodate film thickness being made thinner by pressing. In the case of the low melting point metal foil protruding from ends of the fuse element due to pressing, it is preferable to trim and adjust shape.

Additionally, thin film forming techniques such as vapor deposition and other known laminating techniques may be used to form the fuse element 5 in which the high melting point metal layer 5*b* is laminated to the low melting point metal layer 5*a*.

Figure 4:
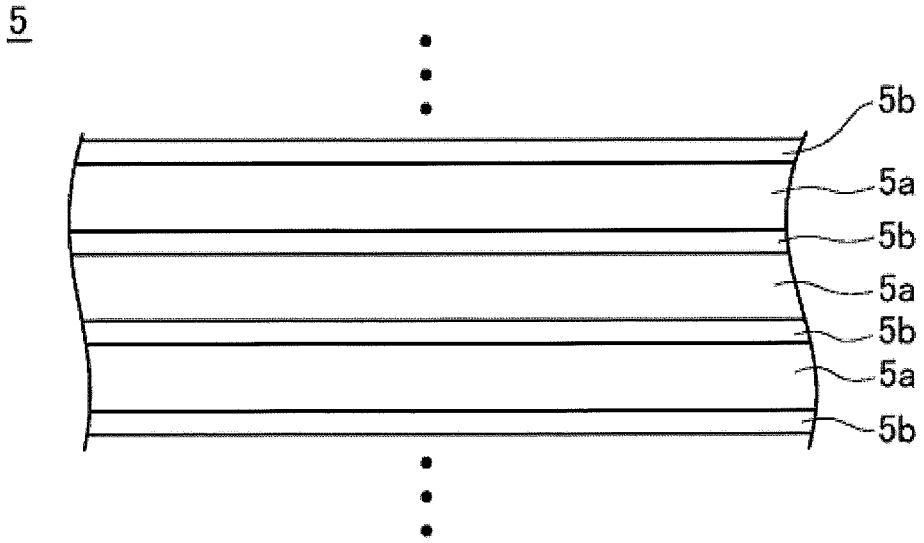
FIG. 4 is a cross-sectional view illustrating another fuse element of the present invention in which a plurality of high melting point metal layers are alternately laminated above and below low melting point metal layers.

Furthermore, in the fuse element 5, as illustrated in FIG. 4, the low melting point metal layer 5*a* and the high melting point metal layer 5*b* may be formed in multiple alternating layers. In this case, the outermost layer may be either the low melting point metal layer 5*a* or the high melting point metal layer 5*b*; however, it is preferable that the low melting point metal layer 20*a* is the outermost layer. In the case of the outermost layer being the low melting point metal layer 20*a*, the high melting point metal layer 21*a* is eroded by the low melting point metal layer 20*a* from both sides in the process of melting so that melting can efficiently occur in a short time. The outermost layer of the low melting point metal layer 20*a* may be coated simultaneously with connection to the electrodes using reflow heating by applying an appropriate amount of solder paste to the front/back surface of the fuse element at the time of mounting the fuse element.

Figure 5:
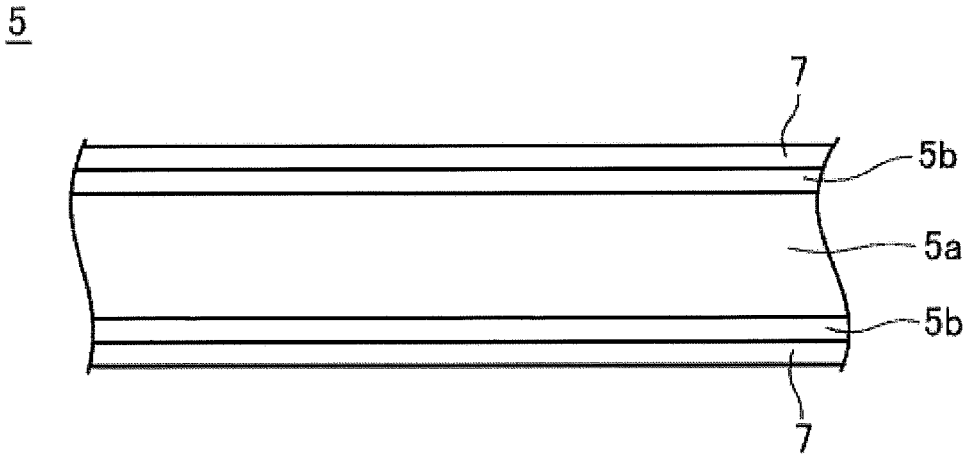
FIG. 5 is a cross-sectional view illustrating another fuse element of the present invention in which high melting point metal layers are provided above and below a low melting point metal layer and antioxidation films are further provided above and below these.

Additionally, in the fuse element 5, as illustrated in FIG. 5, in cases of the outermost layer being the high melting point metal layer 5*b*, an antioxidation film 7 may be formed on a surface of the outermost layer of the high melting point metal layer 5*b*. By further coating an antioxidation film 7 to the outermost layer of the high melting point metal layer 5*b* in the fuse element 5, for example, even in cases of the high melting point metal layer 5*b* being a Cu plating or Cu foil, oxidation of Cu can be prevented. Therefore, the fuse element 5 prevents blowout delays caused by Cu oxidation and can thus achieve rapid blowout.

Thus, the fuse element 5 can be formed by using inexpensive but easily oxidized metals such as copper as the high melting point metal layer 5*b* without using expensive materials such as Ag.

The antioxidation film 7 of the high melting point metal layer can use the same material used in an inner layer of the low melting point metal layer 5*a* and, for example, a Pb-free solder having Sn as a primary constituent can be used. Furthermore, the antioxidation film 7 may be formed by plating tin on the surface of the high melting point metal layer 5*b*. Additionally, the antioxidation film 7 may also be formed by Au plating or preflux.

Figure 6:
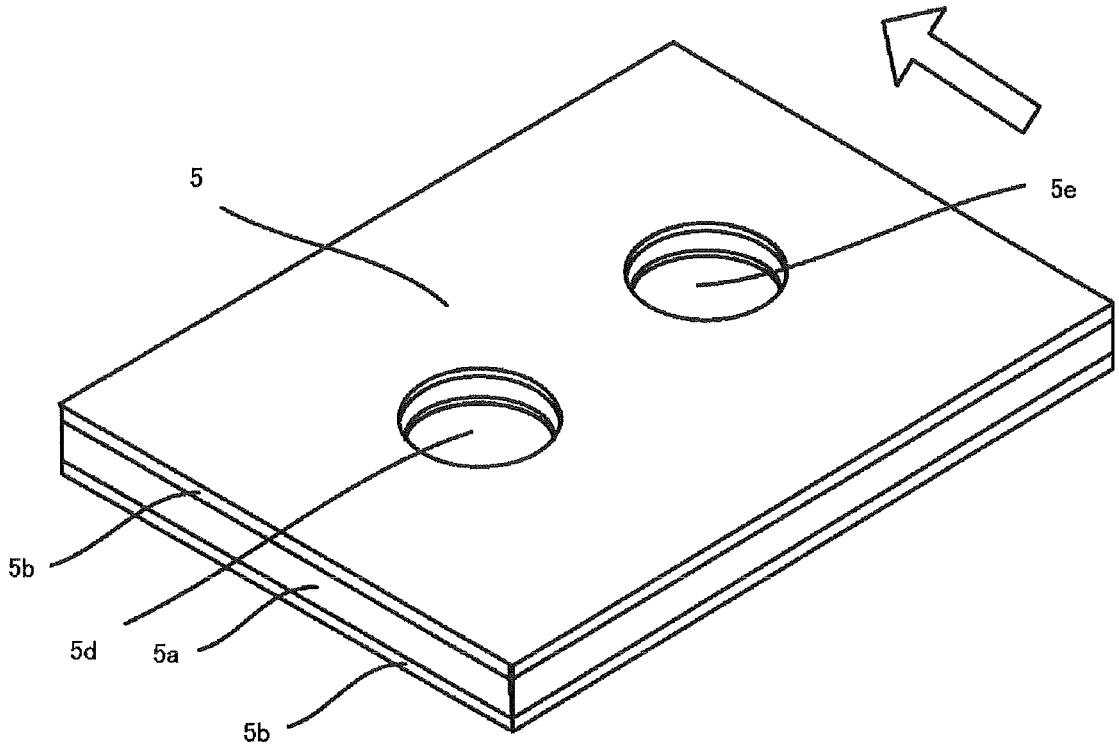
FIG. 6 is a perspective view illustrating arrangement of through holes in another fuse element of the present invention in which high melting point metal layers are provided above and below a low melting point metal layer.
Figure 7:
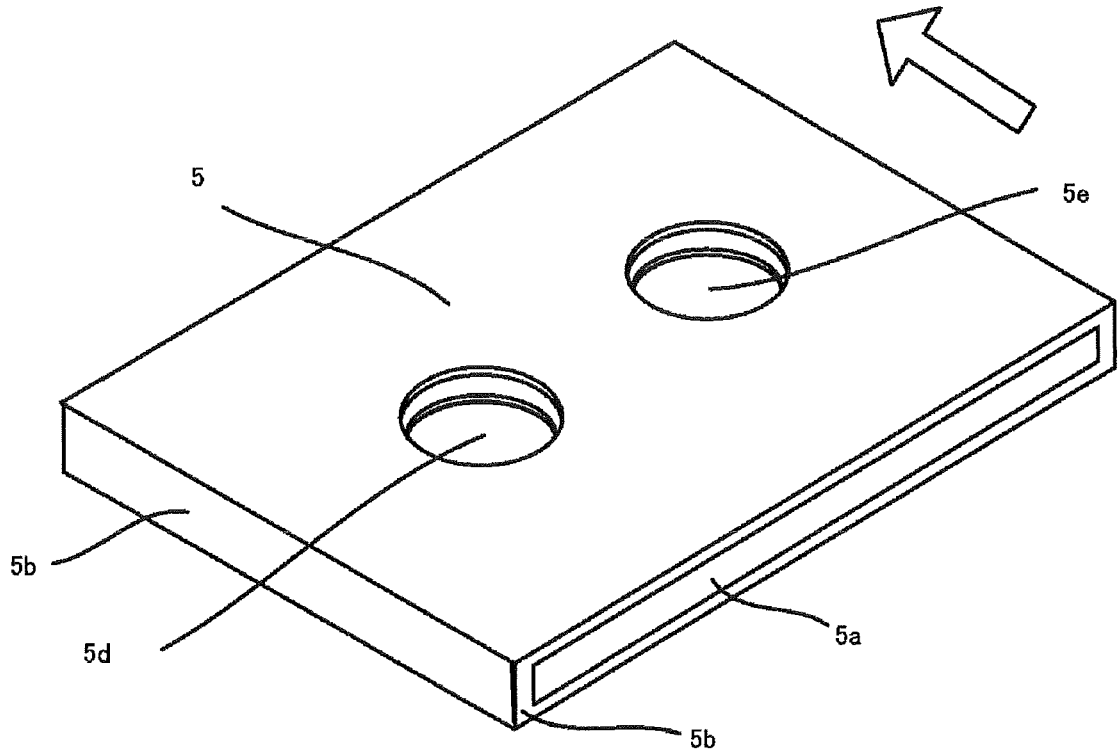
FIG. 7 is a perspective view illustrating arrangement of through holes in another fuse element of the present invention in which high melting point metal layers are provided above, below, and on width-direction side surfaces of a low melting point metal layer.

As illustrated in FIG. 6, in the fuse element 5, the high melting point metal layer 5*b* may be laminated to the upper and lower surfaces of the low melting point metal layer 5*a* or, as illustrated in FIG. 7, exterior portions of the low melting point metal layer 5*a* excluding two opposing ends may be covered by the high melting point metal layer 5*b*. That is, side surfaces in the conduction direction may be covered with the high melting point metal layer 5*b*. In the fuse element 5 illustrated in FIG. 6, because the low melting point metal layer 5*a* is exposed on the side surface, the low melting point metal might melt and leak out to the exterior, possibly impairing functioning of the fuse device 1. On the other hand, with such a structure of the fuse element 5 as illustrated in FIG. 7, the possibility that the low melting point metal melts and flows out to the exterior can be reduced, thus maintaining functioning of the fuse device 1.

Figure 8:
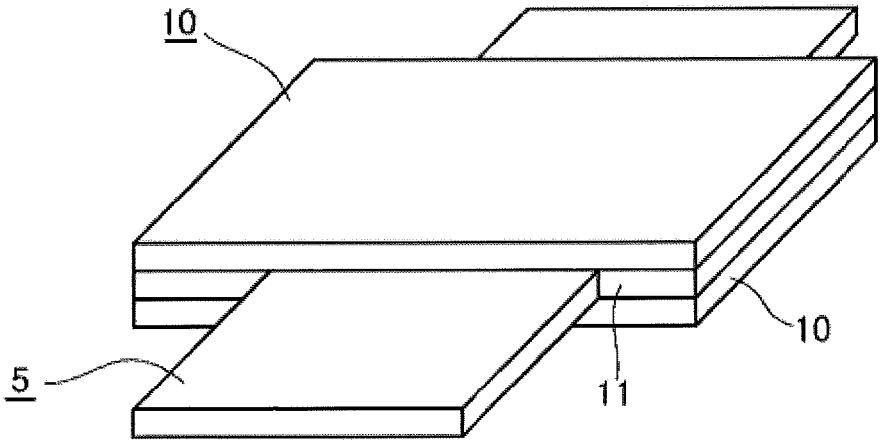
FIG. 8 is a perspective view illustrating a fuse element on which a protecting member is formed.

Furthermore, as illustrated in FIG. 8, a protective member 10 may be provided on at least a portion of the exterior of the fuse element 5. The protective member 10 prevents entrance of connection-use solder and leakage of the low melting point metal layer 5*a*, maintains shape during reflow mounting of the fuse element 5, and prevents entrance of solder which prevents degradation of rapid blowout properties when a rating-exceeding current flows, which might otherwise occur due to an increased rating.

Thus, leakage of the low melting point metal layer 5*a* melted at reflow temperatures can be prevented and element shape can be maintained by providing the protective member 10 on the exterior of the fuse element 5. In particular, the high melting point metal layer 5*b* is laminated to upper and lower surfaces of the low melting point metal layer 5*a* and the low melting point metal layer 5*a* is exposed on a side surface in the fuse element 5, leakage of low melting point metal from the side surface can be prevented and shape can be maintained by providing the protective member 10 on an exterior portion.

Furthermore, providing the protective member 10 on the exterior of the fuse element 5 can prevent entrance of solder melted when a rating-exceeding current flows. In the case of solder connecting the fuse element 5 on the first and second electrodes 3, 4, heat generated by a rating-exceeding current flowing melts solder used in connections of the first and second electrodes and also melts metal constituting the low melting point metal layer 5*a*, and the melted metal might then enter central portions of the fuse element 5 which is intended to blow. In the fuse element 5, intrusion of melted metal such as solder would reduce resistance and impede heat generation such that blowout might not occur at a predetermined current value or blowout might be delayed, or insulation reliability between the first and second electrodes 3, 4 after blowout might be adversely affected. Therefore, providing a protective member 10 to the exterior of the fuse element 5 can prevent entrance of melted metal, stabilize resistance, ensure rapid blowout at a predetermined current value, and ensure insulation reliability properties of the first and second electrodes 3, 4.

Therefore, the protective member 10 is preferably a material having insulating properties, heat-tolerance appropriate for reflow temperatures, and resistance to such materials as melted solder. For example, the protective member 10, as illustrated in FIG. 8, may be formed by using an adhesive agent 11 to bond a polyimide film to a central portion of the fuse element 5, which is in a tape form. Additionally, the protective member 10 may be formed by applying an ink having insulating, heat tolerance, and melted metal resistance properties onto the exterior of the fuse element 5. Alternatively, the protective member 10 may be formed by applying a solder resist onto the exterior of the fuse element 5.

The protective member 10, being made from such materials as films, inks, and solder resists as described above, can be applied or coated to the exterior of the fuse element 5, which has an elongated shape, and the fuse element 5 having the protective member 10 arranged thereon may be cut at time of use and has excellent handling properties.

In the fuse element 5, as illustrated in FIGS. 6 and 7, holes may be machined by punching with a punching machine or with, for example, a punch having a sharp tip as a method for forming the through holes 5*d*, 5*e*. Furthermore, holes may be made by press processing or cutting with a cutter, among other methods. That is, various well-known manufacturing methods capable of making holes in the fuse element 5 can be employed as appropriate.

Mounted State

A mounted state of the fuse element 5 will now be described. The fuse device 1, as illustrated in FIG. 1, is mounted such that an interval exists between the fuse element 5 and a front surface 2*a* of the insulating substrate 2. This ensures that, in the fuse device 1, melted metal of the fuse element 5 does not adhere to the front surface 2*a* of the insulating substrate 2 when a rating-exceeding current flows between the first and second electrodes 3, 4, thereby ensuring interruption of the current path.

In contrast, in a fuse device having a fuse element in contact with a surface of an insulating substrate such as in the case of forming a fuse element by printing to the insulating substrate, melted metal of the fuse element adheres to the insulating substrate between the first and the second electrode and a leak occurs. For example, in a fuse device in which a fuse element is formed by printing Ag paste to a ceramic substrate, ceramic and silver are sintered and eroded and then remain between the first and second electrodes. Consequently, leaking current flows through the remaining material between the first and second electrodes and the current path is not completely interrupted.

In this respect, in the fuse device 1, the fuse element 5 is formed separately from the insulating substrate 2 and mounted such that an interval exists between the fuse element 5 and the front surface 2*a* of the insulating substrate 2. Thus, in the fuse device 1, when the fuse element 5 melts, melted metal does not erode the insulating substrate 2 but is drawn towards the first and second electrodes, thus ensuring electrical insulation between the first and second electrodes.

Flux Coating

In the fuse element 5, as an antioxidation measure for an outer layer of either the high melting point metal layer 5*b* or the low melting point metal layer 5*a* and to remove oxidized material and improve solder fluidity at the time of blowout, as illustrated in FIG. 1, a flux 17 may be applied to nearly the entire surface of an exterior layer of the fuse element 5. By applying the flux 17, in addition to improving wetting properties of low melting point metal (for example, solder), oxidized materials are removed during melting of the low melting point metal and rapid blowout properties can be improved by using an erosive action to the high melting point metal (for example, Ag).

Furthermore, by coating the flux 17, even in cases of forming the antioxidation film 7 from such materials as Pb-free solder having Sn as a primary constituent on the surface of the outermost layer of the high melting point metal layer 5*b*, oxidized material of the antioxidation film 7 can be removed, oxidation of the high melting point metal layer 5*b* is effectively prevented, and rapid blowout properties can be maintained and improved. In addition, the flux 17 suppresses adhesion of the molten scattered material to the surface of the insulating substrate and the surface of the protective member due to arc discharge at the time of interrupting the current, and also suppresses decreases in insulation resistance.

Such a fuse element 5 may be connected in the manner described above by using reflow solder bonding to connect the fuse element 5 to the first and second electrodes 3, 4; additionally, ultrasonic welding may also be used to connect the fuse element 5 to the first and second electrodes 3, 4.

Control of Blowout Order

Regions of the fuse element 5 between each of the through holes 5*d* can be made to blow out in a sequence in the fuse device 1.

For example, in the fuse element 5, among the plurality of current paths, by making cross-sectional area in a portion in a central vicinity less than cross-sectional area of other narrow-width portions, relative resistance is increased and, when a rating-exceeding current flows, a large current flows first through relatively low-resistance portions which then blow out. Because this blowout due to self-generated heat is not accompanied by arc discharge, there is no explosive scattering of melted metal. Thereafter, current concentrates in the remaining part having increased resistance which then blows out accompanied by arc discharge. Thereby, the narrow-width portions 5*f* to 5*h*, into which the fuse element 5 is divided by each of the through holes 5*d*, 5*e*, can be blown out in a sequence. In the fuse element 5, arc discharge occurs at the time of blowout of the portion having less cross-sectional area, but this is small in scale in accordance with the volume of the portion involved so that explosive scattering of melted metal can be prevented.

In this regard, in the fuse device 1, an insulating portion may be provided between portions having relatively low resistance which are to be blown out first and the narrow-width portion adjacent to this portion. In this case, the insulating portion can prevent adjacent narrow-width portions from contacting each other and agglomerating due to expansion caused by heat generated by the fuse element 5. In the fuse device 1, this enables the narrow-width portions to blow out in a predetermined sequence, and can prevent degradation of insulation performance which might otherwise be caused by large-scale arc discharge and increase in blowout time due to adjacent narrow-width portions becoming continuous.

In particular, in the fuse device 1 in which the fuse element 5 having the three narrow-width portions 5*f* to 5*h* illustrated in FIG. 3 is mounted, by selecting a relatively reduced cross-sectional area in the center narrow-width portion 5*g* to increase resistance, more current flows through the narrow-width portions 5*f*, 5*h* on the outer sides which are then blown out after which the center narrow-width portion 5*g* blows out last. In this regard, in the fuse device 1, by providing the insulating portion in the through holes 5*e*, 5*d* between the narrow-width portions 5*f*, 5*h* and between the narrow-width portions 5*g*, 5*h*, even when the narrow-width portions 5*f*, 7*h* blow out due to self-generated heat, along with avoiding contact with the adjacent narrow-width portion 5*g* and blowing out in a short time, the narrow-width portion 5*g* can be made to blow out last. In addition, the narrow-width portion 5*g* having a small cross-sectional area avoids contact with the adjacent narrow-width portions 5*f*, 5*h* and limits arc discharge at the time of blowout to a small scale.

Moreover, in the case of two or more through holes 5*d*, 5*e* being provided, it is preferable that the narrow-width portions on outer sides blow out first, and narrow-width portions on the inner side blow out last in the fuse element 5. For example, as illustrated in FIG. 3, the fuse element 5 is provided with three narrow-width portions 5*f*, 5*g*, 5*h* and it is preferable that the center narrow-width portion 5*g* is blown out last.

As described above, when a rating-exceeding current flows through the fuse element 5, more current first flows through the two narrow-width portions 5*f*, 5*h* provided on outer sides, which blow out due to self-generated heat. Because blowout due to self-generated heat of these narrow-width portions 5*f*, 5*h* is not accompanied by arc discharge, there is no explosive scattering of melted metal.

Subsequently, current concentrates in the narrow-width portion 5*g* provided on the inner side which is then blown out accompanied by arc discharge. In this regard, blowing out the narrow-width portion 5*g* provided on the inner side of the fuse element 5 last can suppress scattering of melted metal of the narrow-width portion 5*g* and can prevent problems such as short circuits caused by melted metal, even when arc discharge occurs.

Also in this regard, among the three narrow-width portions 5*f* to 5*h*, the center narrow-width portion 5*g* may be made to blow out last by selecting a cross-sectional area for the center narrow-width portion 5*g* situated on the inner side that is less than a cross-sectional area of the narrow-width portions 5*f*, 5*h* situated on the outer sides to relatively increase resistance. In this case as well, by making the narrow-width portion 5*g* blow out last by selecting a relatively small cross-sectional area, arc discharge occurs on a small scale in proportion with volume of the narrow-width portion 5*g*, thus enabling suppression of explosive scattering of melted metal.

Terminal

Figure 9:
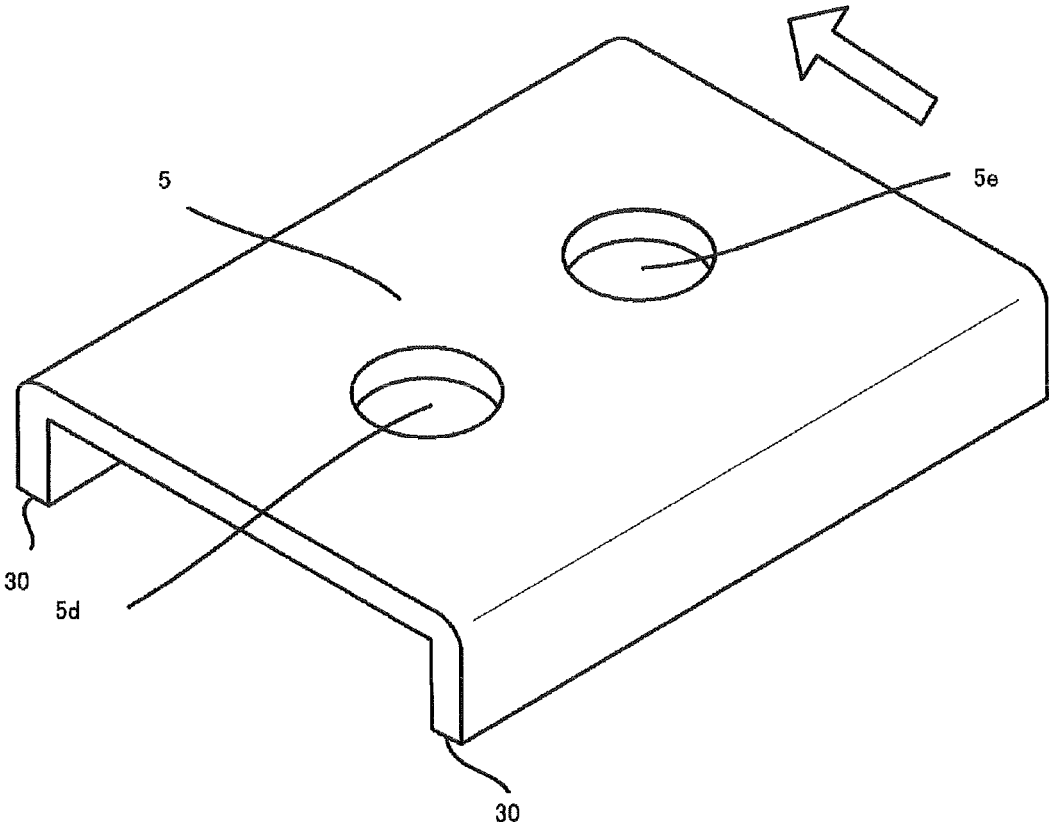
FIG. 9 is a perspective view illustrating a state in which a terminal is formed by bending an end portion of a fuse element according to a first embodiment.

Here, as illustrated in FIG. 9, ends of the fuse element 5 on both end portions in the conduction direction can be bent 90 degrees toward the circuit substrate side, and end surfaces thereof can be used as terminals 30.

Figure 10:
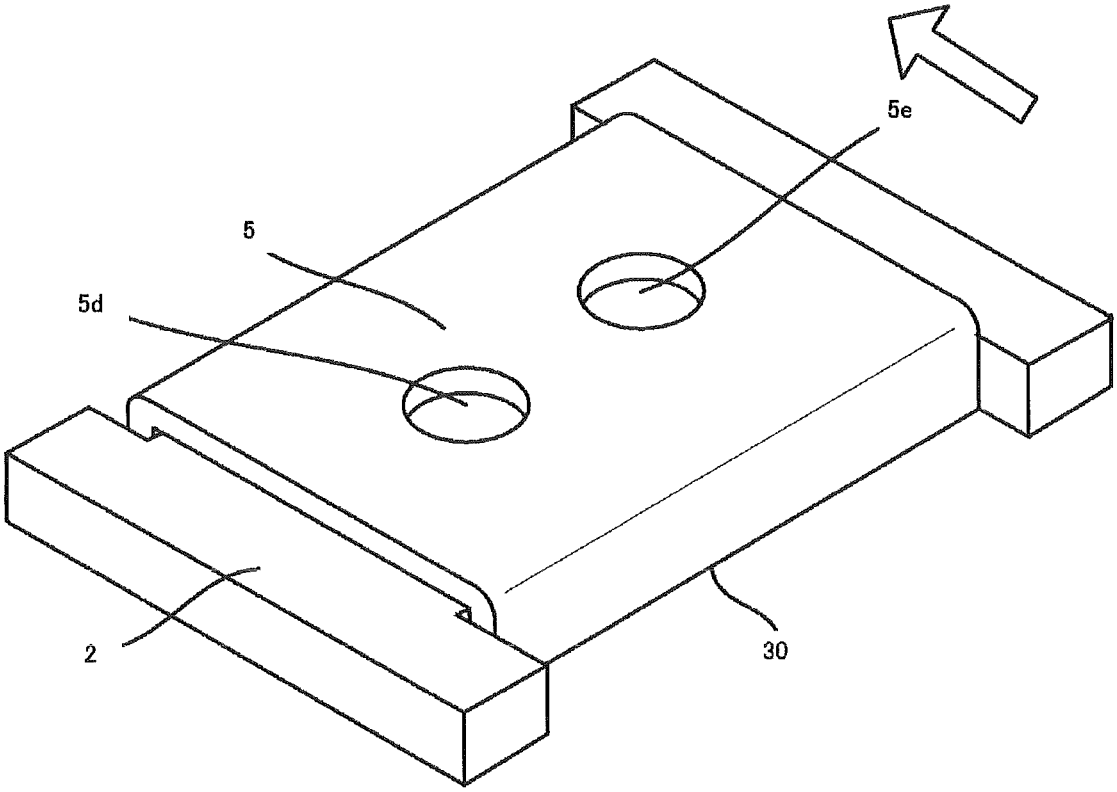
FIG. 10 is a perspective view illustrating a state in which a terminal is formed by bending an end portion of a fuse element according to a first embodiment and the fuse element is arranged on an insulating substrate.
Figure 11:
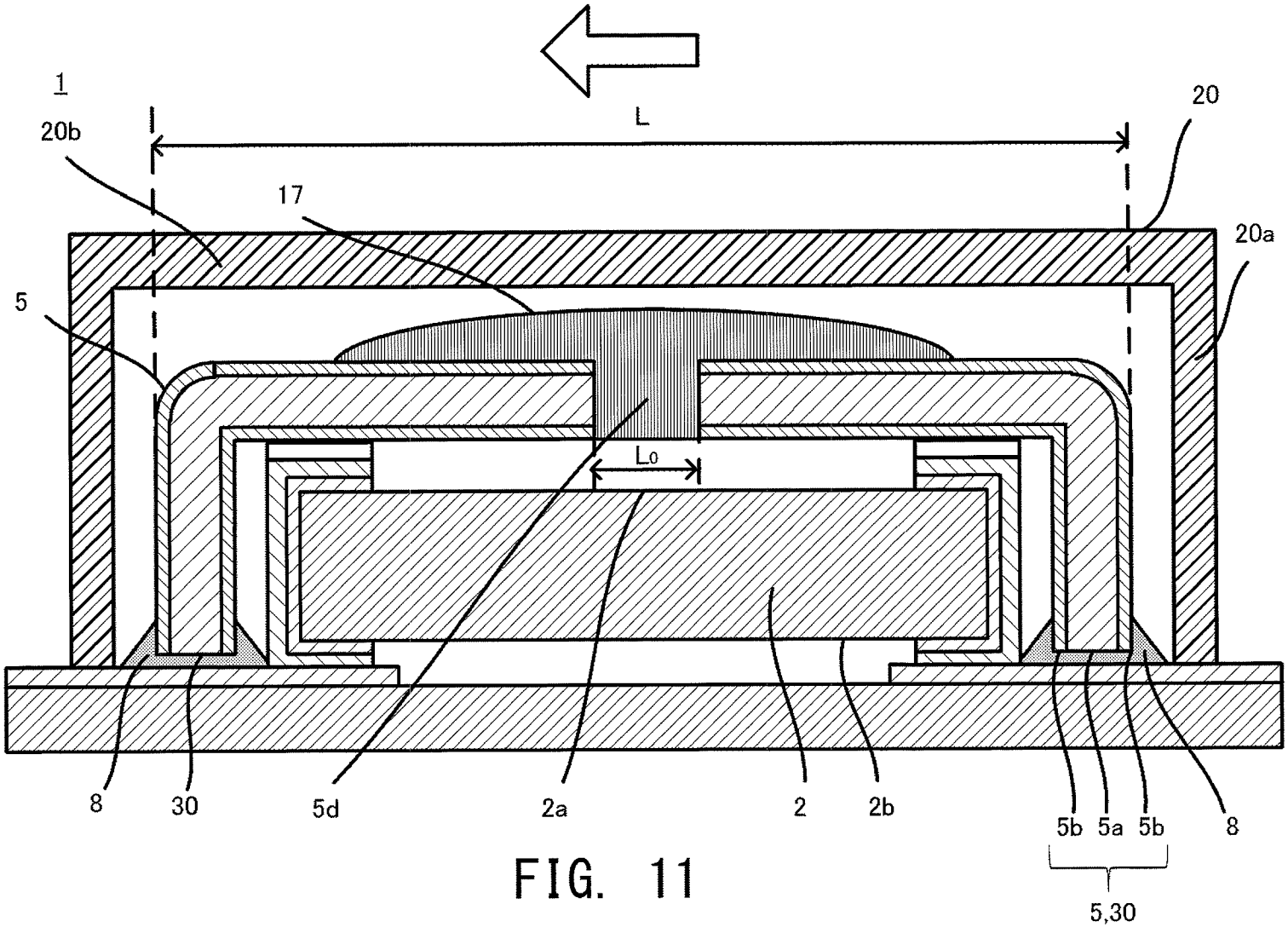
FIG. 11 is a cross-sectional view illustrating one example of a fuse device in which a terminal is formed by bending an end portion of a fuse element according to a first embodiment.

When the fuse device 1 incorporating the fuse element 5 is mounted on the circuit substrate, the terminals 30 are directly connected to connection terminals formed on the circuit substrate and are formed on both end portions in the conduction direction as illustrated in FIG. 9. As illustrated in FIGS. 10 and 11, by mounting the fuse device 1 on the circuit substrate, the terminals 30 are connected to the connection terminals formed on the circuit substrate via, for example, solder.

The fuse device 1 is electrically connected to the circuit substrate via the terminals 30 formed in the fuse element 5 enabling resistance value reductions for the entire device as well as size reductions and rating increases. For example, in the fuse device 1, in the case of providing an electrode on the back surface 2*b* of the insulating substrate 2 for connecting to the circuit substrate and connecting the first and second electrodes 3, 4 such as through vias filled with conductive paste, such limits as those on bore size and number of vias or castellations, and such limits as those on resistance and film thickness of conductive paste lead to difficulties in realizing resistances that are less than or equal to the fuse element and high ratings are difficult to achieve.

Therefore, the terminals 30 are formed in the fuse element 5 of the fuse device 1. Furthermore, as illustrated in FIGS. 10 and 11, by mounting the fuse device 1 onto the circuit substrate, the terminals 30 are directly connected to the connection terminals of the circuit substrate. Thus, in the fuse device 1, high resistances caused by interposing conductive vias can be avoided and ratings can be determined by the fuse element 5, allowing size reductions and ratings increases.

Additionally, forming the terminals 30 in the fuse element 5 obviates formation of a connecting electrode for connecting to the circuit substrate on the back surface 2*b* of the insulating substrate and makes formation of only the first and second electrodes 3, 4 on the front surface 2*a* sufficient, thereby enabling reduction in the number of manufacturing steps for the fuse device 1.

The terminals 30 can be formed on the fuse element 5, for example, by applying pressure using a press machine to bend end portions on both sides thereof. Moreover, by using a press process to form the through holes 5*e*, 5*f* in the fuse element 5 in which the terminals 30 are to be provided, hole machining processes and bending processes can be performed simultaneously.

It should be noted that, in the fuse device 1, in the case of providing the fuse element 5 with the terminals 30 and the plurality of through holes 5*d*, 5*e*, it is not necessary to provide the first and second electrodes 3, 4 on the insulating substrate 2. In this case, the insulating substrate 2 is used for dissipating heat away from the fuse element 5, and a ceramic substrate having good thermal conductivity is preferably used. Furthermore, in the adhesive agent for connecting the fuse element 5 to the insulating substrate 2, electrical conductivity is not required but it is preferable that the adhesive agent has excellent thermal conductivity.

Fuse Device Manufacturing Processes

The fuse device 1 incorporating the fuse element 5 can be manufactured by the following process. The first and second electrodes 3, 4 are formed on the front surface 2*a* of the insulating substrate 2 onto which the fuse element 5 is to be mounted. The first and second electrodes 3, 4 are connected to the fuse element 5 such as by using solder connecting. The fuse element 5 is thus mounted in a series in the circuit formed on the circuit substrate by mounting the fuse device 1 on the circuit substrate.

The fuse element 5 is mounted between the first and second electrodes 3, 4 via a connecting material such as solder and connected by reflow mounting. In the case of using a conventional Pb-based solder (having a melting point of approximately 300° C.) as the fuse element, when mounting with an Sn-based solder (having a melting point of approximately 220° C.), because Sn and Pb form an alloy and the fuse element would blow out at reflow temperatures of approximately 250° C., it was necessary to use a high-Pb-content-type solder having a relatively small proportion of Sn. However, by using a laminated element of a low melting point metal layer and a high melting point metal layer, the fuse elements is not blown out even in the case of mounting with an Sn-type solder (having a melting point of approximately 220° C.), performing reflow mounting processes at lower temperatures and achieving Pb-free implementations are thereby made possible. Furthermore, as illustrated in FIG. 1, a flux 17 is provided on the fuse element 5. Forming the flux 17 prevents oxidation of the fuse element 5 and can improve wetting properties, thereby enabling rapid blowout. Furthermore, forming the flux 17 can suppress adhesion of melted metal caused by arc discharge to the insulating substrate 2 and can improve insulation properties after blowout.

Second Embodiment

Fuse Element

In the following, another example of the fuse element 5 will be described. Because the structure of the fuse device 1 is substantially the same as that of the first embodiment in which both ends of the fuse element are bent to provide the terminals 30, it is not specifically illustrated in the drawings. Moreover, the same reference signs are assigned to parts having the same function as in the configuration of the fuse element 5 of the first embodiment, and a description thereof is omitted.

Figure 12:
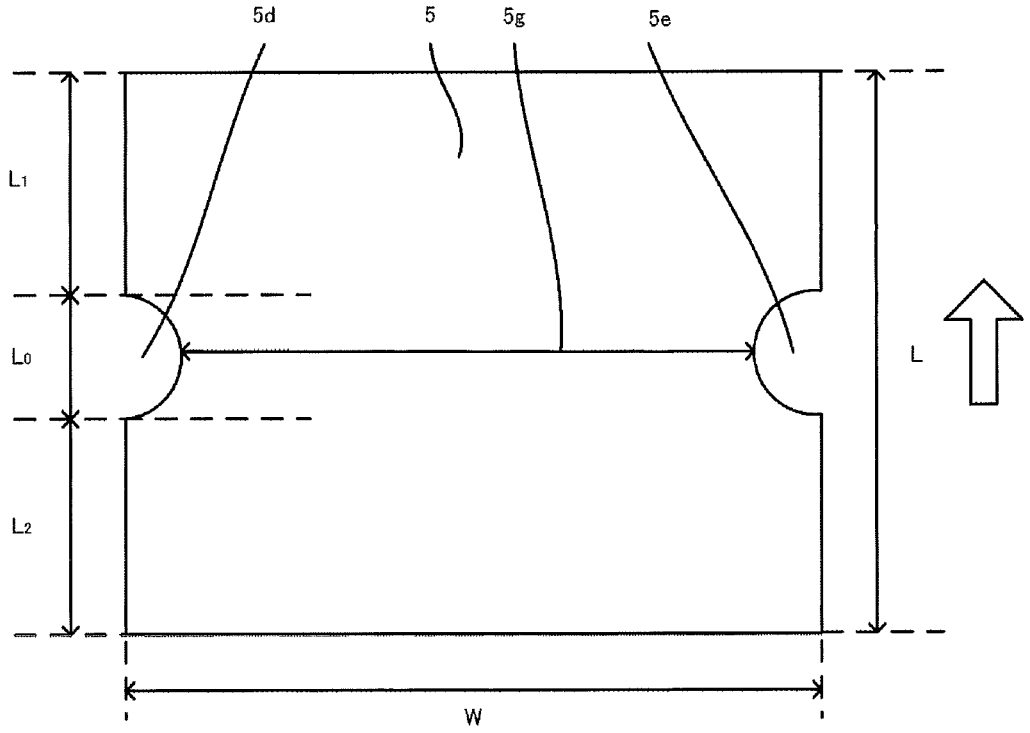
FIG. 12 is a plan view illustrating one example of a fuse element according to a second embodiment.
Figure 13:
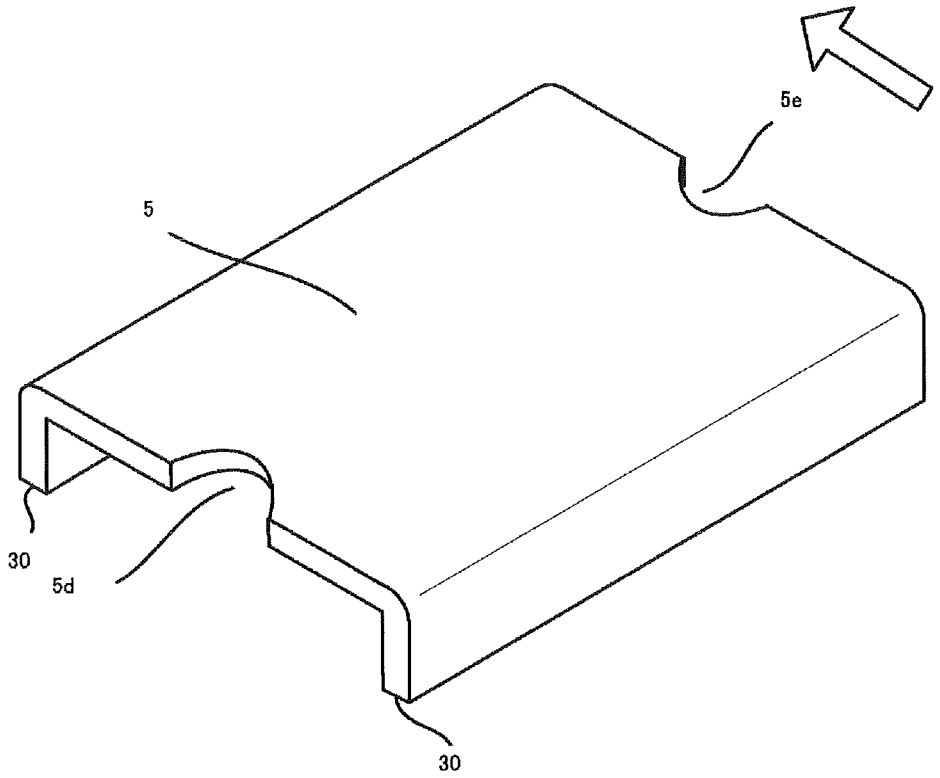
FIG. 13 is a perspective view illustrating one example of a fuse element according to a second embodiment.

As illustrated in FIGS. 12 and 13, the fuse element 5 has a laminated structure formed in an approximately rectangular plate shape and has a wide structure in which the length W in the width direction is greater than the total length L in the conduction direction. Furthermore, ends in the conduction direction of the fuse element 5 are bent toward the circuit substrate side to form the terminals 30.

Through holes 5*d*, 5*e*, the opening shapes of which being substantially semicircular, are arranged in alignment on the fuse element 5 on side surfaces in the width direction of the fuse element. That is, the through holes 5*d*, 5*e* are exposed on side surfaces in the width direction of the fuse element 5.

Through Holes

Next, position and size of the through holes 5*d*, 5*e* of the fuse element 5 will be described. Vicinities near the through holes 5*d*, 5*e* are blown out first as in other embodiments and, in order to adjust the blowout position, it is particularly preferable that these vicinities are located in a central vicinity with respect to the length L in the conduction direction. In other words, in order to interrupt the circuit between the first and second electrodes 3, 4, it is preferable to select an approximately central vicinity between the first and second electrodes 3, 4.

In particular, the through holes 5*d*, 5*e* are preferably located at positions separated from end portions in the conduction direction of the fuse element 5 by L1 and L2, respectively. More particularly, respective lengths of L1 and L2 are such that L/4<L1 and L/4<L2. While the current path of the fuse element 5 is divided into a plurality of parts, volume of the element, which has a predetermined heat capacity, is thus ensured in the vicinity of the first and second electrodes 3, 4.

Furthermore, size of the through holes 5*d*, 5*e* is preferably selected so that L/2>L0, wherein L0 is the maximum length of the through holes in the conduction direction of the fuse element 5, with respect to the length L of the current path of the fuse element 5. If a larger size is selected, the through holes 5*d*, 5*e* might extend to portions corresponding to the first and second electrodes 3, 4.

The fuse element 5 has a narrow-width portion 5*g* between the through holes 5*d*, 5*e*, and, when blowout due to applied current occurs, blows out from the narrow-width portion 5*g*.

Third Embodiment

Fuse Element

Next, another example of the fuse element 5 will be described. Because the structure of the fuse device 1 is substantially the same as that of the first embodiment in which both ends of the fuse element are bent to provide the terminals 30, it is not specifically illustrated in the drawings. Moreover, the same reference signs are assigned to parts having the same function as in the configuration of the fuse element 5 of the first embodiment, and a description thereof is omitted.

Figure 14:
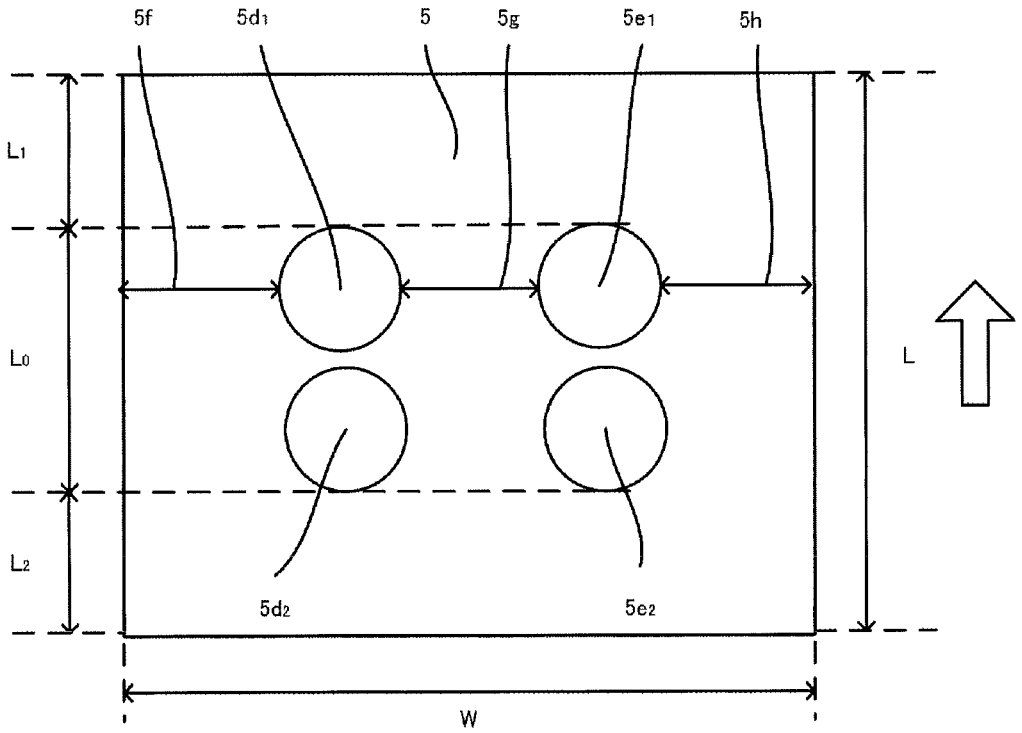
FIG. 14 is a plan view illustrating one example of a fuse element according to a third embodiment.
Figure 15:
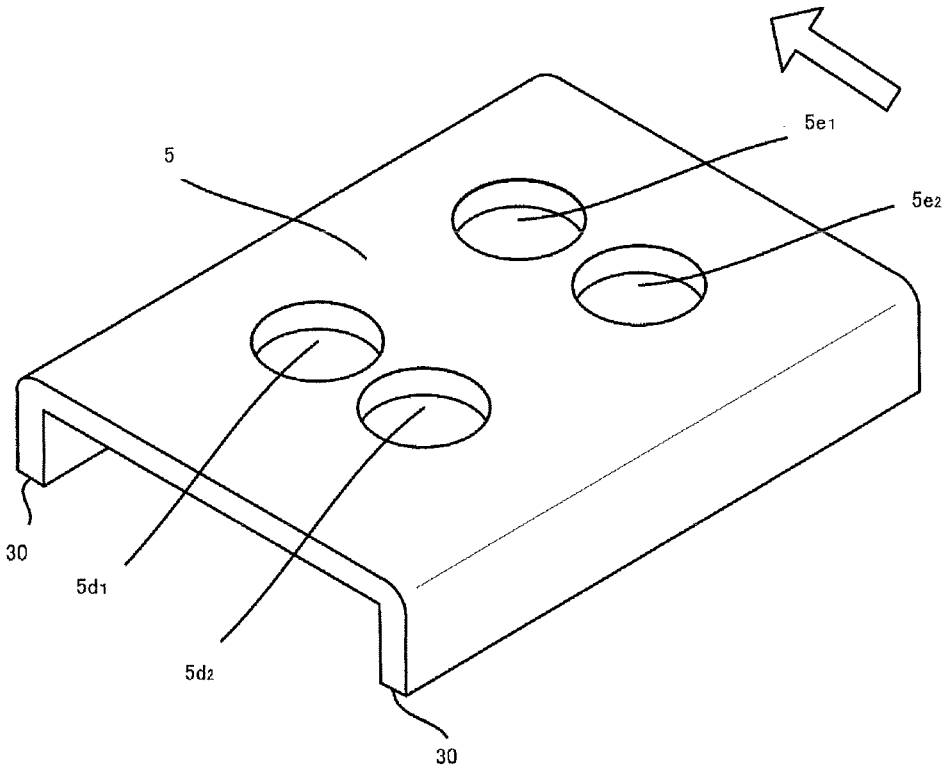
FIG. 15 is a perspective view illustrating one example of a fuse element according to a third embodiment.

As illustrated in FIGS. 14 and 15, the fuse element 5 has a laminated structure formed in an approximately rectangular plate shape and has a wide structure in which the length W in the width direction is greater than the total length L in the conduction direction. Furthermore, ends in the conduction direction of the fuse element 5 are bent toward the circuit substrate side to form the terminals 30.

The fuse element 5 has through holes 5*d*1, 5*e*1 and through holes 5*d*2, 5*e*2 which are circular in shape and arranged in alignment in the width direction of the fuse element 5 in a middle portion in the conduction direction. The through holes 5*d*1, 5*e*1 and the through holes 5*d*2, 5*e*2 are respectively provided at a predetermined interval in the conduction direction of the fuse element 5. The through holes 5*d*1, 5*d*2 are aligned in the conduction direction and the through holes 5*e*1, 5*e*2 are aligned in the conduction direction. That is, the through holes 5*d*1, 5*e*1 and the through holes 5*d*2, 5*e*2 can be considered to be arranged in an array in the fuse element 5.

Through Holes

Next, the positions and size of the through holes 5*d*1, 5*e*1 and the through holes 5*d*2, 5*e*2 of the fuse element 5 will be described. Vicinities near the through holes 5*d*1, 5*e*1 and the through holes 5*d*2, 5*e*2 are blown out first as described above, and, in order to adjust the blowout position, it is particularly preferable that these vicinities are located in a central vicinity with respect to the length L in the conduction direction. In other words, in order to interrupt the circuit between the first and second electrodes 3, 4, it is preferable to select a central vicinity between the first and second electrodes 3, 4.

In particular, the through holes 5*d*1, 5*e*1 and the through holes 5*d*2, 5*e*2 are preferably located at positions separated from end portions in the conduction direction of the fuse element 5 by L1 and L2, respectively. More particularly, respective lengths of L1 and L2 are such that L/4<L1 and L/4<L2. While the current path of the fuse element 5 is divided into a plurality of parts, volume of the element, which has a predetermined heat capacity, is thus ensured in the vicinity of the first and second electrodes 3, 4.

Furthermore, size of the through holes 5*d*1, 5*d*2 is preferably selected so that L/2>L0, wherein L0 is the sum of the diameters of and distance between the through holes 5*d*1, 5*d*2, that is, the maximum length of the through holes in the conduction direction of the fuse element 5, with respect to the length L of the current path of the fuse element 5. If a larger size is selected, the through holes 5*d*1, 5*d*2 might extend to portions corresponding to the first and second electrodes 3, 4. Because size of the through holes 5*e*1, 5*e*2 can be defined in the same manner as for the through holes 5*d*1, 5*d*2, a description thereof is omitted.

The fuse element 5 has a narrow-width portion 5*g* between the through holes 5*d*1, 5*e*1 and between the through holes 5*d*2, 5*e*2, a narrow-width portion 5*f* on the outer side in the width direction of the fuse element 5 of the through holes 5*d*1, 5*d*2, and a narrow-width portion 5*h* on the outer side in the width direction of the fuse element 5 of the through holes 5*e*1, 5*e*2.

Such a fuse element 5 configured as described above in which a plurality of narrow-width portions are provided in the conduction direction of the fuse element 5, in comparison with the first embodiment which has only one row arranged in alignment, can more precisely control blowout positions at a plurality of locations of the fuse element 5.

Fourth Embodiment

Fuse Element

Next, another example of the fuse element 5 will be described. Because the structure of the fuse device 1 is substantially the same as that of the first embodiment in which both ends of the fuse element are bent to provide the terminals 30, it is not specifically illustrated in the drawings. Moreover, the same reference signs are assigned to parts having the same function as in the configuration of the fuse element 5 of the first embodiment, and a description thereof is omitted.

Figure 16:
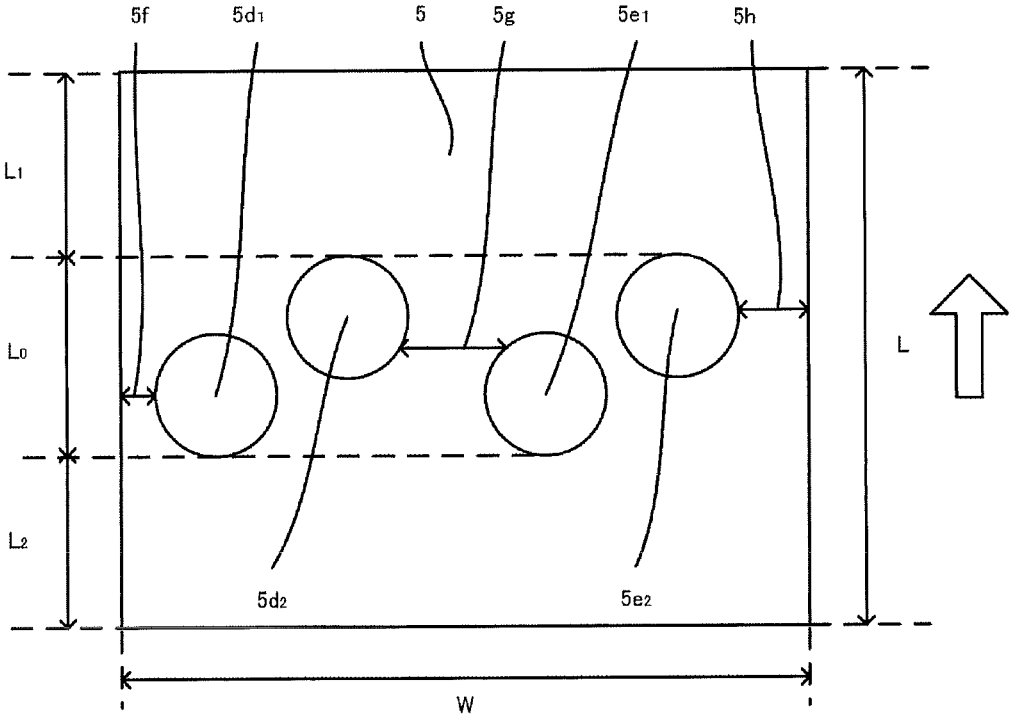
FIG. 16 is a plan view illustrating one example of a fuse element according to a fourth embodiment.
Figure 17:
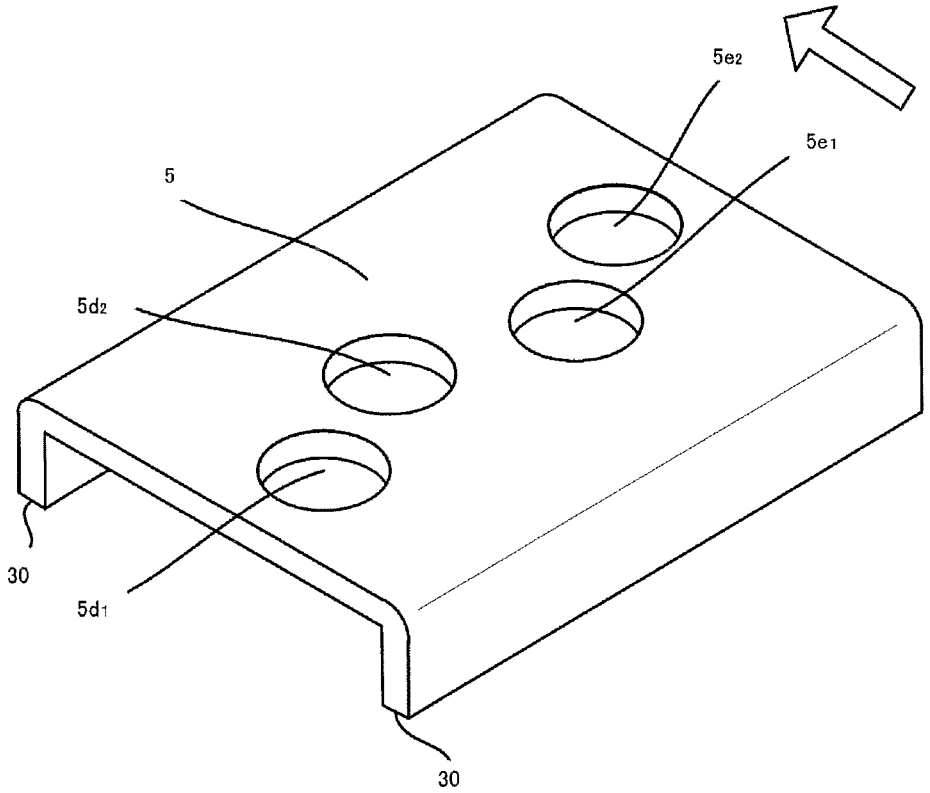
FIG. 17 is a perspective view illustrating one example of a fuse element according to a fourth embodiment.

As illustrated in FIGS. 16 and 17, the fuse element 5 has a laminated structure formed in an approximately rectangular plate shape and has a wide structure in which the length W in the width direction is greater than the total length L in the conduction direction. Furthermore, ends in the conduction direction of the fuse element 5 are bent toward the circuit substrate side to form the terminals 30.

The fuse element 5 has through holes 5*d*1, 5*e*1 and through holes 5*d*2, 5*e*2 which are circular in shape and arranged in alignment in the width direction of the fuse element 5 in a middle portion in the conduction direction. The through holes 5*d*1, 5*e*1 and the through holes 5*d*2, 5*e*2 are respectively provided at a predetermined interval in the conduction direction of the fuse element 5. The through holes 5*d*1, 5*d*2 are aligned with centers offset with respect to the conduction direction, and the through holes 5*e*1, 5*e*2 are also aligned with centers offset with respect to the conduction direction. In particular, in the fuse element 5, the through holes 5*d*1, 5*d*2 and the through holes 5*e*1, 5*e*2 are each aligned so as not to overlap in the conduction direction.

Through Holes

Next, the positions and size of the through holes 5*d*1, 5*e*1 and the through holes 5*d*2, 5*e*2 of the fuse element 5 will be described. Vicinities near the through holes 5*d*1, 5*e*1 and the through holes 5*d*2, 5*e*2 are blown out first as described above, and, in order to adjust the blowout position, it is particularly preferable that these vicinities are located in a central vicinity with respect to the length L in the conduction direction. In other words, in order to interrupt the circuit between the first and second electrodes 3, 4, it is preferable to select a central vicinity between the first and second electrodes 3, 4.

In particular, the through holes 5*d*1, 5*e*1 and the through holes 5*d*2, 5*e*2 are preferably located at positions separated from end portions in the conduction direction of the fuse element 5 by L1 and L2, respectively. More particularly, respective lengths of L1 and L2 are such that L/4<L1 and L/4<L2. While the current path of the fuse element 5 is divided into a plurality of parts, volume of the element, which has a predetermined heat capacity, is thus ensured in the vicinity of the first and second electrodes 3, 4.

Furthermore, size of the through holes 5*d*1, 5*d*2 is preferably selected so that L/2>L0, wherein L0 is maximum length including the through holes 5*d*1, 5*d*2 in the conduction direction, with respect to the total length L of the current path of the fuse element 5. If a larger size is selected, the through holes 5*d*1, 5*d*2 might extend to portions corresponding to the first and second electrodes 3, 4. Because size of the through holes 5*e*1, 5*e*2 can be defined in the same manner as for the through holes 5*d*1, 5*d*2, a description thereof is omitted.

The fuse element 5 has a narrow-width portion 5*g* between the through holes 5*d*2, 5*e*1, a narrow-width portion 5*f* on the outer side in the width direction of the fuse element 5 of the through hole 5*d*1, and a narrow-width portion 5*h* on the outer side in the width direction of the fuse element 5 of the through hole 5*e*2.

Such a fuse element 5 configured as described above in which a plurality of narrow-width portions are provided in the conduction direction of the fuse element 5, in comparison with the first embodiment which has only one row arranged in alignment, can more precisely control blowout positions at a plurality of locations of the fuse element 5.

Fifth Embodiment

Fuse Element

Next, another example of the fuse element 5 will be described. Because the structure of the fuse device 1 is substantially the same as that of the first embodiment in which both ends of the fuse element are bent to provide the terminals 30, it is not specifically illustrated in the drawings. Moreover, the same reference signs are assigned to parts having the same function as in the configuration of the fuse element 5 of the first embodiment, and a description thereof is omitted.

Figure 18:
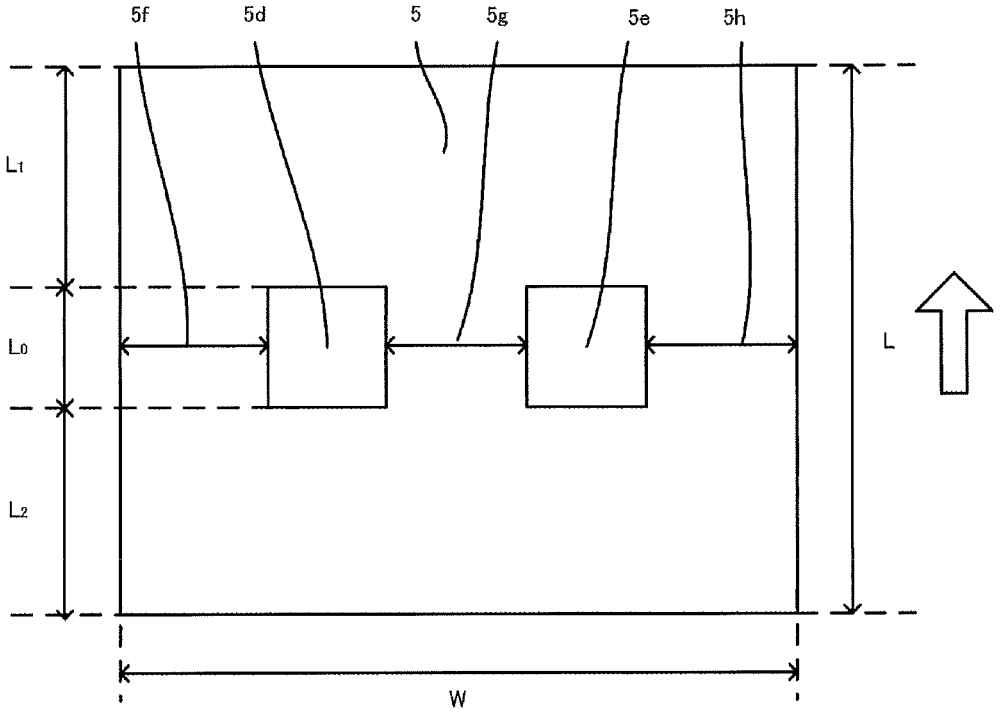
FIG. 18 is a plan view illustrating one example of a fuse element according to a fifth embodiment.
Figure 19:
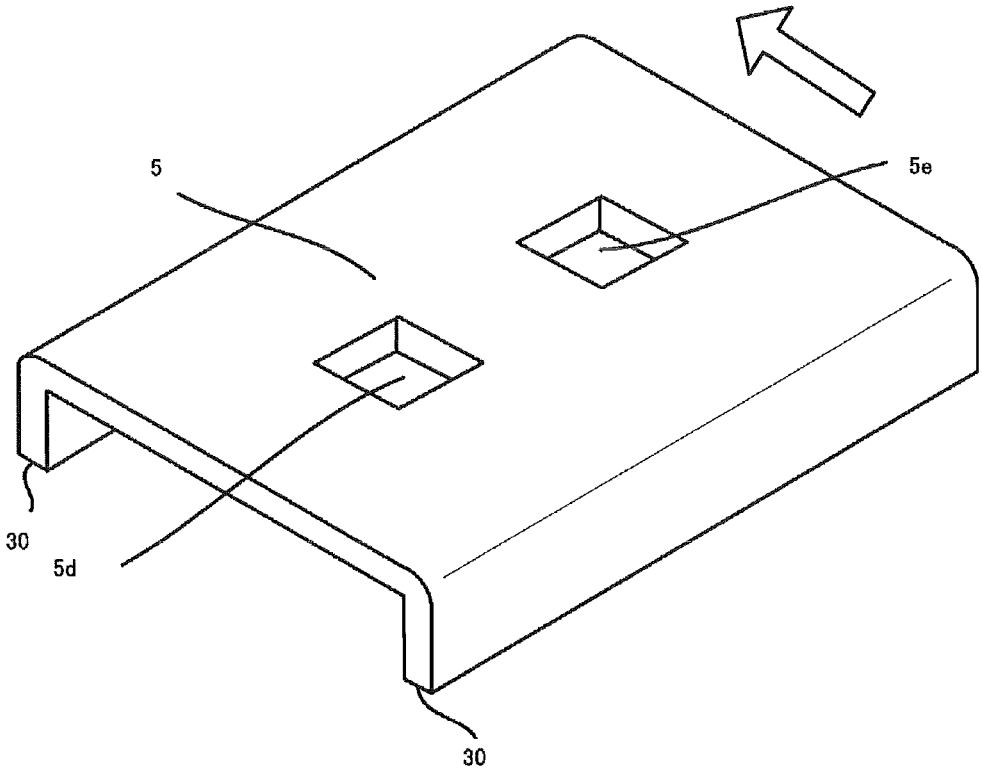
FIG. 19 is a perspective view illustrating one example of a fuse element according to a fifth embodiment.

As illustrated in FIGS. 18 and 19, the fuse element 5 has a laminated structure formed in an approximately rectangular plate shape and has a wide structure in which the length W in the width direction is greater than the total length L in the conduction direction. Furthermore, ends in the conduction direction of the fuse element 5 are bent toward the circuit substrate side to form the terminals 30.

The fuse element 5 has through holes 5*d*1, 5*e*1 which are rectangular in shape and arranged in alignment in the width direction of the fuse element 5 in a middle portion in the conduction direction.

Through Holes

Next, position and size of the through holes 5*d*, 5*e* of the fuse element 5 will be described. Vicinities near the through holes 5*d*, 5*e* and the through holes 5*d*2, 5*e*2 are blown out first as described above, and, in order to adjust the blowout position, it is particularly preferable that these vicinities are located in a central vicinity with respect to the length L in the conduction direction. In other words, in order to interrupt the circuit between the first and second electrodes 3, 4, it is preferable to select a central vicinity between the first and second electrodes 3, 4.

In particular, the through holes 5*d*, 5*e* are preferably located at positions separated from end portions in the conduction direction of the fuse element 5 by L1 and L2, respectively. More particularly, respective lengths of L1 and L2 are such that L/4<L1 and L/4<L2. While the current path of the fuse element 5 is divided into a plurality of parts, volume of the element, which has a predetermined heat capacity, is thus ensured in the vicinity of the first and second electrodes 3, 4.

Furthermore, size of the through holes 5*d*, 5*e* is preferably selected so that L/2>L0, wherein L0 is the length of a side of the rectangular shape in the conduction direction, that is, the maximum length including the through holes 5*d*, 5*e* in the conduction direction, with respect to the total length L of the current path of the fuse element 5. If a larger size is selected, the through holes 5*d*, 5*e* might extend to portions corresponding to the first and second electrodes 3, 4.

The fuse element 5 has a narrow-width portion 5*g* between the through holes 5*d*, 5*e*, a narrow-width portion 5*f* on the outer side in the width direction of the fuse element 5 of the through hole 5*d*, and a narrow-width portion 5*h* on the outer side in the width direction of the fuse element 5 of the through hole 5*e*.

Sixth Embodiment

Fuse Element

Next, another example of the fuse element 5 will be described. Because the structure of the fuse device 1 is substantially the same as that of the first embodiment in which both ends of the fuse element are bent to provide the terminals 30, it is not specifically illustrated in the drawings. Moreover, the same reference signs are assigned to parts having the same function as in the configuration of the fuse element 5 of the first embodiment, and a description thereof is omitted.

Figure 20:
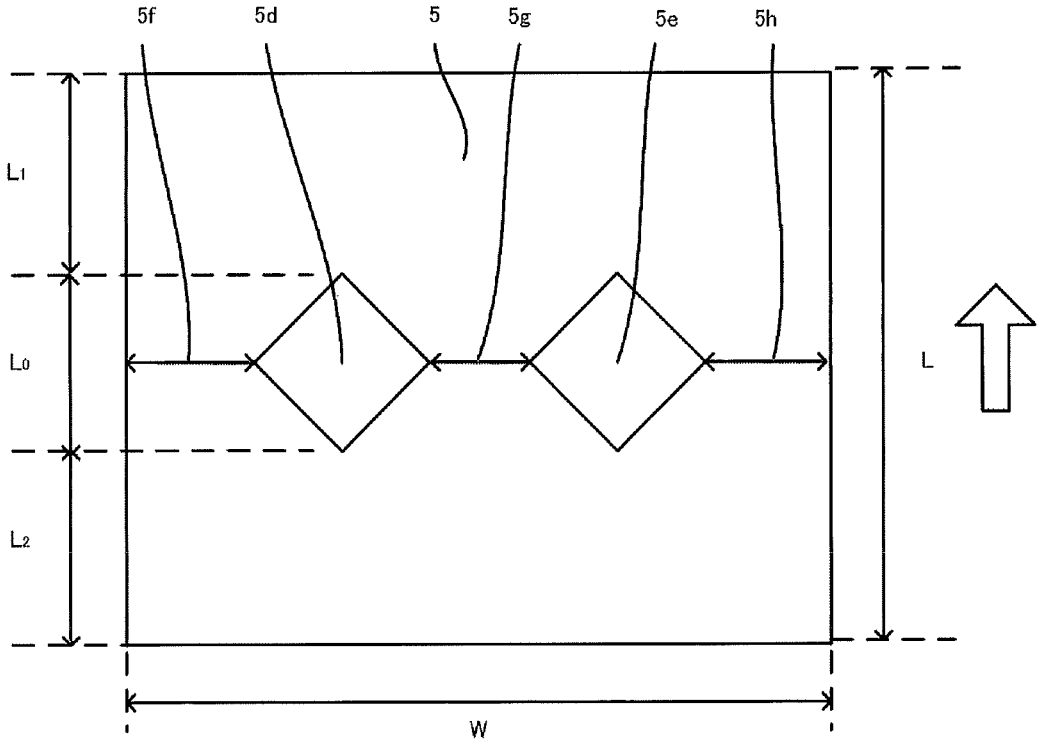
FIG. 20 is a plan view illustrating one example of a fuse element according to a sixth embodiment.
Figure 21:
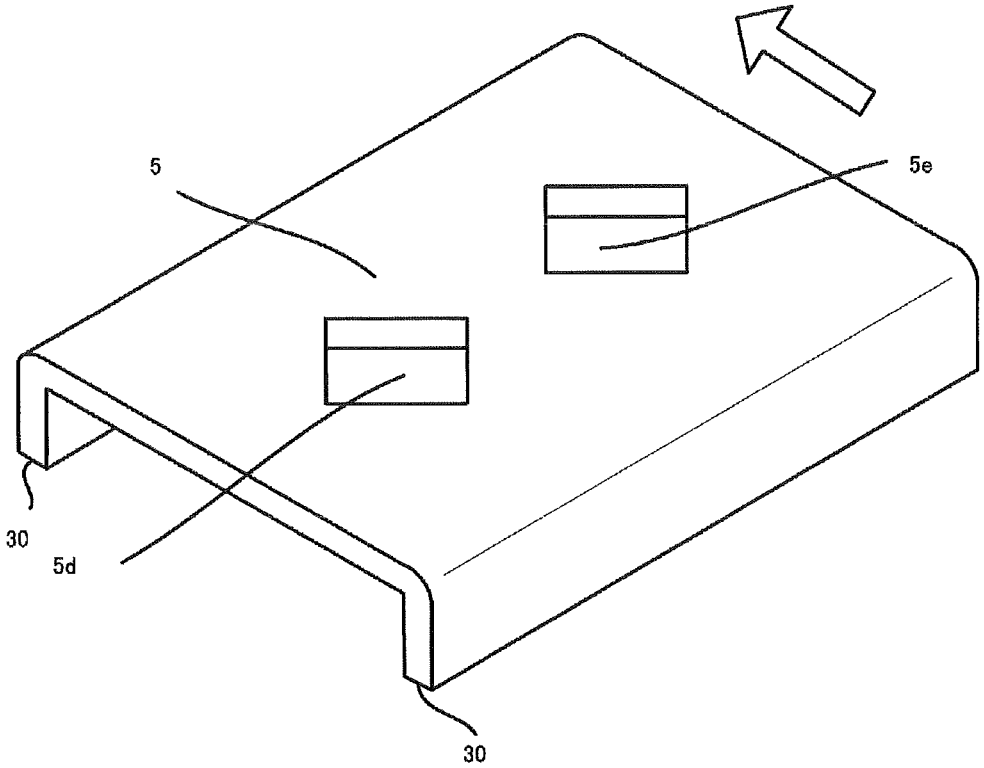
FIG. 21 is a perspective view illustrating one example of a fuse element according to a sixth embodiment.

As illustrated in FIGS. 20 and 21, the fuse element 5 has a laminated structure formed in an approximately rectangular plate shape and has a wide structure in which the length W in the width direction is greater than the total length L in the conduction direction. Furthermore, ends in the conduction direction of the fuse element 5 are bent toward the circuit substrate side to form the terminals 30.

The fuse element 5 has through holes 5*d*1, 5*e*1 which are rhombic in shape and arranged in alignment in the width direction of the fuse element 5 in a middle portion in the conduction direction.

Through Holes

Next, position and size of the through holes 5*d*, 5*e* of the fuse element 5 will be described. Vicinities near the through holes 5*d*, 5*e* are blown out first as described above, and, in order to adjust the blowout position, it is particularly preferable that these vicinities are located near a central vicinity with respect to the length L in the conduction direction. In other words, in order to interrupt the circuit between the first and second electrodes 3, 4, it is preferable to select a central vicinity between the first and second electrodes 3, 4.

In particular, the through holes 5*d*, 5*e* are preferably located at positions separated from end portions in the conduction direction of the fuse element 5 by L1 and L2, respectively. More particularly, respective lengths of L1 and L2 are such that $L/4<L1$ and $L/4<L2$. While the current path of the fuse element 5 is divided into a plurality of parts, volume of the element, which has a predetermined heat capacity, is thus ensured in the vicinity of the first and second electrodes 3, 4.

Furthermore, size of the through holes 5*d*, 5*e* is preferably selected so that $L/2>L0$, wherein L0 is the length of the diagonal of the rhombic shape in the conduction direction, that is, the maximum length including the through holes 5*d*, 5*e* in the conduction direction, with respect to the total length L of the current path of the fuse element 5. If a larger size is selected, the through holes 5*d*, 5*e* might extend to portions corresponding to the first and second electrodes 3, 4.

The fuse element 5 has a narrow-width portion 5*g* between the through holes 5*d*, 5*e*, that is, between vertices of the rhombi in the width direction, a narrow-width portion 5*f* outside the vertex of the rhombus in the width direction of the fuse element 5 of the through hole 5*d*, and a narrow-width portion 5*h* outside the vertex of the rhombus in the width direction of the fuse element 5 of the through hole 5*e*.

The fuse element 5 configured as described above can achieve the same effect as the first embodiment.

Seventh Embodiment

Fuse Element

Next, another example of the fuse element 5 will be described. Because the structure of the fuse device 1 is substantially the same as that of the first embodiment in which both ends of the fuse element are bent to provide the terminals 30, it is not specifically illustrated in the drawings. Moreover, the same reference signs are assigned to parts having the same function as in the configuration of the fuse element 5 of the first embodiment, and a description thereof is omitted.

Figure 22:
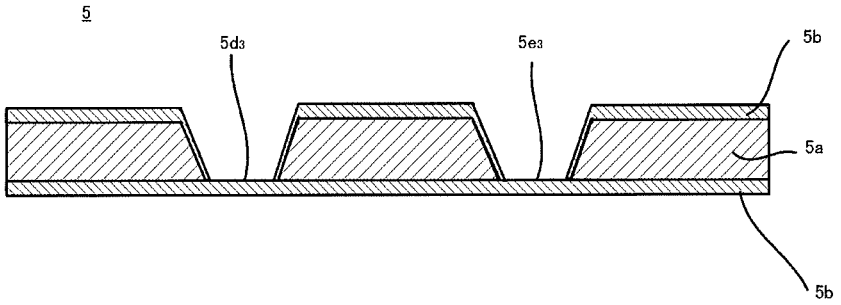
FIG. 22 is a cross-sectional view illustrating one example of a fuse element according to a seventh embodiment.
Figure 23:
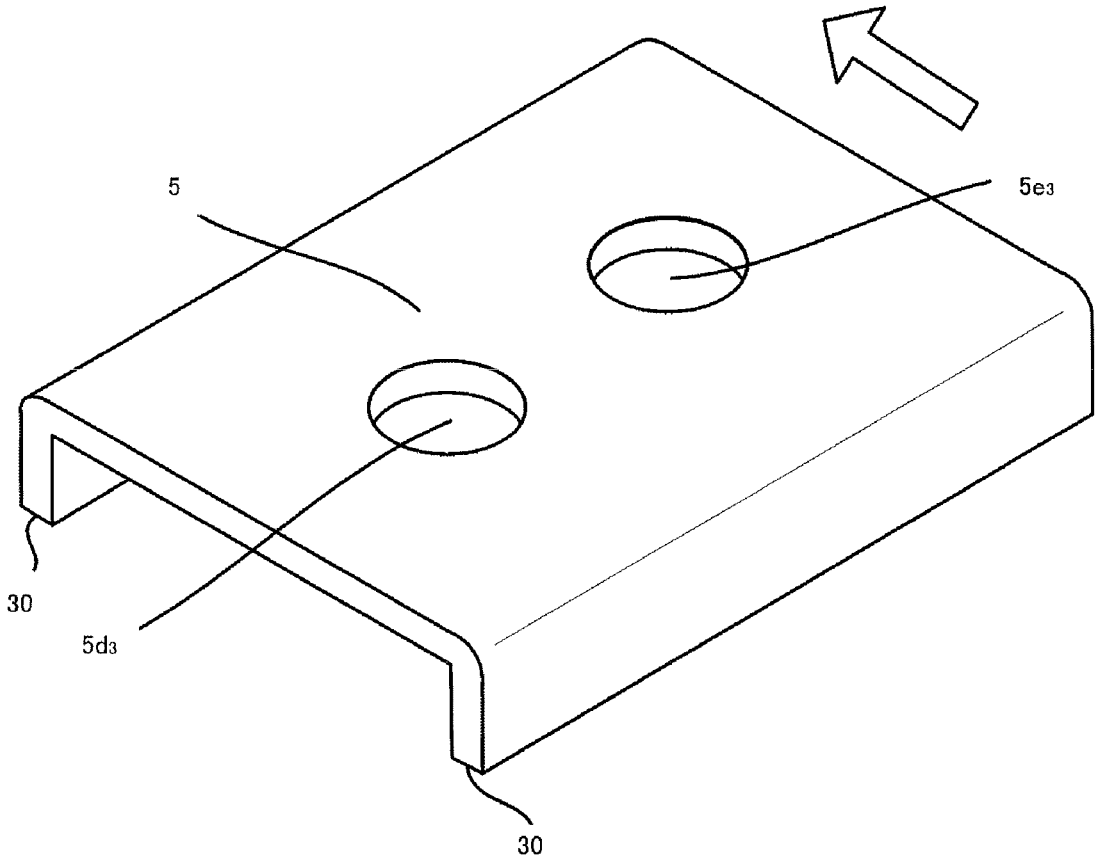
FIG. 23 is a perspective view illustrating one example of a fuse element according to a seventh embodiment.

As illustrated in FIGS. 22 and 23, the fuse element 5 has a laminated structure formed in an approximately rectangular plate shape and has a wide structure in which the length W in the width direction is greater than the total length L in the conduction direction. Furthermore, ends in the conduction direction of the fuse element 5 are bent toward the circuit substrate side to form the terminals 30.

The fuse element 5 has recesses 5*d*3, 5*e*3 which are circular in shape and arranged in alignment in the width direction of the fuse element 5 in a middle portion in the conduction direction. The recesses 5*d*3, 5*e*3 are configured to not penetrate the fuse element 5. Particularly, the low melting point metal layer 5*a* is removed leaving a bowl-shaped structure of the high melting point metal layer 5*b*.

The recesses 5*d*3, 5*e*3 can, for example, be easily formed by pressing the fuse element 5 with a punch having a blunt tip. Moreover, the recesses 5*d*3, 5*e*3 can be reliably formed by simpler processes than those for forming through holes.

Recesses

Next, position and size of the recesses 5*d*3, 5*e*3 of the fuse element 5 will be described. Vicinities near the recesses 5*d*3, 5*e*3 are blown out first as described above, and, in order to adjust the blowout position, it is particularly preferable that these vicinities are located in a central vicinity with respect to the length L in the conduction direction. In other words, in order to interrupt the circuit between the first and second electrodes 3, 4, it is preferable to select a central vicinity between the first and second electrodes 3, 4.

In particular, the recesses 5*d*3, 5*e*3 are preferably located at positions separated from end portions in the conduction direction of the fuse element 5 by L1 and L2, respectively. More particularly, respective lengths of L1 and L2 are such that $L/4<L1$ and $L/4<L2$. While the primary current path of the fuse element 5 is divided into a plurality of parts, volume of the element, which has a predetermined heat capacity, is thus ensured in the vicinity of the first and second electrodes 3, 4. It should be noted that the recesses 5*d*3, 5*e*3 constitute a current path of a region comprising only the high melting point metal layer 5*b*. However, in view of the characteristics of the present fuse element 5 in which the low melting point metal layer 5*a* blows out due to current flow first, in the seventh embodiment, in the portion having a laminated structure, the low melting point metal layer 5*a* is considered to be the primary current path which is considered to be separate from the current path of the recesses 5*d*3, 5*e*3.

Furthermore, size of the recesses 5*d*3, 5*e*3 is preferably selected so that $L/2>L0$, wherein L0 is the length of the diameter of the recesses 5*d*3, 5*e*3, that is, the maximum length including the through holes 5*d*, 5*e* in the conduction direction, with respect to the total length L of the current path of the fuse element 5. If a larger size is selected, hole machining (recess machining) becomes difficult and the through holes 5*d*, 5*e* might extend to portions corresponding to the first and second electrodes 3, 4.

The fuse element 5 has a narrow-width portion 5*g* between the recesses 5*d*3, 5*e*3, a narrow-width portion 5*f* on the outer side in the width direction of the fuse element 5 of the recess 5*d*3, and a narrow-width portion 5*h* on the outer side in the width direction of the fuse element 5 of the recess 5*e*3.

In such a fuse element 5 configured as described above, although current flows thorough the recesses 5*d*3, 5*e*3, because the low melting point metal layer 5*a* is separated by the high melting point metal layer 5*b*, explosive melting of the entire fuse element 5 does not occur and each primary current path blows out independently so that an effect equivalent to that of the first embodiment can be obtained.

Eighth Embodiment

Fuse Element

Next, another example of the fuse element 5 will be described. Because the structure of the fuse device 1 is substantially the same as that of the first embodiment in which both ends of the fuse element are bent to provide the terminals 30, it is not specifically illustrated in the drawings. Moreover, the same reference signs are assigned to parts having the same function as in the configuration of the fuse element 5 of the first embodiment, and a description thereof is omitted.

Figure 24:
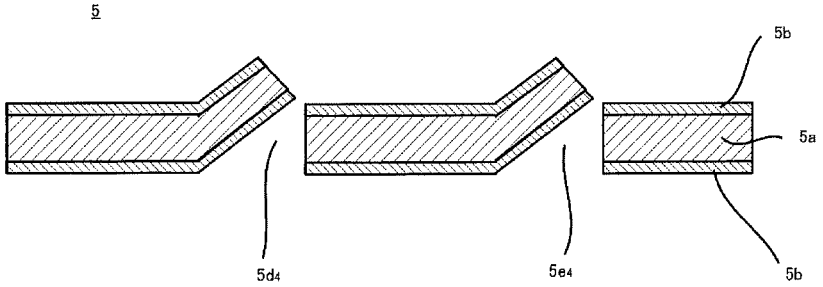
FIG. 24 is a cross-sectional view illustrating one example of a fuse element according to an eighth embodiment.
Figure 25:
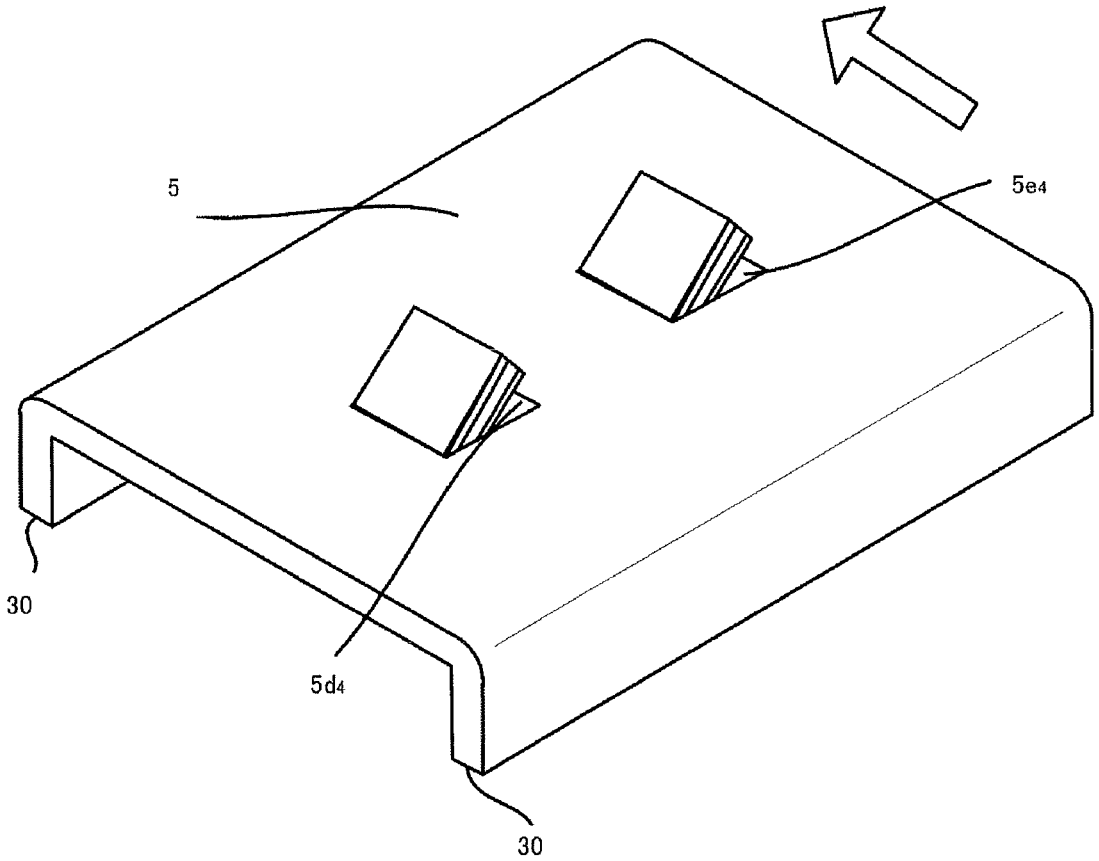
FIG. 25 is a perspective view illustrating one example of a fuse element according to an eighth embodiment.

As illustrated in FIGS. 24 and 25, the fuse element 5 has a laminated structure formed in an approximately rectangular plate shape and has a wide structure in which the length W in the width direction is greater than the total length L in the conduction direction. Furthermore, ends in the conduction direction of the fuse element 5 are bent toward the circuit substrate side to form the terminals 30.

The fuse element 5 has cut through holes 5*d*4, 5*e*4 which are rectangular in shape and arranged in alignment in the width direction of the fuse element 5 in a middle portion in the conduction direction.

The cut through holes 5*d*4, 5*e*4, have rectangular openings and can be formed by cutting three sides in a central portion of the fuse element 5 and pushing to raise a portion of the fuse element 5. The cut through holes 5*d*4, 5*e*4 can be formed at the same time as the terminals 30 during press processing by simultaneously making the three-sided cuts and pressing to raise the corresponding areas, thereby enabling simplified manufacturing processes.

The cut through holes 5*d*4, 5*e*4 are oriented so as to be exposed in the width direction of the fuse element 5 when raised.

Cut Through Holes

Next, the position and size of the cut through holes 5*d*4, 5*e*4 of the fuse element 5 will be described. Vicinities near the cut through holes 5*d*4, 5*e*4 are blown out first as described above, and, in order to adjust the blowout position, it is particularly preferable that these vicinities are located in a central vicinity with respect to the length L in the conduction direction. In other words, in order to interrupt the circuit between the first and second electrodes 3, 4, it is preferable to select a central vicinity between the first and second electrodes 3, 4.

In particular, the cut through holes 5*d*4, 5*e*4 are preferably located at positions separated from end portions in the conduction direction of the fuse element 5 by L1 and L2, respectively. More particularly, respective lengths of L1 and L2 are such that $L/4<L1$ and $L/4<L2$. While the current path of the fuse element 5 is divided into a plurality of parts, volume of the element, which has a predetermined heat capacity, is thus ensured in the vicinity of the first and second electrodes 3, 4.

Furthermore, size of the cut through holes 5*d*4, 5*e*4 is preferably selected so that $L/2>L0$, wherein L0 is the length of a side of the rectangular shape in the conduction direction, that is, the maximum length including the through holes 5*d*, 5*e* in the conduction direction, with respect to the total length L of the current path of the fuse element 5. If a larger size is selected, the cut through holes 5*d*4, 5*e*4 might extend to portions corresponding to the first and second electrodes 3, 4.

The fuse element 5 has a narrow-width portion 5*g* between the cut through holes 5*d*4, 5*e*4, a narrow-width portion 5*f* on the outer side in the width direction of the fuse element 5 of the cut through hole 5*d*4, and a narrow-width portion 5*h* on the outer side in the width direction of the fuse element 5 of the cut through hole 5*e*4.

The fuse element 5 configured as described above can be manufactured using simpler manufacturing processes and can obtain the same effect as the first embodiment.

Figure 26:
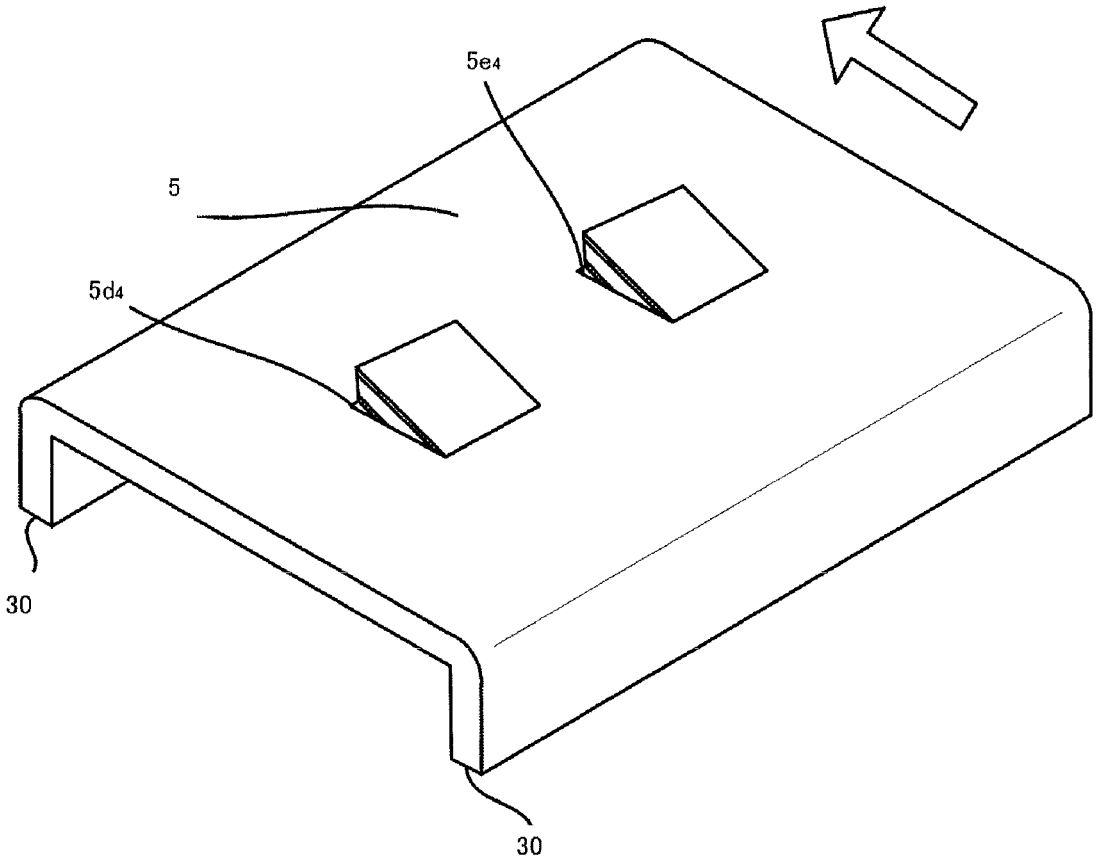
FIG. 26 is a perspective view illustrating another example of a fuse element according to an eighth embodiment.

Furthermore, as illustrated in FIG. 26, the cut through holes 5*d*4, 5*e*4 may be oriented so as to be exposed in the width direction of the fuse element 5 when raised. That is, it is possible to rotate cut positions and the direction of raising of the cut through holes 5*d*4, 5*e*4 described in FIG. 25 by 90 degrees.

Ninth Embodiment

Heat-Generator-Integrated Fuse Device

The fuse device 1 according to the present invention can also be applied to a heat-generator-integrated fuse device. In particular, as illustrated in FIG. 27, a heat-generator-integrated fuse device 100 comprises an insulating substrate 2, a heat generator 14 covered by an insulating member 15 and laminated on the insulating substrate 2, a heat generator lead electrode 16 laminated on the insulating member 15 to overlap the heat generator 14, a fuse element 5 connected to the heat generator lead electrode 16 in a central portion and which has terminals 30 disposed on both ends which are connected via a bonding material 8 such as solder paste to a circuit pattern on a circuit substrate, a flux 17 provided on the fuse element 5 for removing oxide film generated on the fuse element 5 to improve wetting properties, and a cover member 20 as a housing for covering the fuse element 5.

The structure of the fuse element 5 is substantially the same as in the case of having the terminals 30 as described in the first embodiment and is therefore not specifically illustrated in the drawings; however, it is preferable to position the through hole 5*d* as a bridge from the end portion of the heat generator lead electrode 16, that is, extending towards a terminal 30 side. Furthermore, by adjusting a thickness t of the fuse element 5, the through hole may be made unnecessary.

Figure 27:
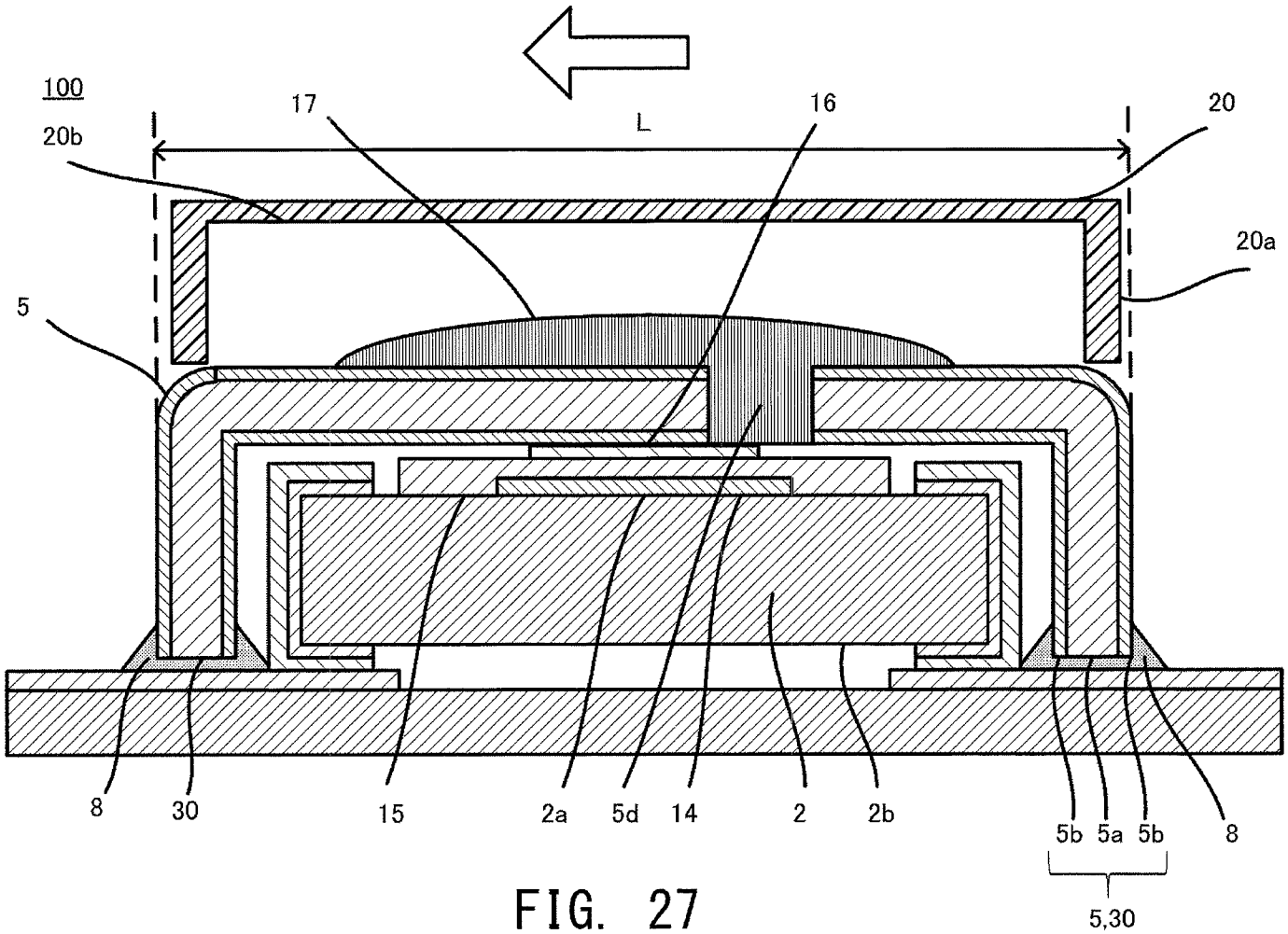
FIG. 27 is a cross-sectional view illustrating one example of a heat-generator-integrated fuse device according to a ninth embodiment.

As illustrated in FIG. 27, the fuse element 5 has a laminated structure composed of inner and outer layers, has a low melting point metal layer 5*a* as an inner layer and a high melting point metal layer 5*b* as an outer layer laminated on the low melting point metal layer 5*a*, and is formed in an approximately rectangular plate shape. The fuse element 5 is connected via a bonding material 8 such as solder paste to a circuit pattern on a circuit substrate. Although not illustrated, electrodes provided on both end portions in the conduction direction of the insulating substrate may be connected via a bonding material 8 such as solder. In this case, by dissipating heat from the terminals via the insulating substrate, surface temperature of the device can be reduced while a rated current flows, thus enabling increased ratings.

The heat generator 14 is made of a conductive material, such as W, Mo, and Ru, among others, which has a relatively high resistance and generates heat when a current flows therethrough. For example, to form the heating component, a powdered alloy, composition, or compound of these materials is mixed with a resin binder to obtain a paste, which is screen-printed as a pattern on the insulating substrate 2 before baking.

The insulating member 15 is arranged such that it covers the heat generator 14, and the heat generator lead electrode 16 is disposed so as to face the heat generator 14 with the insulating member 15 interposing therebetween. The insulating member 15 may be laminated between the heat generator 14 and the insulating substrate 2 to facilitate efficient transfer of heat from the heat generator 14 to the fuse element 5. The insulating member 15 may, for example, be made of glass.

The heat generator lead electrode 16 is connected to one end of the heat generator 14, one end of the heat generator lead electrode 16 being connected to a heat generator electrode, which is not illustrated, and the other end being connected to another heat generator electrode, which is not illustrated, via the heat generator 14.

The heat generator 14 generates heat when supplied with current from an electrode (not illustrated), and is thus able to heat the fuse element 5.

Thus, in the heat-generator-integrated fuse device 100, even in the case of an abnormal current exceeding the rated current not flowing through the fuse element 5, by supplying current to the heat generator 14 to heat the fuse element 5, it is possible to blow out the fuse element 5 under desired conditions.

Tenth Embodiment

Fuse Device

In the following, another example of the fuse device 1 will be described. The fuse device 1 is configured to include the fuse element of the first embodiment in which both ends are bent to provide the terminals 30; being nearly equivalent, other features are not specifically illustrated in the drawings. Moreover, the same reference signs are assigned to parts having the same function as the structure of the fuse device 1 of the first embodiment, and a description thereof is omitted.

Figure 28:
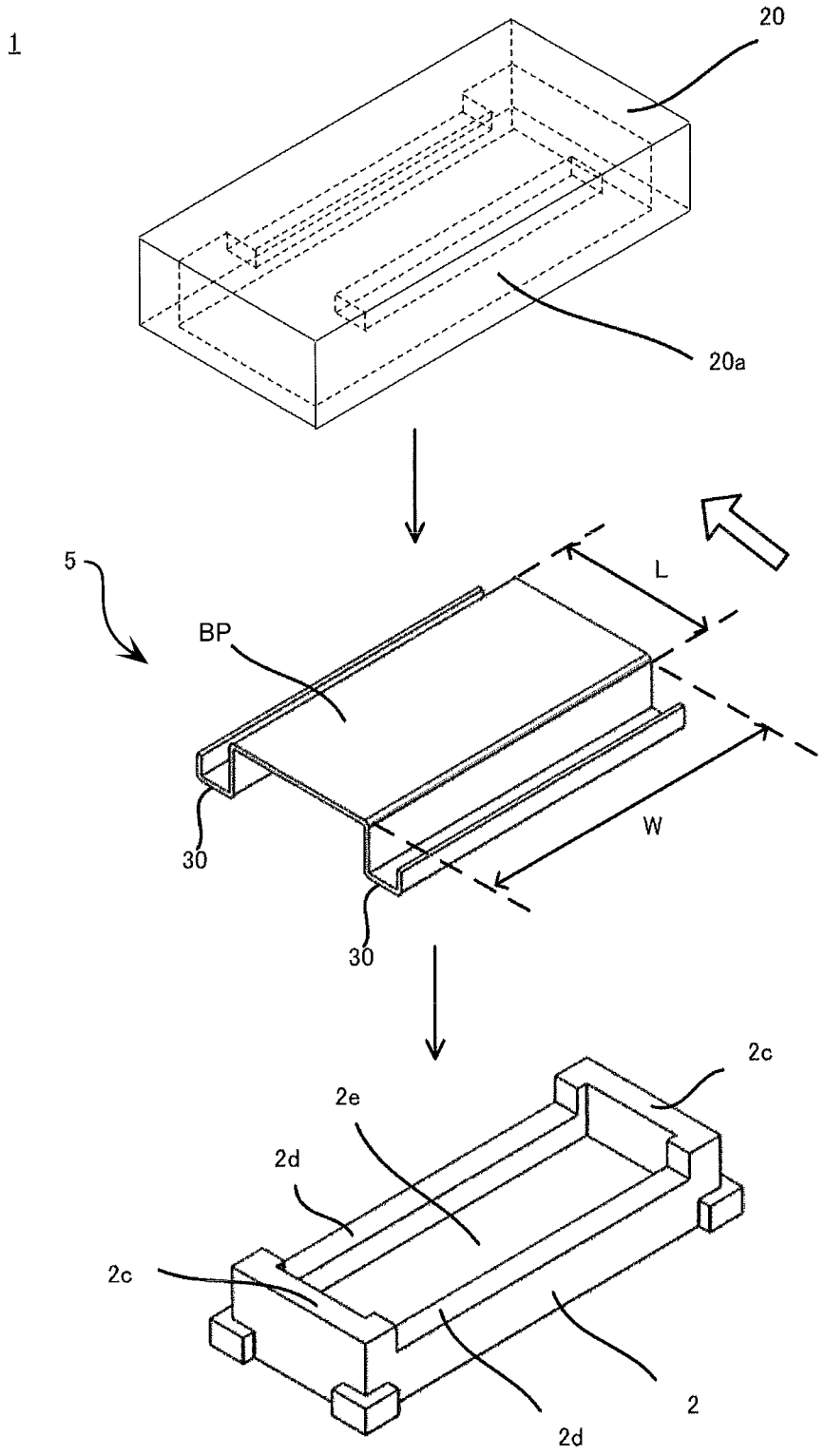
FIG. 28 is an exploded perspective view illustrating one example of a fuse device according to a tenth embodiment.
Figure 29:
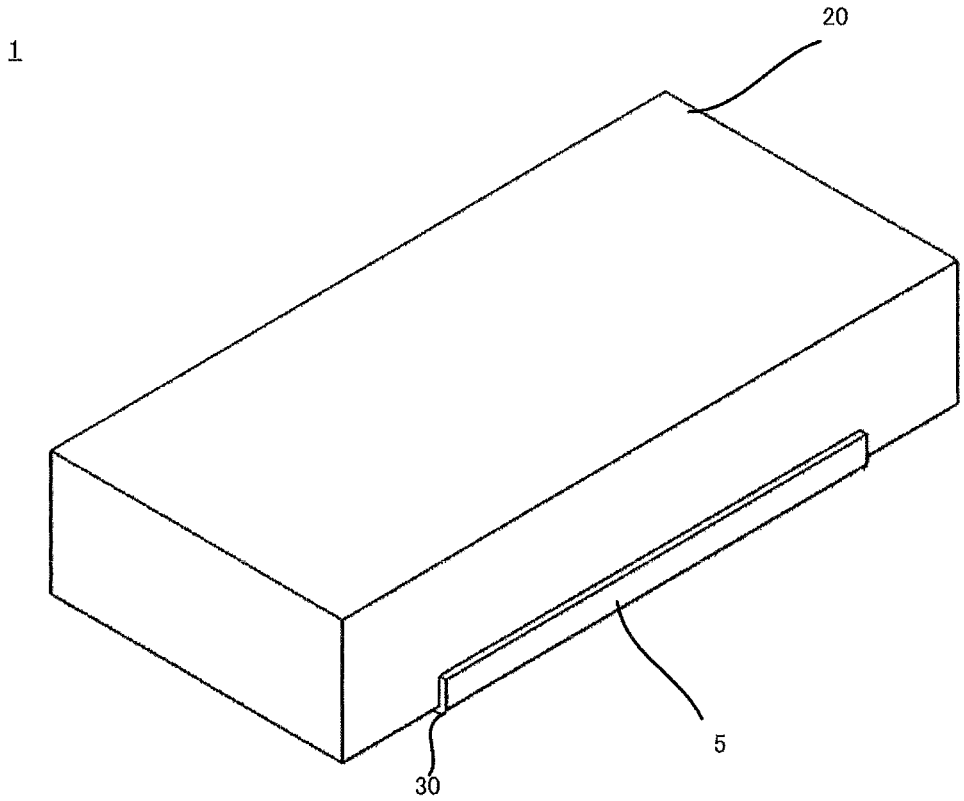
FIG. 29 is a perspective view illustrating one example of a fuse device according to a tenth embodiment.
Figure 30:
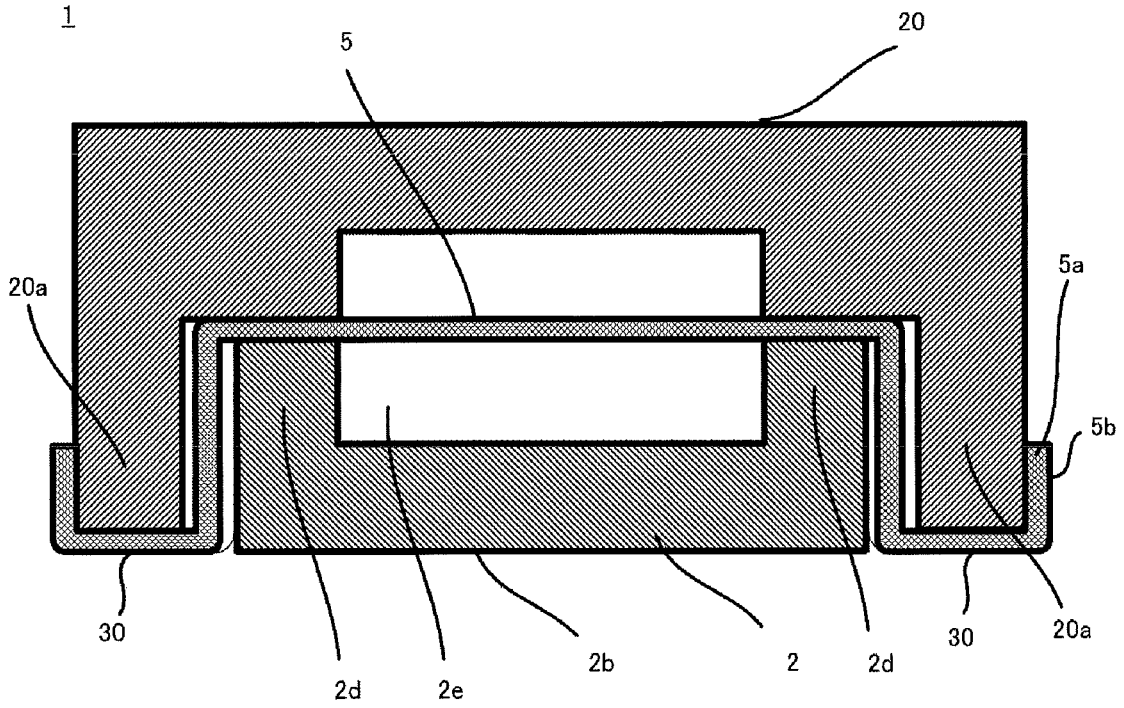
FIG. 30 is a cross-sectional view illustrating an example of a fuse device according to a tenth embodiment.

In particular, as illustrated in FIGS. 28 to 30, the fuse device 1 includes an insulating substrate 2, a fuse element 5, and a cover member 20.

The insulating substrate 2 has side walls 2*c* provided at both ends in the long direction, side walls 2*d* provided at both ends in the short direction, and a recessed portion 2*e* surrounded by the side walls 2*c* and 2*d*. The distance between the side walls 2*c* is greater than a length W in the width direction which is perpendicular to a conduction direction of the fuse element 5 and separation is provided by adding a predetermined clearance to the length W in the width direction.

The cover member 20 has side walls 20*a* at both ends in the short direction. The distance between the side walls 20*a* is greater than the total length L in the conduction direction of the fuse element 5, and separation is provided by adding a predetermined clearance distance to the total length L in the conduction direction.

The fuse element 5 has a laminated structure in an approximately rectangular plate shape and has a wide structure in which the length W in the width direction is greater than the total length L in the conduction direction. Furthermore, the fuse element 5 has terminals 30 in which an end portion in the conduction direction is bent a plurality of times. The total length L in the conduction direction is the length of a portion between first bends as viewed from a central portion with respect to both end portions in the conduction direction. Particularly, in the fuse element 5, both end portions in the conduction direction are bent three times to form the terminals 30.

More particularly, the fuse element 5 is configured such that both ends in the conduction direction are bent by 90 degrees toward the circuit board (not illustrated) which are then further bent by 90 degrees so as to be parallel to the circuit substrate and is further bent by 90 degrees so as to rise in the direction perpendicular to the circuit substrate. Thus, the fuse element 5 is formed with the end surface in the conducting direction facing up with respect to the circuit substrate and there is a difference in this respect from the fuse element of the first embodiment in which the terminals 30 are provided by bending both ends of the fuse element.

As illustrated in FIG. 28, bending processes of the fuse element 5 can be performed by mounting the insulating substrate 2, which is an underside base member, on a jig (not illustrated) having a shape corresponding to the terminals 30, mounting the rectangular plate-shaped fuse element 5 between the side walls 2*c* of the insulating substrate 2, mounting the cover member 20 above the fuse element 5, and pressing the cover member 20.

It can be considered that the bend positions of the fuse element 5 are determined by the side walls 20*a* of the cover member 20 and the side walls 2*d* of the insulating substrate 2. When the cover member 20 and the insulating substrate 2 are combined, a distance for maintaining sufficient separation that is greater than the film thickness of the fuse element 5 is provided between the side walls 20*a* of the cover member 20 and the side walls 2*d* of the insulating substrate. That is, the fuse device 1 holds the fuse element 5 in a space between the side walls 20*a* of the cover member 20 and the side walls 2*d* of the insulating substrate 2. As illustrated in FIGS. 10 and 11, the fuse device 1 is mounted on the circuit substrate, so that the terminals 30 are connected to connection terminals formed on the circuit substrate, for example, via solder.

The fuse device 1 is electrically connected to the circuit substrate via the terminals 30 formed in the fuse element 5 enabling resistance value reductions for the entire device as well as size reductions and rating increases. That is, in the fuse device 1, high resistances caused by interposing conductive vias can be avoided and ratings can be determined by the fuse element 5, allowing size reductions and ratings increases.

Furthermore, by forming the terminals 30 in the fuse element 5, forming a connecting electrode on the back surface of the insulating substrate 2 is not necessary, and the number of manufacturing steps for the fuse device 1 can be reduced.

Furthermore, in the fuse device 1, by bending the terminals 30 of the fuse element 5 multiple times, locations facing the circuit substrate are a flat surface, and connection stability with the circuit substrate can be improved.

Although the fuse device 1 is configured so that the fuse element 5 is bent multiple times, as described above, because bending processes of a fuse element as a flat plate can be easily accomplished with a press process using a jig, manufacturing productivity can be improved.

It should be noted that, as illustrated in FIG. 30, a heat-generator-integrated fuse device can be easily formed by providing a heat generator in the recessed portion 2*e* of the insulating substrate 2.

Eleventh Embodiment

Heat-Generator-Integrated Fuse Device

Next, another configuration example of a heat-generator-integrated fuse device will be described; however, parts having the same function as in the configuration of the fuse device 1 of the first embodiment are assigned the same reference signs and a description thereof is omitted.

In particular, as illustrated in FIGS. 31 to 35, a heat-generator-integrated fuse device 100 comprises, an insulating substrate 2, a heat generator 14 covered by an insulating member 15 and laminated on the insulating substrate 2, a heat generator lead electrode 16 laminated on the insulating member 15 to overlap with the heat generator 14, first and second electrodes 3, 4, a fuse element 5 mounted between the first and second electrodes 3, 4, connected to the heat generator lead electrode 16 in a central portion, and which blows out due to self-generated heat or heating of the heat generator 14 when a rating-exceeding current flows to interrupt a current path between the first and second electrodes 3, 4, a plurality of flux 17 provided on the fuse element 5 for removing oxide film generated on the fuse element 5 to improve wetting properties, and a cover member 20 as a housing for covering the fuse element 5.

Figure 31:
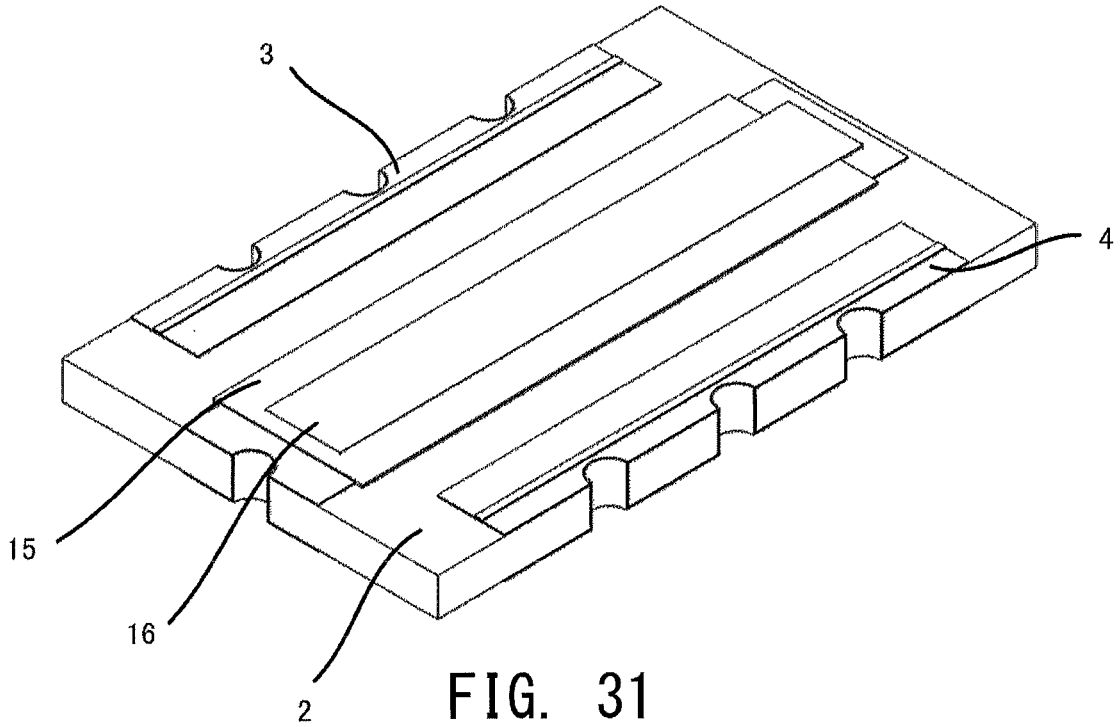
FIG. 31 is a perspective view illustrating a manufacturing process of a heat-generator-integrated fuse device according to an eleventh embodiment.
Figure 32:
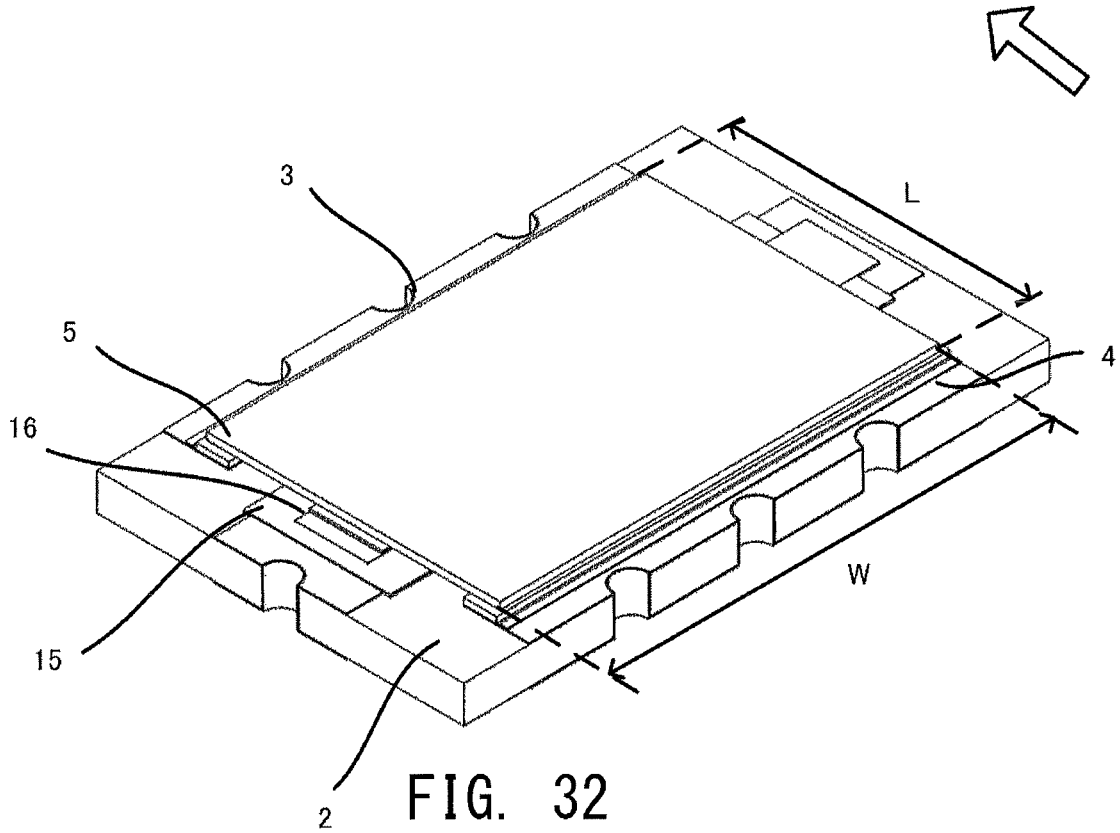
FIG. 32 is a perspective view illustrating a manufacturing process of a heat-generator-integrated fuse device according to an eleventh embodiment.
Figure 33:
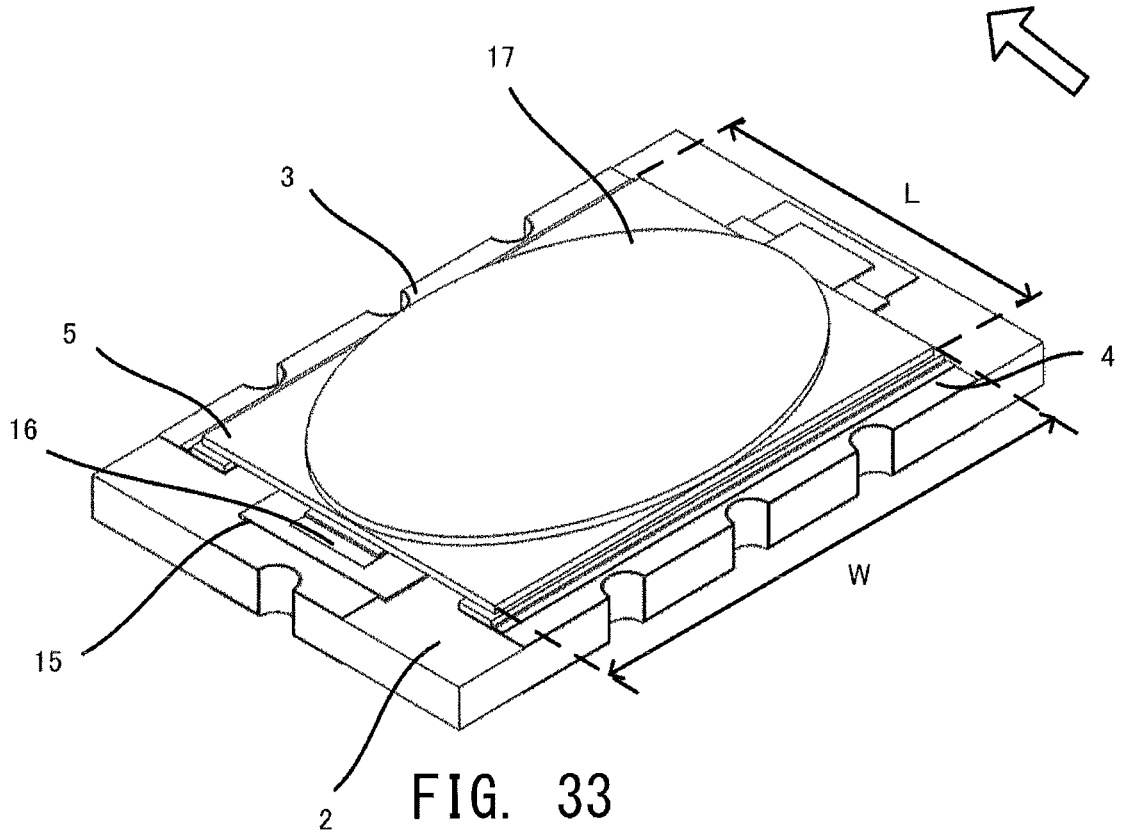
FIG. 33 is a perspective view illustrating a manufacturing process of a heat-generator-integrated fuse device according to an eleventh embodiment.
Figure 34:
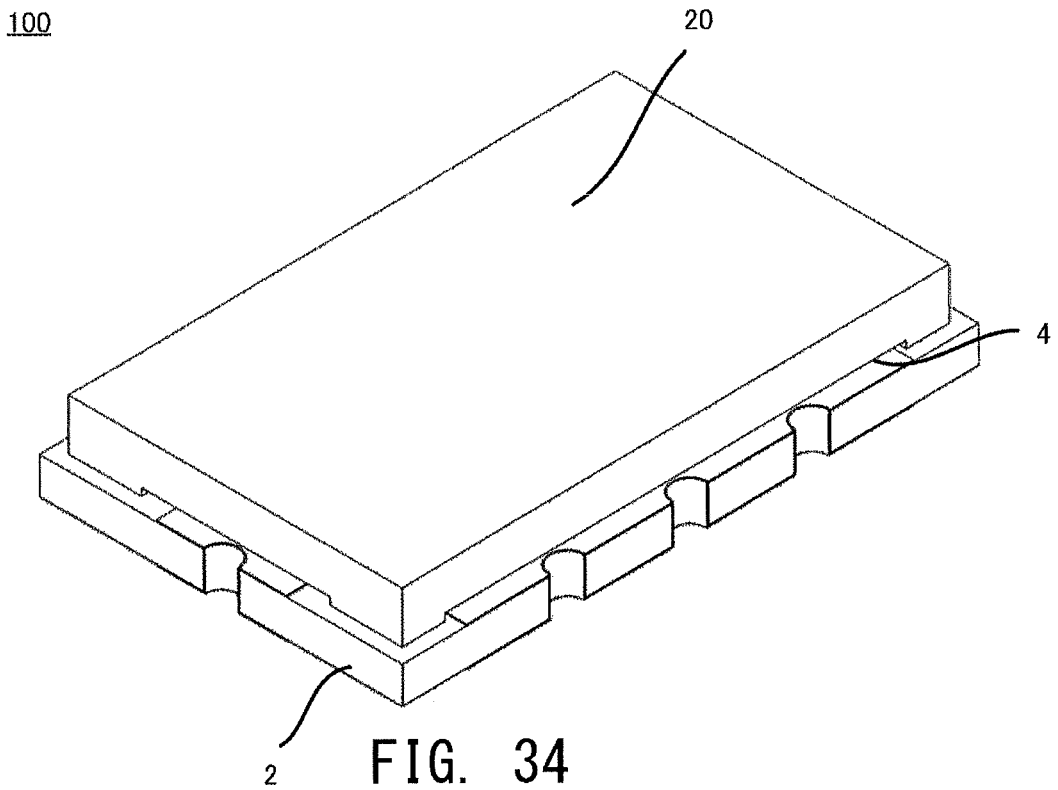
FIG. 34 is a perspective view illustrating a heat-generator-integrated fuse device according to an eleventh embodiment as viewed from a front-surface side.
Figure 35:
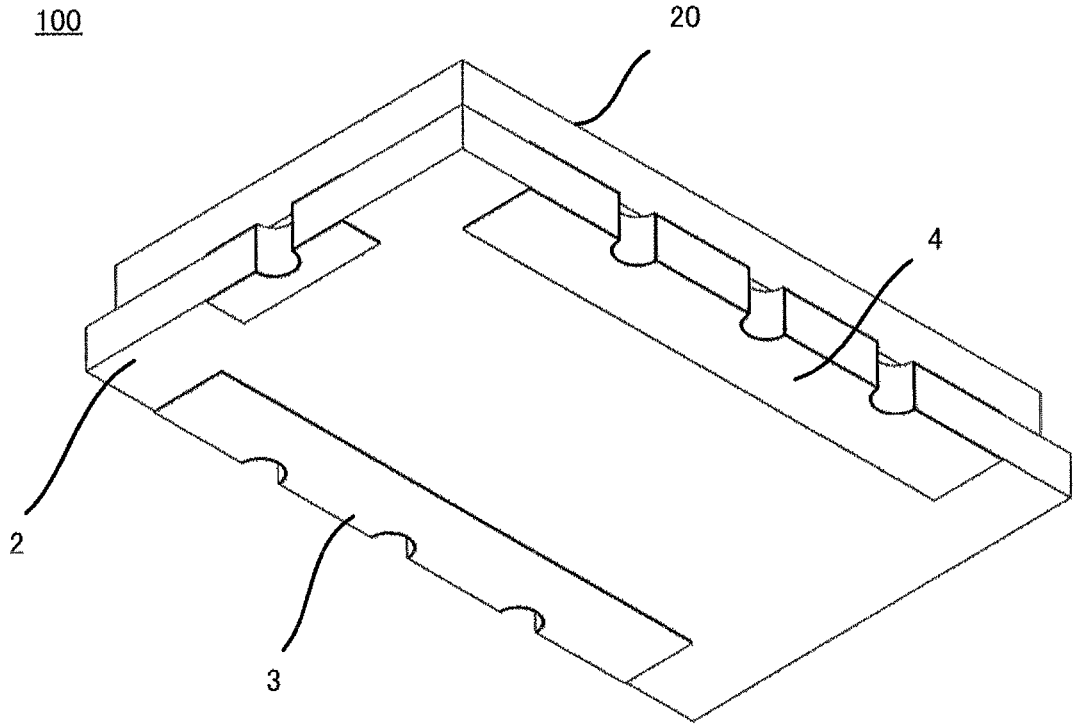
FIG. 35 is a perspective view illustrating a heat-generator-integrated fuse device according to an eleventh embodiment as viewed from a back-surface side.

FIG. 31 illustrates a state before the fuse element 5 is mounted on the insulating substrate 2, FIG. 32 illustrates a state in which the fuse element 5 is mounted on the insulating substrate 2, FIG. 33 illustrates a state in which the flux 17 is applied onto the fuse element 5, and FIG. 34 illustrates a state in which the cover member 20 is placed after applying the flux 17. That is, FIGS. 31 to 34 are views illustrating manufacturing processes of the heat-generator-integrated fuse device 100 in order. It should be noted that FIG. 35 is a view illustrating a back surface of the heat-generator-integrated fuse device 100.

The fuse element 5 has a laminated structure in an approximately rectangular plate shape and has a wide structure in which the length W in the width direction is greater than the total length L in the conduction direction.

The heat generator 14 generates heat when an electric current is supplied, and can heat the fuse element 5.

Thus, in the heat-generator-integrated fuse device 100, even in the case of an abnormal current exceeding the rated current not flowing through the fuse element 5, by supplying current to the heat generator 14 to heat the fuse element 5, it is possible to blow out the fuse element 5 under desired conditions.

It should be noted that in the heat-generator-integrated fuse device 100, the first and second electrodes 3, 4 connecting the front surface 2*a* and the back surface 2*b* of the insulating substrate 2 ensure conduction between the front and back surfaces of the insulating substrate 2 through vias and form a current path for the fuse element 5.

Figure 36:
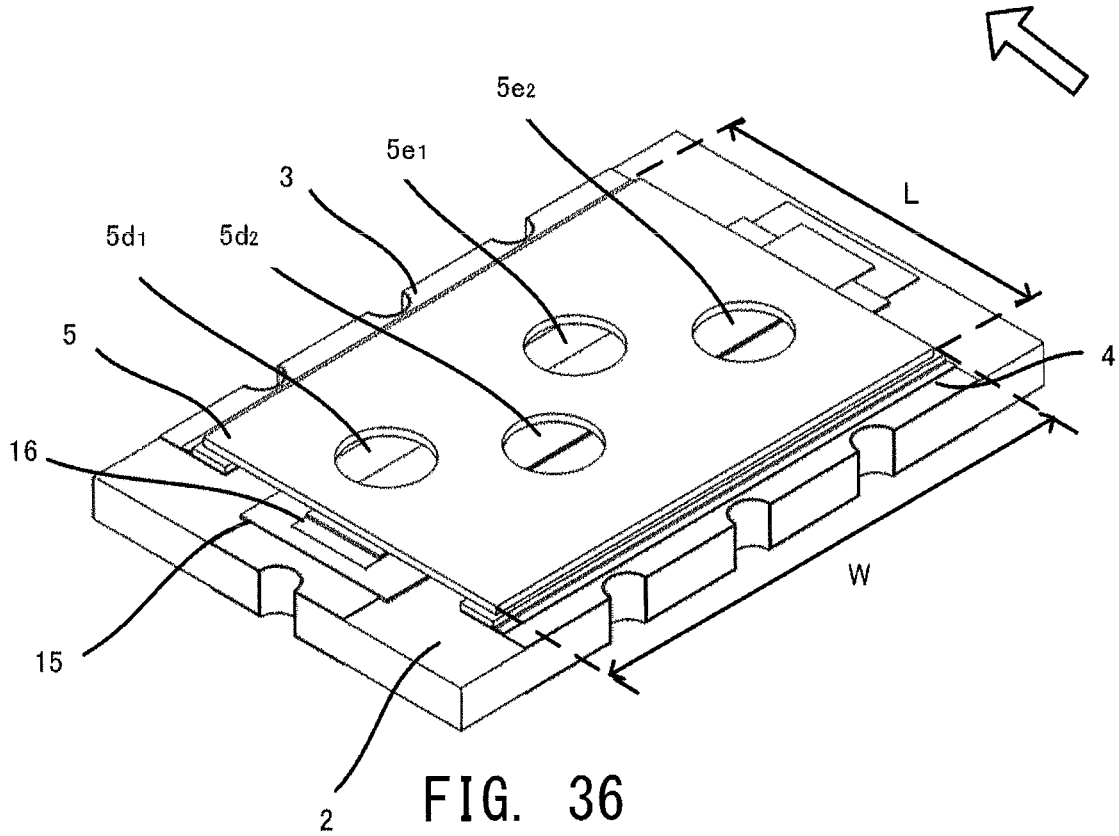
FIG. 36 is a perspective view illustrating an example in which a fuse element of a heat-generator-integrated fuse device according to an eleventh embodiment is modified.
Figure 37:
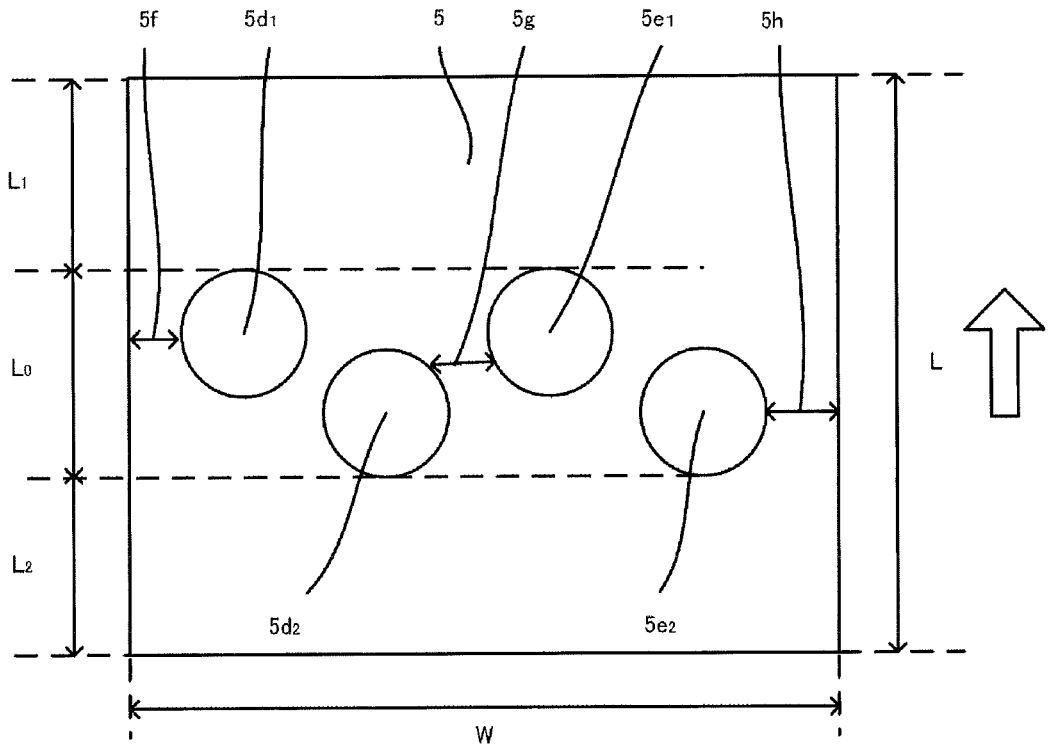
FIG. 37 is a plan view illustrating an example in which a fuse element of a heat-generator-integrated fuse device according to an eleventh embodiment is modified.

It should also be noted that, as illustrated in FIGS. 36 and 37, the fuse element 5 may be provided with through holes 5*d*1, 5*e*1 and through holes 5*d*2, 5*e*2.

In particular, the fuse element 5 has through holes 5*d*1, 5*e*1 and through holes 5*d*2, 5*e*3 which are circular in shape and arranged in alignment in the width direction of the fuse element 5 in a middle portion in the conduction direction. The through holes 5*d*1, 5*e*1 and the through holes 5*d*2, 5*e*2 are respectively provided at a predetermined interval in the conduction direction of the fuse element 5. The through holes 5*d*1, 5*d*2 are aligned with centers offset with respect to the conduction direction, and the through holes 5*e*1, 5*e*2 are also aligned with centers offset with respect to the conduction direction. In particular, in the fuse element 5, the through holes 5*d*1, 5*d*2 and the through holes 5*e*1, 5*e*2 are each aligned so as not to overlap in the conduction direction.

Through Holes

Next, the positions and size of the through holes 5*d*1, 5*e*1 and the through holes 5*d*2, 5*e*2 of the fuse element 5 will be described. Vicinities near the through holes 5*d*1, 5*e*1 and the through holes 5*d*2, 5*e*2 are blown out first as described above, and, in order to adjust the blowout position, it is particularly preferable that these vicinities are located in a central vicinity with respect to the length L in the conduction direction. In other words, in order to interrupt the circuit between the first and second electrodes 3, 4, it is preferable to select a central vicinity between the first and second electrodes 3, 4.

In particular, the through holes 5*d*1, 5*e*1 and the through holes 5*d*2, 5*e*2 are preferably located at positions separated from end portions in the conduction direction of the fuse element 5 by L1 and L2, respectively. More particularly, respective lengths of L1 and L2 are such that $L/4<L1$ and $L/4<L2$. While the current path of the fuse element 5 is divided into a plurality of parts, volume of the element, which has a predetermined heat capacity, is thus ensured in the vicinity of the first and second electrodes 3, 4. It is preferable to position the through holes 5*d*1, 5*e*1, 5*d*2, 5*e*2 as a bridge from the end portion of the heat generator lead electrode 16, that is, extending towards a terminal 30 side.

Furthermore, size of the through holes 5*d*1, 5*d*2 is preferably selected so that $L/2>L0$, wherein L0 is maximum length including the through holes 5*d*1, 5*d*2 in the conduction direction, with respect to the total length L of the current path of the fuse element 5. If a larger size is selected, the through holes 5*d*1, 5*d*2 might extend to portions corresponding to the first and second electrodes 3, 4. Because size of the through holes 5*e*1, 5*e*2 can be defined in the same manner as for the through holes 5*d*1, 5*d*2, a description thereof is omitted.

The fuse element 5 has a narrow-width portion 5*g* between the through holes 5*d*2, 5*e*1, a narrow-width portion 5*f* on the outer side in the width direction of the fuse element 5 of the through hole 5*d*1, and a narrow-width portion 5*h* on the outer side in the width direction of the fuse element 5 of the through hole 5*e*2.

Such a fuse element 5 configured as described above in which a plurality of narrow-width portions are provided in the conduction direction of the fuse element 5, in comparison with the first embodiment which has only one row arranged in alignment, can more precisely control blowout positions at a plurality of locations of the fuse element 5.

Twelfth Embodiment

Heat-Generator-Integrated Fuse Device

Next, another configuration example of a heat-generator-integrated fuse device will be described; however, parts having the same function as in the configuration of the fuse device 1 of the first embodiment are assigned the same reference signs and a description thereof is omitted.

In particular, as illustrated in FIGS. 38 to 41, a heat-generator-integrated fuse device 100 comprises, an insulating substrate 2, a heat generator 14 covered by an insulating member 15 and laminated on the insulating substrate 2, a heat generator lead electrode 16 laminated on the insulating member 15 to overlap with the heat generator 14, a fuse element 5 connected to the heat generator lead electrode 16 in a central portion, which has terminals 30 disposed on both end portions in the conduction direction, and which blows out due to self-generated heat or heating of the heat generator 14 when a rating-exceeding current flows between the terminals 30 to interrupt a current path, a plurality of flux 17 provided on the fuse element 5 for removing oxide film generated on the fuse element 5 to improve wetting properties, and a cover member 20 as a housing for covering the fuse element 5.

Figure 38:
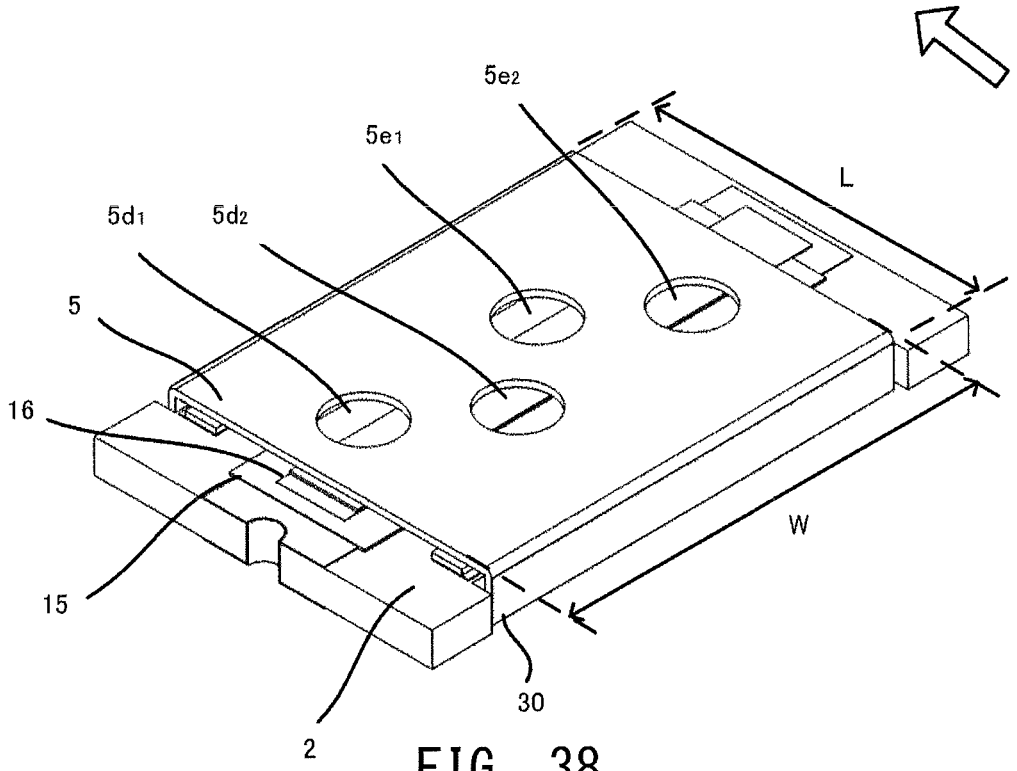
FIG. 38 is a perspective view illustrating a manufacturing process of a heat-generator-integrated fuse device according to a twelfth embodiment.
Figure 39:
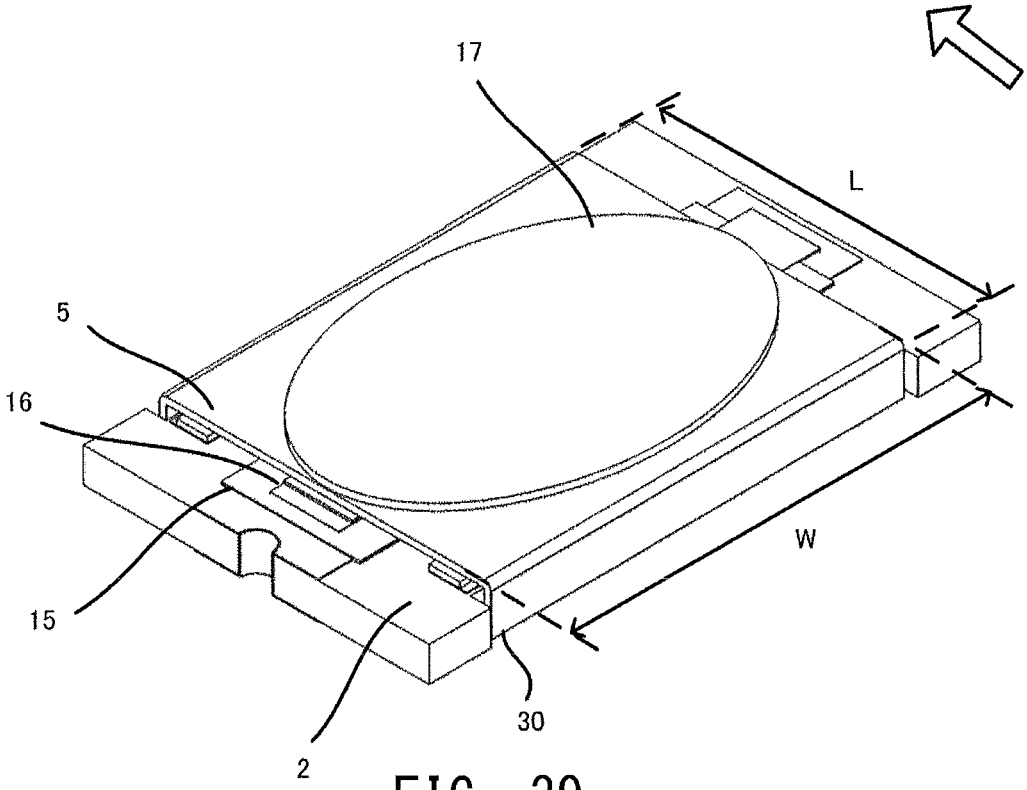
FIG. 39 is a perspective view illustrating a manufacturing process of a heat-generator-integrated fuse device according to a twelfth embodiment.
Figure 40:
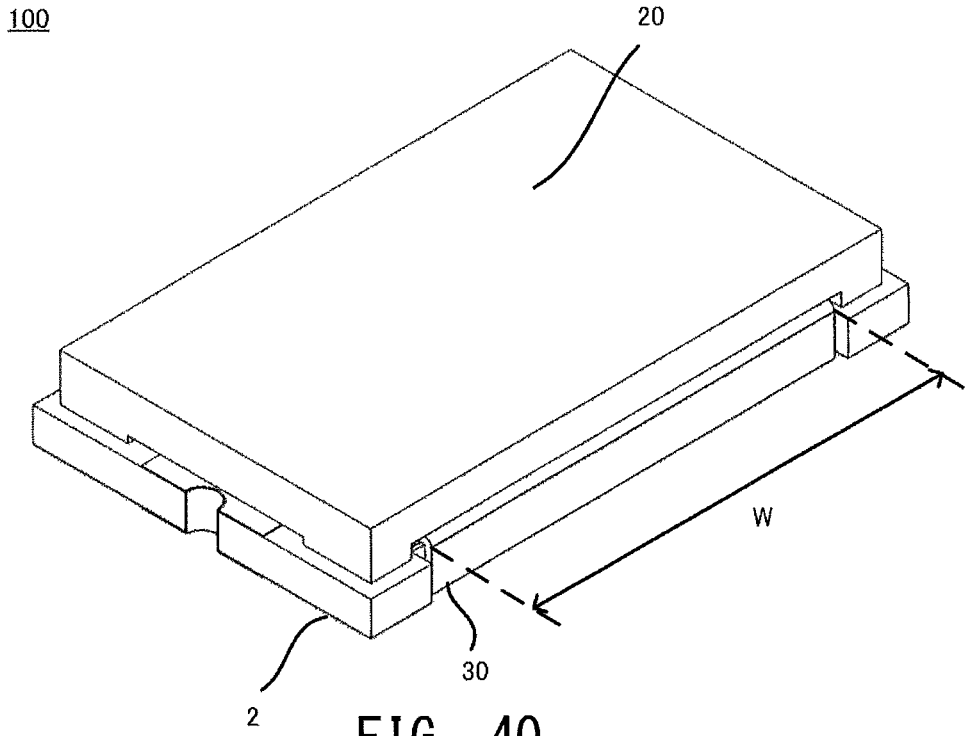
FIG. 40 is a perspective view illustrating a heat-generator-integrated fuse device according to a twelfth embodiment as viewed from a front-surface side.
Figure 41:
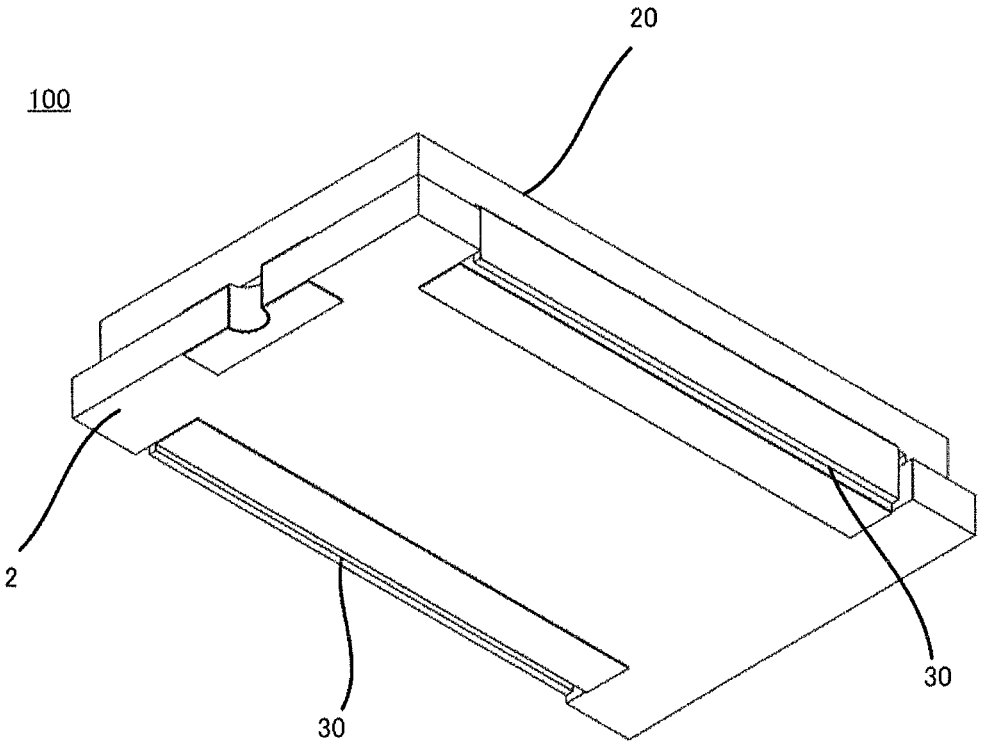
FIG. 41 is a perspective view illustrating a heat-generator-integrated fuse device according to a twelfth embodiment as viewed from a back-surface side.

FIG. 38 illustrates a state in which the fuse element 5 is mounted on the insulating substrate 2, FIG. 39 illustrates a state in which the flux 17 is applied onto the fuse element 5, and FIG. 40 illustrates a state in which the cover member 20 is placed after applying the flux 17. That is, FIGS. 38 to 41 are views illustrating manufacturing processes of the heat-generator-integrated fuse device 100 in order. Additionally, FIG. 41 is a view illustrating a back surface of the heat-generator-integrated fuse device 100. It should be noted that because a state before the fuse element 5 is mounted on the insulating substrate 2 is the same as illustrated in FIG. 31, an additional illustration thereof is omitted.

The fuse element 5 has a laminated structure in an approximately rectangular plate shape and has a wide structure in which the length W in the width direction is greater than the total length L in the conduction direction. It should be noted that because the total length L and the width W are equivalent to those in FIG. 37, an additional illustration thereof is omitted.

Both end portions in the conduction direction of the fuse element 5 are bent by 90 degrees towards the circuit substrate side and the end surfaces thereof serve as the terminals 30.

When the heat-generator-integrated fuse device 100 incorporating the fuse element 5 is mounted on the circuit substrate, the terminals 30 are directly connected to a connection terminal formed on the circuit substrate and are formed on both end portions in the conduction direction. As illustrated in FIGS. 40 and 41, the fuse device 1 is mounted on the circuit substrate, so that the terminals 30 are connected to connection terminals formed on the circuit substrate, for example, via solder.

The heat-generator-integrated fuse device 100 is electrically connected to the circuit substrate via the terminals 30 formed in the fuse element 5 enabling resistance value reductions for the entire device as well as size reductions and rating increases. Thus, in the heat-generator-integrated fuse device 100, high resistances caused by interposing conductive vias can be avoided and ratings can be determined by the fuse element 5, allowing size reductions and ratings increases.

Furthermore, as illustrated in FIG. 38, the fuse element 5 is provided with through holes **5*d*1, 5*e*1 and through holes 5*d*2, 5*e*2. Because positions of the through holes 5*d*1, 5*e*1 and the through holes 5*d*2, 5*e*2 are substantially the same as those in FIG. 37**, an additional illustration thereof is omitted.

Particularly, the fuse element 5 has through holes **5*d*1, 5*e*1 and through holes 5*d*2, 5*e*2 which are circular in shape and arranged in alignment in the width direction of the fuse element 5 in a middle portion in the conduction direction. The through holes 5*d*1, 5*e*1 and the through holes 5*d*2, 5*e*2 are respectively provided at a predetermined interval in the conduction direction of the fuse element 5. The through holes 5*d*1, 5*d*2 are aligned with centers offset with respect to the conduction direction, and the through holes 5*e*1, 5*e*2 are also aligned with centers offset with respect to the conduction direction. In particular, in the fuse element 5, the through holes 5*d*1, 5*d*2 and the through holes 5*e*1, 5*e*2** are each aligned so as not to overlap in the conduction direction.

Through Holes

Next, the positions and size of the through holes **5*d*1, 5*e*1 and the through holes 5*d*2, 5*e*2 of the fuse element 5 will be described. Vicinities near the through holes 5*d*1, 5*e*1 and the through holes 5*d*2, 5*e*2 are blown out first as described above, and, in order to adjust the blowout position, it is particularly preferable that these vicinities are located in a central vicinity with respect to the length L in the conduction direction. In other words, in order to interrupt the circuit between the terminals 30, it is preferable to select a central vicinity between the terminals 30**.

In particular, the through holes **5*d*1, 5*e*1 and the through holes 5*d*2, 5*e*2 are preferably located at positions separated from end portions in the conduction direction of the fuse element 5 by L1 and L2, respectively. More particularly, respective lengths of L1 and L2 are such that $L/4<L1$ and $L/4<L2$. While the current path of the fuse element 5 is divided into a plurality of parts, volume of the element, which has a predetermined heat capacity, is thus ensured in the vicinity of the first and second electrodes 3, 4. It is preferable to position the through holes 5*d*1, 5*e*1, 5*d*2, 5*e*2 as a bridge from the end portion of the heat generator lead electrode 16, that is, extending towards a terminal 30** side.

Furthermore, size of the through holes **5*d*1, 5*d*2 is preferably selected so that $L/2>L0$, wherein L0 is maximum length including the through holes 5*d*1, 5*d*2 in the conduction direction, with respect to the total length L of the current path of the fuse element 5. If a larger size is selected, the through holes 5*d*1, 5*d*2 might extend to the bent portions. Because size of the through holes 5*e*1, 5*e*2 can be defined in the same manner as for the through holes 5*d*1, 5*d*2**, a description thereof is omitted.

The fuse element 5 has a narrow-width portion **5*g* between the through holes 5*d*2, 5*e*1, a narrow-width portion 5*f* on the outer side in the width direction of the fuse element 5 of the through hole 5*d*1, and a narrow-width portion 5*h* on the outer side in the width direction of the fuse element 5 of the through hole 5*e*2. It should be noted that because the narrow-width portions are substantially similar to those in FIG. 37**, an additional illustration thereof is omitted.

Such a fuse element 5 configured as described above in which a plurality of narrow-width portions are provided in the conduction direction of the fuse element 5, in comparison with the first embodiment which has only one row arranged in alignment, can more precisely control blowout positions at a plurality of locations of the fuse element 5.

The heat generator 14 can generate heat by being supplied with current from an electrode not illustrated in the drawings to heat the fuse element 5.

Thus, in the heat-generator-integrated fuse device 100, even in the case of an abnormal current exceeding the rated current not flowing through the fuse element 5, by supplying current to the heat generator 14 to heat the fuse element 5, it is possible to blow out the fuse element 5 under desired conditions.

Thirteenth Embodiment

Heat-Generator-Integrated Fuse Device

Next, another configuration example of a heat-generator-integrated fuse device will be described; however, parts having the same function as in the configuration of the fuse device 1 of the first embodiment are assigned the same reference signs and a description thereof is omitted. The fuse device in this embodiment is an example of a flip-chip type heat-generator-integrated fuse device.

Figure 42:
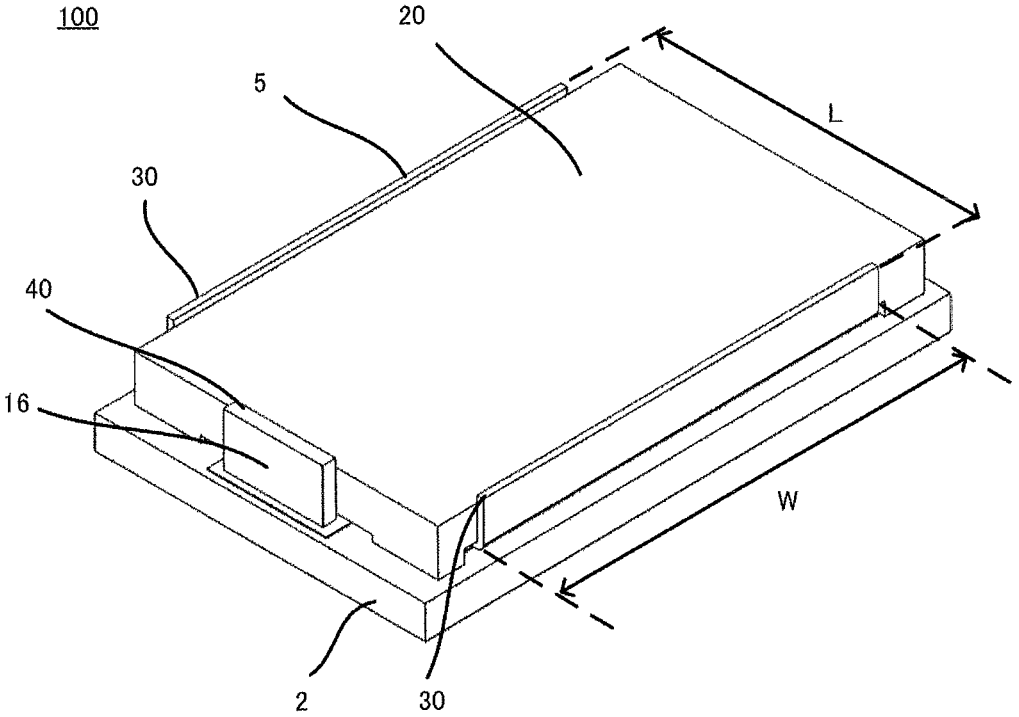
FIG. 42 is a perspective view illustrating a flip-chip type heat-generator-integrated fuse device according to a thirteenth embodiment as viewed from a front-surface side.
Figure 43:
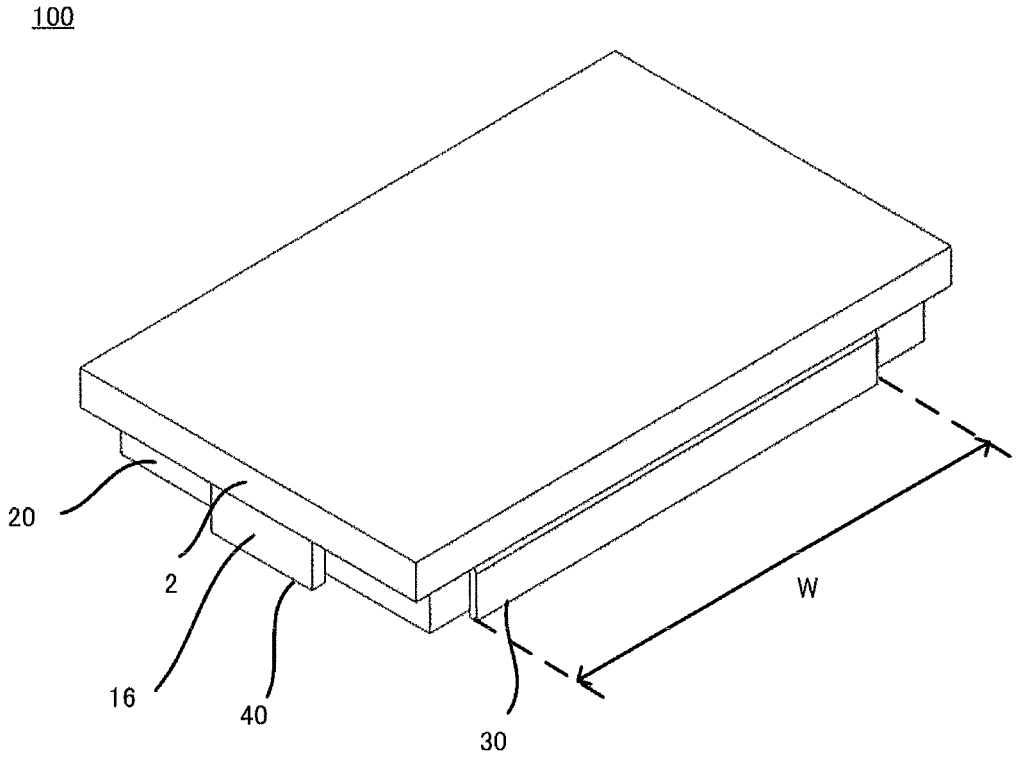
FIG. 43 is a perspective view illustrating a flip-chip type heat-generator-integrated fuse device according to a thirteenth embodiment as viewed from a back-surface side.

In particular, as illustrated in FIGS. 42 to 43, a heat-generator-integrated fuse device 100 comprises, an insulating substrate 2, a heat generator covered by an insulating member and laminated on the insulating substrate 2, a heat generator lead electrode 16 laminated on the insulating member to overlap with the heat generator, a fuse element 5 which is connected to the heat generator lead electrode in a central portion, which has terminals 30 disposed on both end portions in the conduction direction, and which blows out due to self-generated heat or heating of the heat generator to interrupt a current path when a rating-exceeding current flows between the terminals 30, a flux 17 provided on the fuse element 5 for removing oxide film generated on the fuse element 5 to improve wetting properties, and a cover member 20 as a housing for covering the fuse element 5.

FIG. 42 is a view illustrating a front surface of the heat-generator-integrated fuse device 100 and FIG. 43 is a view illustrating a back surface of the heat-generator-integrated fuse device 100. Because details of the internal structure are substantially similar to that of the twelfth embodiment, additional illustration and description thereof are omitted.

The fuse element 5 has a laminated structure in an approximately rectangular plate shape and has a wide structure in which the length W in the width direction is greater than the total length L in the conduction direction.

Both end portions in the conduction direction of the fuse element 5 are bent by 90 degrees towards the circuit substrate side and the end surfaces thereof serve as the terminals 30. The heat-generator-integrated fuse device 100 according to the present embodiment is of a flip-chip type; therefore, orientation is different and the mounting direction toward the circuit substrate is opposite (face down) to that of the other embodiments. Therefore, in the fuse element 5, the end surfaces are bent to face upwards in the direction perpendicular to the insulating substrate 2. The heat generator lead electrode 16 also has terminals 40 to secure a connection path in a direction perpendicular to the insulating substrate 2.

When the heat-generator-integrated fuse device 100 incorporating the fuse element 5 is mounted on the circuit substrate, the terminals 30 are directly connected to a connection terminal formed on the circuit substrate and are formed on both end portions in the conduction direction. As illustrated in FIG. 43, the fuse device 1 is mounted face down on the circuit substrate, so that the terminals 30 are connected to connection terminals formed on the circuit substrate, for example, via solder. Also, the terminals 40 are similarly mounted on the circuit substrate in a face-down manner.

The heat-generator-integrated fuse device 100 is electrically connected to the circuit substrate via the terminals 30 formed in the fuse element 5 enabling resistance value reductions for the entire device as well as size reductions and rating increases. Thus, in the heat-generator-integrated fuse device 100, high resistances caused by interposing conductive vias can be avoided and ratings can be determined by the fuse element 5, allowing size reductions and ratings increases.

Fourteenth Embodiment

Fuse Device

Next, another configuration example of a face-down type fuse device will be described; however, the same reference signs are assigned to parts having the same function as the structure of the fuse device 1 of the first embodiment, and a description thereof is omitted.

In particular, as illustrated in FIGS. 44 to 47, a fuse device 1 comprises, an insulating substrate 2, a fuse element 5 laminated on the insulating substrate 2, which has terminals 30 disposed on both end portions in the conduction direction, and which blows out due to self-generated heat when a rating-exceeding current flows between the terminals 30 to interrupt a current path, a plurality of flux 17 provided on the fuse element 5 for removing oxide film generated on the fuse element 5 to improve wetting properties, and a cover member 20 as a housing for covering the fuse element 5.

Figure 44:
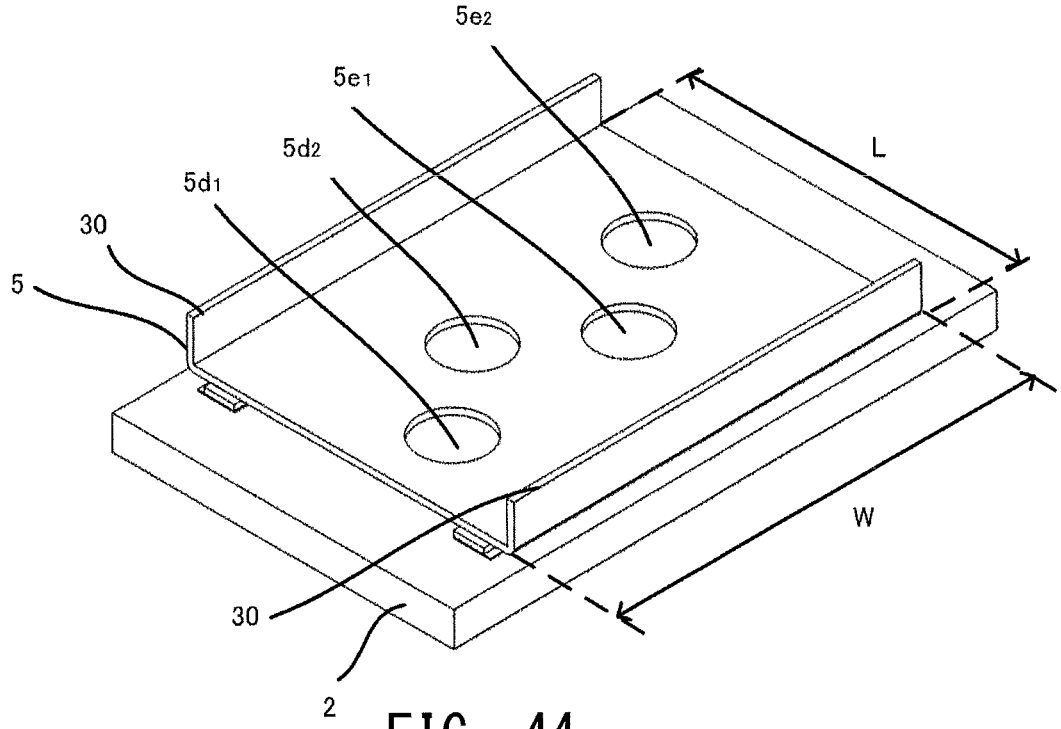
FIG. 44 is a perspective view illustrating a manufacturing process of a flip-chip type fuse device according to a fourteenth embodiment.
Figure 45:
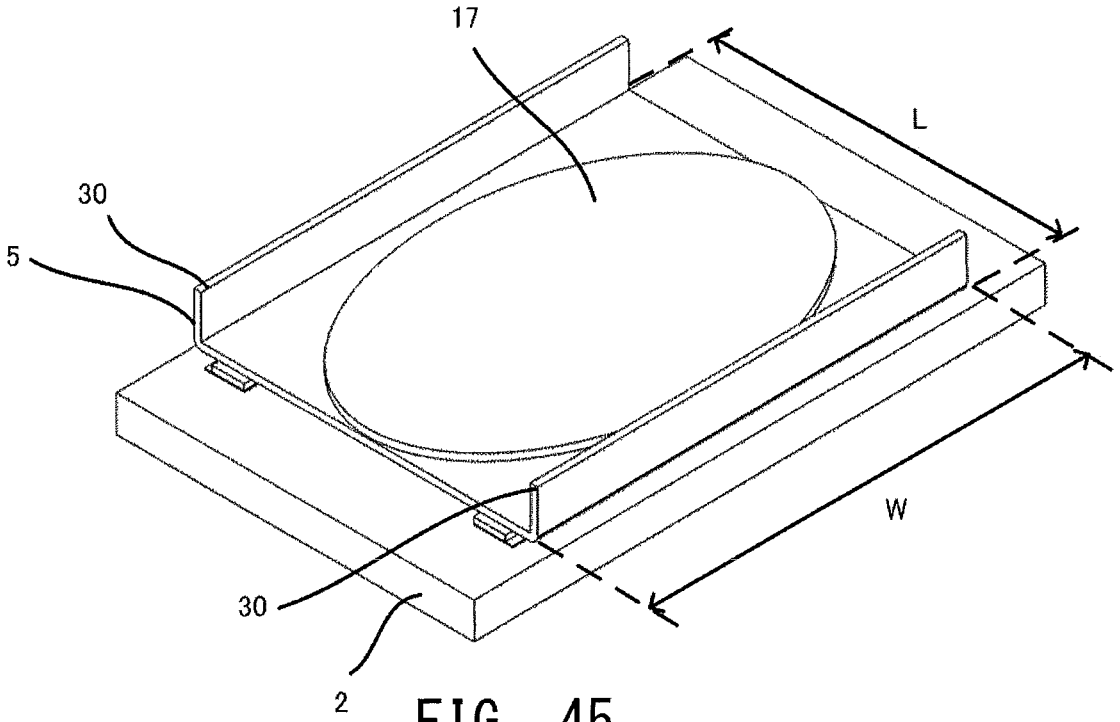
FIG. 45 is a perspective view illustrating a manufacturing process of a flip-chip type fuse device according to a fourteenth embodiment.
Figure 46:
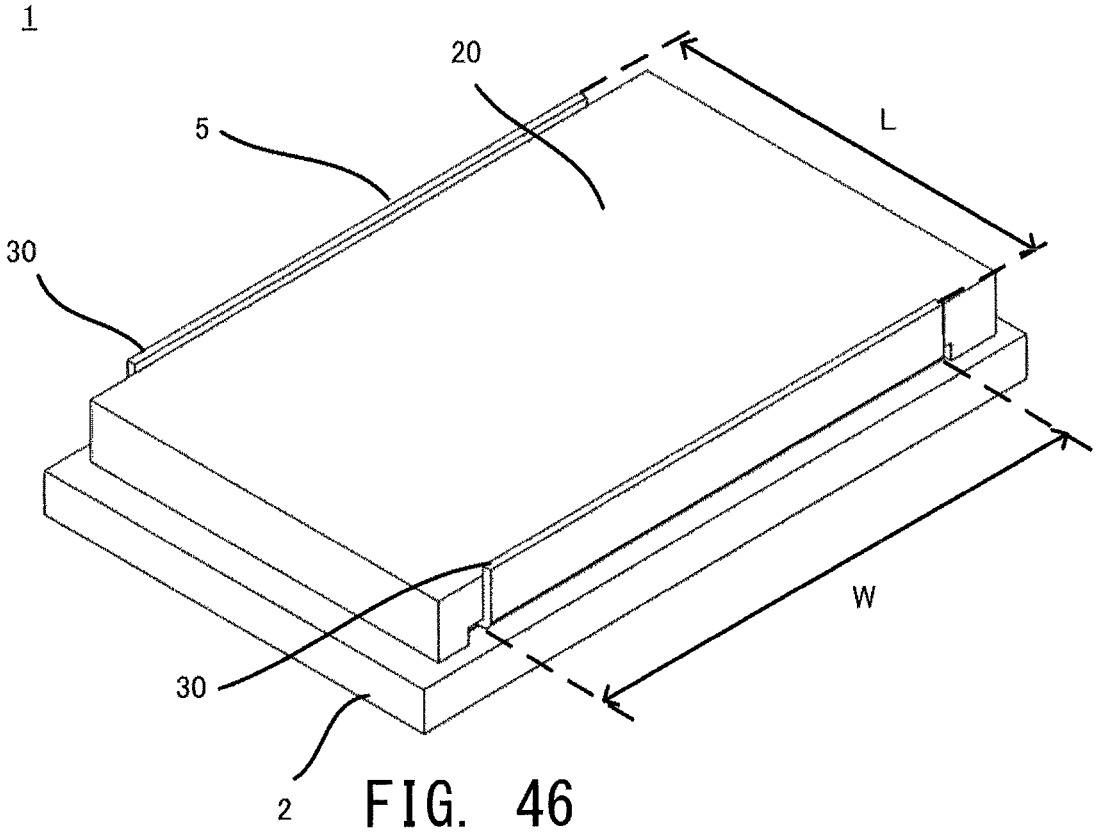
FIG. 46 is a perspective view illustrating a flip-chip type fuse device according to a fourteenth embodiment as viewed from a front-surface side.
Figure 47:
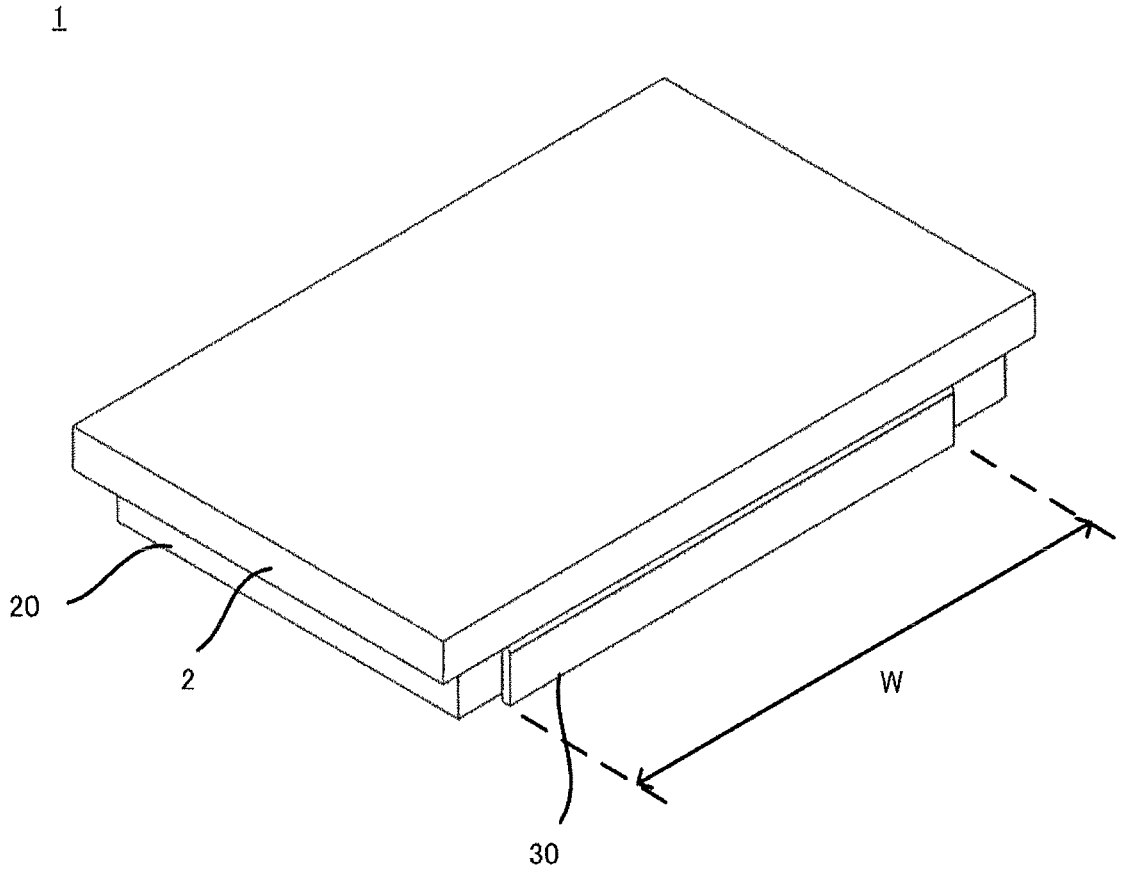
FIG. 47 is a perspective view illustrating a flip-chip type fuse device according to a fourteenth embodiment as viewed from a back-surface side.

FIG. 44 illustrates a state in which the fuse element 5 is mounted on the insulating substrate 2, FIG. 45 illustrates a state in which the flux 17 is applied onto the fuse element 5, and FIG. 46 illustrates a state in which the cover member 20 is placed after applying the flux 17. That is, FIGS. 44 to 46 are views illustrating manufacturing processes of the fuse device 1 in order. FIG. 47 is a view illustrating a back surface of the heat-generator-integrated fuse device 100.

The fuse element 5 has a laminated structure in an approximately rectangular plate shape and has a wide structure in which the length W in the width direction is greater than the total length L in the conduction direction. It should be noted that because the total length L and the width W are equivalent to those in FIG. 37, an additional illustration thereof is omitted.

Both end portions in the conduction direction of the fuse element 5 are bent by 90 degrees towards the circuit substrate side and the end surfaces thereof serve as the terminals 30.

When the fuse device 1 incorporating the fuse element 5 is mounted on the circuit substrate, the terminals 30 are directly connected to a connection terminal formed on the circuit substrate and are formed on both end portions in the conduction direction. As illustrated in FIG. 47, the fuse device 1 is mounted face down on the circuit substrate, so that the terminals 30 are connected to connection terminals formed on the circuit substrate, for example, via solder.

The fuse device 1 is electrically connected to the circuit substrate via the terminals 30 formed in the fuse element 5 enabling resistance value reductions for the entire device as well as size reductions and rating increases. Thus, in the fuse device 1, high resistances caused by interposing conductive vias can be avoided and ratings can be determined by the fuse element 5, allowing size reductions and ratings increases.

Furthermore, as illustrated in FIG. 43, the fuse element 5 is provided with through holes **5*d*1, 5*e*1 and through holes 5*d*2, 5*e*2. Alternatively, recesses may be used instead of through holes. Because positions of the through holes 5*d*1, 5*e*1 and the through holes 5*d*2, 5*e*2 are substantially the same as those in FIG. 37**, an additional illustration thereof is omitted.

Particularly, the fuse element 5 has through holes **5*d*1, 5*e*1 and through holes 5*d*2, 5*e*2 which are circular in shape and arranged in alignment in the width direction of the fuse element 5 in a middle portion in the conduction direction. The through holes 5*d*1, 5*e*1 and the through holes 5*d*2, 5*e*2 are respectively provided at a predetermined interval in the conduction direction of the fuse element 5. The through holes 5*d*1, 5*d*2 are aligned with centers offset with respect to the conduction direction, and the through holes 5*e*1, 5*e*2 are also aligned with centers offset with respect to the conduction direction. In particular, in the fuse element 5, the through holes 5*d*1, 5*d*2 and the through holes 5*e*1, 5*e*2** are each aligned so as not to overlap in the conduction direction.

Through Holes

Next, the positions and size of the through holes 5*d*1, 5*e*1 and the through holes 5*d*2, 5*e*2 of the fuse element 5 will be described. Vicinities near the through holes 5*d*1, 5*e*1 and the through holes 5*d*2, 5*e*2 are blown out first as described above, and, in order to adjust the blowout position, it is particularly preferable that these vicinities are located in a central vicinity with respect to the length L in the conduction direction. In other words, in order to interrupt the circuit between the terminals 30, it is preferable to select a central vicinity between the terminals 30.

In particular, the through holes 5*d*1, 5*e*1 and the through holes 5*d*2, 5*e*2 are preferably located at positions separated from end portions in the conduction direction of the fuse element 5 by L1 and L2, respectively. More particularly, respective lengths of L1 and L2 are such that L/4<L1 and L/4<L2. While the current path of the fuse element 5 is divided into a plurality of parts, volume of the element, which has a predetermined heat capacity, is thus ensured in the vicinity of the first and second electrodes 3, 4.

Furthermore, size of the through holes 5*d*1, 5*d*2 is preferably selected so that L/2>L0, wherein L0 is maximum length including the through holes 5*d*1, 5*d*2 in the conduction direction, with respect to the total length L of the current path of the fuse element 5. If a larger size is selected, the through holes 5*d*1, 5*d*2 might extend to the bent portions. Because size of the through holes 5*e*1, 5*e*2 can be defined in the same manner as for the through holes 5*d*1, 5*d*2, a description thereof is omitted.

The fuse element 5 has a narrow-width portion 5*g* between the through holes 5*d*2, 5*e*1, a narrow-width portion 5*f* on the outer side in the width direction of the fuse element 5 of the through hole 5*d*1, and a narrow-width portion 5*h* on the outer side in the width direction of the fuse element 5 of the through hole 5*e*2. It should be noted that because the narrow-width portions are substantially similar to those in FIG. 37, an additional illustration thereof is omitted.

Such a fuse element 5 configured as described above in which a plurality of narrow-width portions are provided in the conduction direction of the fuse element 5, in comparison with the first embodiment which has only one row arranged in alignment, can more precisely control blowout positions at a plurality of locations of the fuse element 5.

CONCLUSION

As described above, the fuse element in each embodiment of the present invention has a wide structure in which the length W in the width direction is greater than the total length L in the conduction direction and, in particular, by having a laminated structure of a low melting point metal layer and a high melting point metal layer, it is possible to provide a fuse device or a heat-generator-integrated fuse device with a simple structure which is capable of size reductions and increased current ratings.

Furthermore, by providing a through hole or a recess in the fuse element, explosive melting of the fuse element can be suppressed and allows provision of a fuse device and heat-generator-integrated fuse device which is highly reliable in maintaining electrical insulation after blowout of the fuse element.

It should be noted that the number and type of the through holes or recesses provided in the fuse element can be selected as appropriate, and the structure described in each embodiment, including those in which the terminals are present or absent, can be used as appropriate in combination.

Furthermore, the fuse element of each embodiment of the present invention can be applied to all of heat-generator-integrated fuse devices, and a size-reduced fuse device for surface mounting capable of handling increased current ratings can be easily obtained.

REFERENCE SIGNS LIST

1 fuse device, 2 insulating substrate, 2*a* front surface, 2*b* back surface, 3 first electrode, 4 second electrode, 5 fuse element, 5*a* low melting point metal layer, 5*b* high melting point metal layer, 5*e* to 5*d* through holes (recesses), 5*f* to 5*h* narrow-width portions, 6 protective layer, 7 antioxidation film, 8 bonding material, 10 protective member, 11 adhesive agent, 14 heat generator, 15 insulating member, 16 heat generator lead electrode, 20 cover member, 20*a* side wall, 20*b* top surface, 30 terminals, 40 terminals, 100 heat-generator-integrated fuse device

The invention claimed is:

1. A fuse element which constitutes a current path of a fuse device, the fuse element comprising:

a blowout portion comprising:

a low melting point metal layer having a film thickness of 30 μm or more; and a high melting point metal layer laminated on the low melting point metal layer, the high melting point metal layer having a film thickness of 3 μm or more, wherein a width (W) of the blowout portion in a width direction perpendicular to a conduction direction is greater than a total length (L) of the blowout portion in the conduction direction, the fuse element is connected between two electrodes on a circuit board and connected onto the electrodes by a solder at a reflow temperature of the solder, a melting point of the low melting point metal layer and a melting point of the solder are equal to or lower than 260° C., the low melting point metal layer and the solder are melted at the reflow temperature of the solder, and the fuse element is configured to blow out due to self-generated heat when a rating-exceeding current flows therethrough.

2. The fuse element according to claim 1, wherein the high melting point metal layer is provided above and below the low melting point metal layer.

3. The fuse element according to claim 2, wherein the high melting point metal layer is provided on both side surfaces in the conduction direction of the low melting point metal layer.

4. The fuse element according to claim 1, further comprising:

a recess or a through hole.

5. The fuse element according to claim 4, wherein a maximum length (L0) of the recess or the through hole in the conduction direction of the fuse element is less than ½ of the total length (L).

6. The fuse element according to claim 5, wherein the recess or the through hole is positioned so that distances L1 and L2 from the recess or the through hole to respective end portions in the conduction direction are such that L1 is greater than ¼ L and L2 is greater than ¼ L.

7. The fuse element according to claim 4, wherein a plurality of the recesses or the through holes are aligned in the width direction.

8. The fuse element according to claim 4, wherein the recess or the through hole is circular, rectangular, or rhombic.

9. The fuse element according to claim 1, wherein the low melting point metal layer comprises solder, and the high melting point metal layer comprises Ag, Cu, or an alloy containing Ag or Cu as a primary constituent.

10. The fuse element according to claim 1, wherein the low melting point metal layer has a volume greater than that of the high melting point metal layer.

11. The fuse element according to claim 1, wherein a film thickness ratio of the low melting point metal layer to the high melting point metal layer is from 2:1 to 100:1.

12. The fuse element according to claim 1, wherein the high melting point metal layer is formed by plating on a surface of the low melting point metal layer.

13. The fuse element according to claim 1, wherein the high melting point metal layer is formed by attaching a metal foil to a surface of the low melting point metal layer.

14. The fuse element according to claim 1, wherein the high melting point metal layer is formed by a thin-film deposition process onto a surface of the low melting point metal layer.

15. The fuse element according to claim 1, wherein an antioxidation film is further formed on a surface of the high melting point metal layer.

16. The fuse element according to claim 1, wherein the low melting point metal layer and the high melting point metal layer are alternately laminated in a plurality of layers.

17. The fuse element according to claim 1, wherein an outer circumference portion excluding two opposite end faces of the low melting point metal layer is covered with the high melting point metal layer.

18. The fuse element according to claim 1, wherein at least a part of an outer circumference is protected by a protective member.

19. The fuse element according to claim 4, further comprising:

a plurality of narrow-width portions arranged in alignment by the recess or the through hole, wherein the plurality of narrow-width portions blow out due to self-generated heat when the rating-exceeding current flows through the fuse element.

20. The fuse element according to claim 19, wherein the plurality of narrow-width portions blow out in a sequence.

21. The fuse element according to claim 19, wherein one of the narrow-width portions, in a part or entirety, has a cross-sectional area that is less than other narrow-width portions.

22. The fuse element according to claim 19, wherein three of the narrow-width portions are arranged in alignment, and the narrow-width portion in the center blows out last.

23. The fuse element according to claim 22, wherein the narrow-width portion in the center, in a part or entirety, has a cross-sectional area that is less than cross-sectional areas of the narrow-width portions on both sides.

24. The fuse element according to claim 1, further comprising:

a terminal serving as an external connection terminal of the fuse device.

25. The fuse element according to claim 1, wherein the fuse element has a thickness (t) that is 1/30 or less of the width (W).

26. The fuse element according to claim 25, wherein the thickness (t) of the fuse element is not more than 1/60 of the width (W).

27. A fuse device, comprising:

a fuse element which constitutes a current path and is configured to blow out due to self-generated heat when a rating-exceeding current flows therethrough, the fuse element comprising:

a blowout portion comprising:

a low melting point metal layer having a film thickness of 30 μm or more; and a high melting point metal layer laminated on the low melting point metal layer, the high melting point metal layer having a film thickness of 3 μm or more, wherein a width (W) of the blowout portion in a width direction perpendicular to a conduction direction is greater than a total length (L) of the blowout portion in the conduction direction, the fuse element is connected between first and second electrodes on an insulating substrate and connected onto the first and second electrodes by a solder at a reflow temperature of the solder, a melting point of the low melting point metal layer and a melting point of the solder are equal to or lower than 260° C., and the low melting point metal layer and the solder are melted at the reflow temperature of the solder.

28. The fuse device according to claim 27, wherein the high melting point metal layer is provided above and below the low melting point metal layer in the fuse element.

29. The fuse device according to claim 28, wherein the high melting point metal layer is provided on both side surfaces in the conduction direction of the low melting point metal layer.

30. The fuse device according to claim 27, wherein the fuse element has a recess or a through hole.

31. The fuse device according to claim 30, wherein a maximum length (L0) of the recess or the through hole in the conduction direction of the fuse element is less than ½ of the total length (L).

32. The fuse device according to claim 31, wherein the recess or the through hole is positioned so that distances L1 and L2 from the recess or the through hole to respective end portions in the conduction direction are such that L1 is greater than ¼ L and L2 is greater than ¼ L.

33. The fuse device according to claim 30, wherein a plurality of the recesses or the through holes are aligned in the width direction.

34. The fuse device according to claim 30, wherein the recess or through hole is circular, rectangular, or rhombic.

35. The fuse device according to claim 27, wherein the solder comprises Sn or has Sn as a primary constituent.

36. The fuse device according to claim 27, wherein the fuse element is connected to the first and second electrodes by ultrasonic welding.

37. The fuse device according to claim 27, wherein the fuse element is mounted to be separated from the insulating substrate.

38. The fuse device according to claim 27, wherein a surface of the fuse element is coated with a flux.

39. The fuse device according to claim 27, wherein a surface of the insulating substrate is covered with a cover member.

40. A fuse element which constitutes a current path of a fuse device, the fuse element comprising:

a blowout portion comprising a low melting point metal layer; and a terminal serving as an external connection terminal of the fuse device, wherein a width (W) of the blowout portion in a width direction perpendicular to a conduction direction is greater than a total length (L) of the blowout portion in the conduction direction, the fuse element is connected between two electrodes on a circuit board and connected onto the electrodes by a solder at a reflow temperature of the solder, a melting point of the low melting point metal layer and a melting point of the solder are equal to or lower than 260° C., the low melting point metal layer and the solder are melted at the reflow temperature of the solder, and the fuse element is configured to blow out due to self-generated heat when a rating-exceeding current flows through the therethrough.

41. The fuse element according to claim 24, wherein the terminal and the blowout portion are integrally formed of a same material.

42. The fuse element according to claim 40, wherein the terminal and the blowout portion are integrally formed of a same material.

43. The fuse element according to claim 24, wherein the blowout portion has a rectangular shape.

44. The fuse device according to claim 27, wherein the fuse element has a rectangular shape.

45. The fuse element according to claim 40, wherein the blowout portion has a rectangular shape.

46. The fuse element according to claim 27, wherein the high melting point metal layer is composed of Ag, Cu, or an alloy containing Ag or Cu as a main component, and the low melting point metal layer is composed of solder.

* * * * *